US010302035B2

(12) United States Patent
Okazaki

(10) Patent No.: US 10,302,035 B2
(45) Date of Patent: May 28, 2019

(54) INTERNAL COMBUSTION ENGINE

(71) Applicant: TOYOTA JIDOSHA KABUSHIKI KAISHA, Toyota-shi, Aichi (JP)

(72) Inventor: Shuntaro Okazaki, Sunto-gun (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 115 days.

(21) Appl. No.: 15/329,780

(22) PCT Filed: Jul. 28, 2015

(86) PCT No.: PCT/JP2015/003790
§ 371 (c)(1),
(2) Date: Jan. 27, 2017

(87) PCT Pub. No.: WO2016/017156
PCT Pub. Date: Feb. 4, 2016

(65) Prior Publication Data

US 2017/0218868 A1 Aug. 3, 2017

(30) Foreign Application Priority Data

Jul. 28, 2014 (JP) ..... 2014-153238

(51) Int. Cl.
*F02D 41/02* (2006.01)
*F02D 41/14* (2006.01)
(Continued)

(52) U.S. Cl.
CPC ..... *F02D 41/0295* (2013.01); *F01N 3/0864* (2013.01); *F01N 3/20* (2013.01);
(Continued)

(58) Field of Classification Search
CPC ..... F01N 3/0864; F01N 3/20; F02D 41/0295; F02D 41/1441; F02D 41/1454; F02D 41/1475; F02D 41/2454; F02D 2200/0814
(Continued)

(56) References Cited

U.S. PATENT DOCUMENTS 6,055,972 A * 5/2000 Fujimoto ..... G01N 27/4067 123/688
2002/0157381 A1 10/2002 Kakuyama et al.
(Continued)

FOREIGN PATENT DOCUMENTS

EP 1 195 507 A2 4/2002
JP 2008075495 A 4/2008
(Continued)

OTHER PUBLICATIONS

Machine Translation WO 2005/045220 done Jun. 22, 2018.*

*Primary Examiner* — Audrey K Bradley
*Assistant Examiner* — Dapinder Singh
(74) *Attorney, Agent, or Firm* — Finnegan, Henderson, Farabow, Garrett & Dunner, LLP

(57) ABSTRACT

An internal combustion engine comprises: an exhaust purification catalyst; a downstream side air-fuel ratio sensor which is arranged at a downstream side of the exhaust purification catalyst; and an air-fuel ratio control system which performs feedback control so that the air-fuel ratio of the exhaust gas flowing into the exhaust purification catalyst becomes a target air-fuel ratio. The air-fuel ratio control system switches the target air-fuel ratio to a lean set air-fuel ratio when the air-fuel ratio detected by the downstream side air-fuel ratio sensor becomes a rich judged air-fuel ratio or less; changes the target air-fuel ratio to a slight lean set air-fuel ratio after switching the target air-fuel ratio to the lean set air-fuel ratio and before an estimated value of the oxygen storage amount of the exhaust purification catalyst
(Continued)

becomes a switching reference storage amount or more; and switches the target air-fuel ratio to a rich air-fuel ratio when the estimated value of the oxygen storage amount of the exhaust purification catalyst becomes the switching reference storage amount or more.

12 Claims, 23 Drawing Sheets

(51) Int. Cl.
*F01N 3/08* (2006.01)
*F01N 3/20* (2006.01)
*F02D 41/24* (2006.01)

(52) U.S. Cl.
CPC ..... *F02D 41/1441* (2013.01); *F02D 41/1454* (2013.01); *F02D 41/1475* (2013.01); *F02D 41/2454* (2013.01); *F02D 2200/0814* (2013.01)

(58) Field of Classification Search
USPC ..... 60/286, 295
See application file for complete search history.

(56) References Cited

U.S. PATENT DOCUMENTS

| | | | | |
|---|---|---|---|---|
| 2008/0066727 | A1 | 3/2008 | Kato et al. | |
| 2010/0242934 | A1* | 9/2010 | Yonekawa | F02D 41/0295 123/672 |
| 2012/0060805 | A1* | 3/2012 | Nakano | F02D 41/0235 123/703 |
| 2013/0231845 | A1 | 9/2013 | Onoe et al. | |
| 2013/0269324 | A1* | 10/2013 | Onoe | F02D 41/1401 60/285 |
| 2015/0330323 | A1 | 11/2015 | Aoki | |
| 2016/0061084 | A1 | 3/2016 | Okazaki et al. | |

FOREIGN PATENT DOCUMENTS

| | | | |
|---|---|---|---|
| JP | 2011-69337 | A | 4/2011 |
| JP | 5360312 | B1 | 12/2013 |
| WO | WO2005/045220 | A1 | 5/2005 |
| WO | WO 2012/032631 | A1 | 3/2012 |
| WO | WO2014/118892 | A1 | 8/2014 |

* cited by examiner

INTERNAL COMBUSTION ENGINE

CROSS-REFERENCE TO RELATED APPLICATIONS

This application is a national phase application of International Application No. PCT/JP2015/003790, filed Jul. 28, 2015, and claims the priority of Japanese Application No. 2014-153238, filed Jul. 28, 2014, the content of both of which is incorporated herein by reference.

TECHNICAL FIELD

The present invention relates to an internal combustion engine.

BACKGROUND ART

In the past, a control system of an internal combustion engine which is provided with an air-fuel ratio sensor at an upstream side, in a direction of exhaust flow, of an exhaust purification catalyst, and is provided with an oxygen sensor at a downstream side thereof, in the direction of exhaust flow has been known (for example, PTL 1). In such a control system, for example, feedback control is performed based on the output of the upstream side air-fuel ratio sensor so that the output of this air-fuel ratio sensor becomes a target value corresponding to the target air-fuel ratio. In addition, the target value of the upstream side air-fuel ratio sensor is adjusted based on the output of the downstream side oxygen sensor. Note that, in the following explanation, the upstream side in the direction of exhaust flow will sometimes be simply referred to as the "upstream side", and the downstream side in the direction of exhaust flow will sometimes be simply referred to as the "downstream side".

For example, in the control system described in PTL 1, when the output voltage of the downstream side oxygen sensor is a high side threshold value or more and thus the exhaust purification catalyst is in an oxygen deficient state, the target air-fuel ratio of the exhaust gas flowing into the exhaust purification catalyst is set to an air-fuel ratio which is leaner than the stoichiometric air-fuel ratio (below, also referred to as the "lean air-fuel ratio"). Conversely, when the output voltage of the downstream side oxygen sensor is the low side threshold value or less and thus the exhaust purification catalyst is in an oxygen excess state, the target air-fuel ratio is set to an air-fuel ratio which is richer than the stoichiometric air-fuel ratio (below, also referred to as the "rich air-fuel ratio"). According to PTL 1, due to this, when the catalyst is in the oxygen deficient state or oxygen excess state, it is considered possible to quickly return the state of the exhaust purification catalyst to an intermediate state between the two states (that is, state where the exhaust purification catalyst stores a suitable amount of oxygen).

In addition, in the above control system, when the output voltage of the downstream side oxygen sensor is between the high side threshold value and low side threshold value, when the output voltage of the oxygen sensor is increasing as a general trend, the target air-fuel ratio is set to a lean air-fuel ratio. Conversely, when the output voltage of the oxygen sensor is decreasing as a general trend, the target air-fuel ratio is set to a rich air-fuel ratio. According to PTL 1, due to this, it is considered possible to prevent in advance the exhaust purification catalyst from becoming in an oxygen deficient state or in an oxygen excess state.

CITATION LIST

Patent Literature

PTL 1: Japanese Patent Publication No. 2011-069337A

SUMMARY OF INVENTION

Technical Problem

In this regard, according to the inventors of the present application, it has been proposed to provide a downstream side air-fuel ratio sensor at a downstream side of exhaust of the upstream side exhaust purification catalyst, and to control the target air-fuel ratio of the exhaust gas flowing into the exhaust purification catalyst, based on the output of the downstream side air-fuel ratio sensor, as follows. That is, when the output air-fuel ratio of the downstream side air-fuel ratio sensor becomes a rich judged air-fuel ratio, which is richer than the stoichiometric air-fuel ratio, or less, the target air-fuel ratio is switched to the lean air-fuel ratio. In addition, when the estimated value of the oxygen storage amount of the exhaust purification catalyst becomes a predetermined switching reference storage amount, which is smaller than the maximum storable oxygen amount, or more, the target air-fuel ratio is switched to the rich air-fuel ratio. By performing such control, the output air-fuel ratio of the downstream side air-fuel ratio sensor almost never becomes the lean air-fuel ratio any more. That is, the amount of outflow of $NO_x$ from the upstream side exhaust purification catalyst is decreased.

When performing such air-fuel ratio control, if increasing the lean degree (difference from the stoichiometric air-fuel ratio) when setting the target air-fuel ratio to the lean air-fuel ratio, the possibility of lean air-fuel ratio exhaust gas flowing out from the exhaust purification catalyst is increased. That is, if the operating state of the internal combustion engine suddenly changes, etc., and the air-fuel ratio of the exhaust gas flowing into the exhaust purification catalyst may temporarily fluctuate. In this case, even if the oxygen storage amount of the exhaust purification catalyst does not reach the maximum storable oxygen amount and the exhaust purification catalyst has a further margin for storing oxygen, part of the oxygen in the exhaust gas will may not be stored in the exhaust purification catalyst and flows out from the exhaust purification catalyst. At this time, along with the outflow of oxygen, $NO_x$ also flows out from the exhaust purification catalyst.

Further, if deterioration of the exhaust purification catalyst leads to decrease of the maximum storable oxygen amount, even if the above-mentioned control is performed, the oxygen storage amount of the exhaust purification catalyst will reach the maximum storable oxygen amount, and thus lean air-fuel ratio exhaust gas will flow out from the exhaust purification catalyst. At this time, the lean degree of the exhaust gas flowing out from the exhaust purification catalyst becomes larger, the larger the lean degree when setting the target air-fuel ratio to the lean air-fuel ratio. Therefore, if considering these, it is can be said to be preferable that the lean degree when setting the target air-fuel ratio to the lean air-fuel ratio be small.

However, if setting the lean degree of the target air-fuel ratio small, there is the possibility of rich air-fuel ratio exhaust gas flowing out from the exhaust purification catalyst when setting the target air-fuel ratio to the lean air-fuel ratio. That is, when setting the lean degree of the target air-fuel ratio small, if sudden change of the operating state of the internal combustion engine, etc., causes the air-fuel ratio of the exhaust gas flowing into the exhaust purification catalyst to temporarily fluctuate to the rich side, the air-fuel ratio of the exhaust gas flowing into the exhaust purification catalyst sometimes becomes a rich air-fuel ratio. Further, when performing the above-mentioned control, right after switching the target air-fuel ratio from the rich air-fuel ratio to the lean air-fuel ratio, the oxygen storage amount of the exhaust purification catalyst becomes substantially zero. Therefore, if the air-fuel ratio of the exhaust gas flowing into the exhaust purification catalyst becomes the rich air-fuel ratio, the unburned gas in the exhaust gas cannot be purified in the exhaust purification catalyst, and thus rich air-fuel ratio exhaust gas flows out from the exhaust purification catalyst.

Further, when performing feedback control based on the air-fuel ratio corresponding to the output value of the upstream side air-fuel ratio sensor (below, also referred to as "the output air-fuel ratio"), if deviation occurs in the upstream side air-fuel ratio sensor, along with this, deviation also occurs in the air-fuel ratio of the exhaust gas flowing into the exhaust purification catalyst. In particular, if the output air-fuel ratio of the upstream side air-fuel ratio sensor deviates to the lean side from the actual air-fuel ratio, the air-fuel ratio of the exhaust gas flowing into the exhaust purification catalyst deviates to the rich side. If making the lean degree of the target air-fuel ratio small, when the output air-fuel ratio of the upstream side air-fuel ratio sensor greatly deviates to the lean side, when setting the target air-fuel ratio at the lean air-fuel ratio, the air-fuel ratio of the exhaust gas flowing into the exhaust purification catalyst becomes the rich air-fuel ratio. In this case, regardless of the target air-fuel ratio being set to the lean air-fuel ratio, rich air-fuel ratio exhaust gas continues to flow out from the exhaust purification catalyst.

Therefore, in consideration of the above problem, an object of the present invention is to provide an internal combustion engine which can keep exhaust gas of rich air-fuel ratio from flowing out from the exhaust purification catalyst when setting the target air-fuel ratio to the lean air-fuel ratio.

Solution to Problem

To solve the above problem, the following inventions are provided.

(1) An internal combustion engine, comprising: an exhaust purification catalyst which is arranged in an exhaust passage of the internal combustion engine and which can store oxygen; a downstream side air-fuel ratio sensor which is arranged at a downstream side, in the direction of exhaust flow, of the exhaust purification catalyst and which detects the air-fuel ratio of the exhaust gas flowing out from the exhaust purification catalyst; and an air-fuel ratio control system which performs feedback control so that the air-fuel ratio of the exhaust gas flowing into the exhaust purification catalyst becomes a target air-fuel ratio, wherein the air-fuel ratio control system switches the target air-fuel ratio to a lean set air-fuel ratio which is leaner than a stoichiometric air-fuel ratio when the air-fuel ratio detected by the downstream side air-fuel ratio sensor becomes a rich judged air-fuel ratio, which is richer than the stoichiometric air-fuel ratio, or less; changes the target air-fuel ratio to a lean air-fuel ratio with a smaller lean degree than the lean set air-fuel ratio at a predetermined lean degree changing timing after switching the target air-fuel ratio to the lean set air-fuel ratio and before an estimated value of the oxygen storage amount of the exhaust purification catalyst becomes a predetermined switching reference storage amount, which is smaller than a maximum storable oxygen amount, or more; and switches the target air-fuel ratio to a rich air-fuel ratio which is richer than the stoichiometric air-fuel ratio, when the estimated value of the oxygen storage amount of the exhaust purification catalyst becomes the switching reference storage amount or more.

(2) The internal combustion engine according to above (1), wherein the lean degree change timing is a timing after the time when the air-fuel ratio detected by the downstream side air-fuel ratio sensor changes from the rich judged air-fuel ratio or less to an air-fuel ratio which is larger than the rich judged air-fuel ratio.

(3) The internal combustion engine according to above (1) or (2), wherein the lean degree change timing is a timing after the time when the elapsed time from when the air-fuel ratio detected by the downstream side air-fuel ratio sensor becomes the rich judged air-fuel ratio or less, becomes a predetermined time or more.

(4) The internal combustion engine according to any one of above (1) to (3), wherein the target air-fuel ratio is maintained at a constant value from the lean degree change timing until the estimated value of the oxygen storage amount of the exhaust purification catalyst becomes the switching reference storage amount or more.

(5) The internal combustion engine according to any one of above (1) to (4), wherein the lean set air-fuel ratio is changed in accordance with the air-fuel ratio detected by the downstream side air-fuel ratio sensor.

(6) The internal combustion engine according to any one of above (1) to (5), wherein the target air-fuel ratio is maintained at a constant rich set air-fuel ratio from when the target air-fuel ratio is switched to a rich air-fuel ratio to when the air-fuel ratio detected by the downstream side air-fuel ratio sensor becomes the rich judged air-fuel ratio or less.

(7) The internal combustion engine according to any one of above (1) to (5), wherein the air-fuel ratio control system switches the target air-fuel ratio to a rich set air-fuel ratio which is richer than the stoichiometric air-fuel ratio when the estimated value of the oxygen storage amount of the exhaust purification catalyst becomes the switching reference storage amount or more, and changes the target air-fuel ratio to a rich air-fuel ratio with a smaller difference from the stoichiometric air-fuel ratio than the rich set air-fuel ratio at a predetermined rich degree change timing after switching the target air-fuel ratio to the rich set air-fuel ratio and before the air-fuel ratio detected by the downstream side air-fuel ratio sensor becomes the rich judged air-fuel ratio or less.

(8) The internal combustion engine according to above (6) or (7), wherein the air-fuel ratio control system increases at least one of an average lean degree of the target air-fuel ratio while the target air-fuel ratio is set to the lean air-fuel ratio and an average rich degree of the target air-fuel ratio while the target air-fuel ratio is set to the rich air-fuel ratio, when the engine operating state is in the steady operating state and low load operating state, compared with when the engine operating state is not the steady operating state and is the medium-high load operating state.

(9) The internal combustion engine according to above (8), wherein the air-fuel ratio control system increases at least one of a lean degree of the lean set air-fuel ratio and a rich degree of the rich set air-fuel ratio, when the engine operating state is the steady operating state and low load operating state, compared with when the engine operating state is not the steady operating state and is the medium-high load operating state.

(10) The internal combustion engine according to any one of above (1) to (9), wherein an average lean degree of the target air-fuel ratio after the lean degree change timing is not changed between a case where the engine operating state is the steady operating state and low load operating state and a case where the engine operating state is not the steady operating state and is the medium-high load operating state.

(11) The internal combustion engine according to any one of above (1) to (10), wherein the air-fuel ratio control system performs learning control which corrects a parameter relating to the feedback control based on the output air-fuel ratio of the downstream side air-fuel ratio sensor, and increases at least one of an average lean degree of the target air-fuel ratio while the target air-fuel ratio is set to the lean air-fuel ratio and an average rich degree of the target air-fuel ratio while the target air-fuel ratio is set to the rich air-fuel ratio, when a learning promotion condition, which stands when it is necessary to promote correction of the parameter by the learning control, stands, compared with when the learning promotion condition does not stand.

(12) The internal combustion engine according to above (11), wherein even when the learning promotion condition stands, the lean degree of the air-fuel ratio is maintained as is without being increased from the lean degree change timing until the estimated value of the oxygen storage amount of the exhaust purification catalyst becomes the switching reference storage amount or more.

Advantageous Effects of Invention

According to the present invention, an internal combustion engine which can keep exhaust gas of rich air-fuel ratio from flowing out from the exhaust purification catalyst when setting the target air-fuel ratio to the lean air-fuel ratio, is provided.

DESCRIPTION OF EMBODIMENTS

Figure 1:
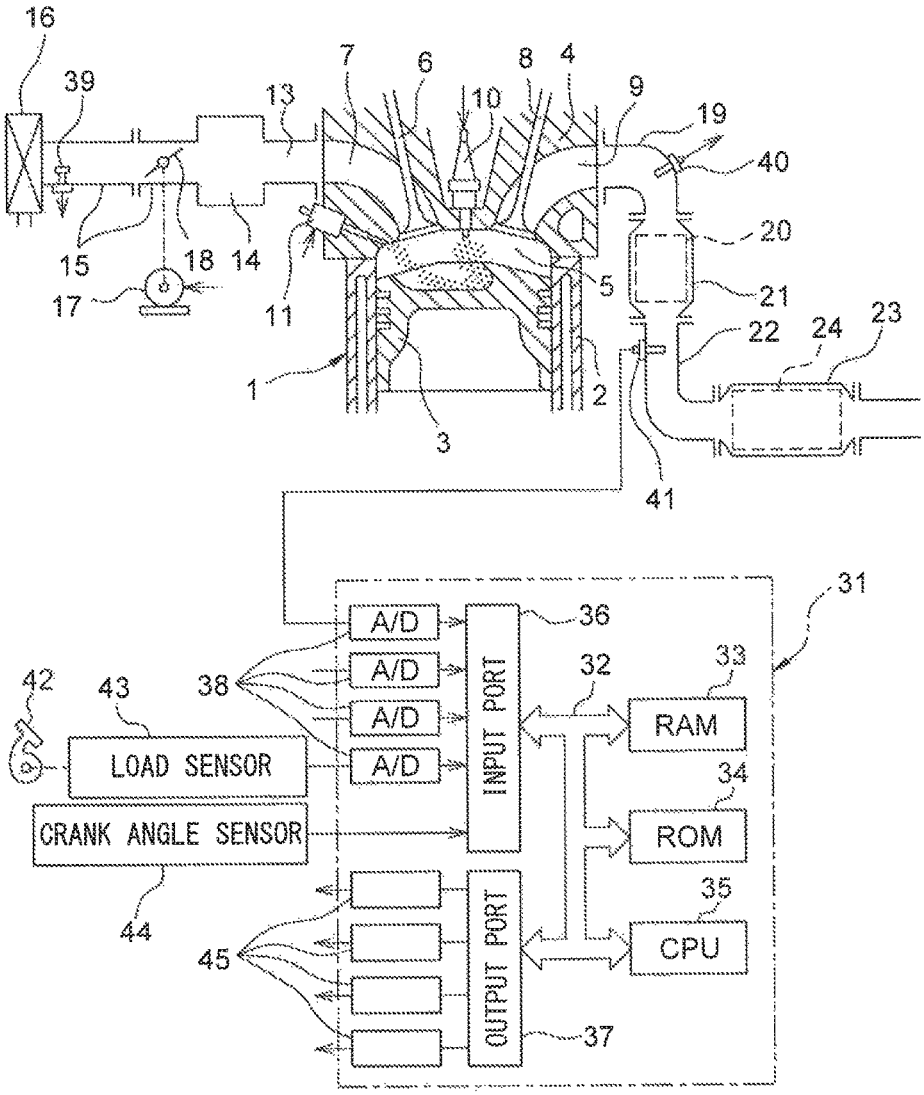
FIG. 1 is a view which schematically shows an internal combustion engine of the present invention.

Below, referring to the drawings, embodiments of the present invention will be explained in detail. Note that, in the following explanation, similar component elements are assigned the same reference numerals.

<Explanation of Internal Combustion Engine as a Whole>

FIG. 1 is a view which schematically shows an internal combustion engine according to the present invention is used. In FIG. 1, 1 indicates an engine body, 2 a cylinder block, 3 a piston which reciprocates inside the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a fuel injector 11 is arranged at a side part of the inner wall surface of the cylinder head 4. The spark plug 10 is configured to generate a spark in accordance with an ignition signal. Further, the fuel injector 11 injects a predetermined amount of fuel into the combustion chamber 5 in accordance with an injection signal. Note that, the fuel injector 11 may also be arranged so as to inject fuel into the intake port 7. Further, in the present embodiment, as the fuel, gasoline with a stoichiometric air-fuel ratio of 14.6 is used. However, the internal combustion engine of the present embodiment may also use another fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a header at which these runners are collected. The header of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an air flow meter 39 is arranged for detecting the flow rate of air which flows through the intake pipe 15. The output of this air flow meter 39 is input through a corresponding AD converter 38 to the input port 36. Further, at the header of the exhaust manifold 19, an upstream side air-fuel ratio sensor 40 is arranged which detects the air-fuel ratio of the exhaust gas which flows through the inside of the exhaust manifold 19 (that is, the exhaust gas which flows into the upstream side exhaust purification catalyst 20). In addition, in the exhaust pipe 22, a downstream side air-fuel ratio sensor 41 is arranged which detects the air-fuel ratio of the exhaust gas which flows through the inside of the exhaust pipe 22 (that is, the exhaust gas which flows out from the upstream side exhaust purification catalyst 20 and flows into the downstream side exhaust purification catalyst 24). The outputs of these air-fuel ratio sensors 40 and 41 are also input through the corresponding AD converters 38 to the input port 36.

Further, an accelerator pedal 42 has a load sensor 43 connected to it which generates an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, fuel injectors 11, and throttle valve drive actuator 17. Note that the ECU 31 functions as a control system for controlling the internal combustion engine.

Note that, the internal combustion engine according to the present embodiment is a non-supercharged internal combustion engine which is fueled by gasoline, but the internal combustion engine according to the present invention is not limited to the above configuration. For example, the internal combustion engine according to the present invention may have cylinder array, state of injection of fuel, configuration of intake and exhaust systems, configuration of valve mechanism, presence of supercharger, supercharged state, etc. which are different from the above internal combustion engine.

<Explanation of Exhaust Purification Catalyst>

The upstream side exhaust purification catalyst 20 and downstream side exhaust purification catalyst 24 in each case have similar configurations. The exhaust purification catalysts 20 and 24 are three-way catalysts which have oxygen storage abilities. Specifically, the exhaust purification catalysts 20 and 24 are comprised of carriers which are comprised of ceramic on which a precious metal which has a catalytic action (for example, platinum (Pt)) and a substance which has an oxygen storage ability (for example, ceria ($CeO_2$)) are carried. The exhaust purification catalysts 20 and 24 exhibit a catalytic action of simultaneously removing unburned gas (HC, CO, etc.) and nitrogen oxides ($NO_X$) when reaching a predetermined activation temperature and, in addition, an oxygen storage ability.

According to the oxygen storage ability of the exhaust purification catalysts 20 and 24, the exhaust purification catalysts 20 and 24 store the oxygen in the exhaust gas when the air-fuel ratio of the exhaust gas which flows into the exhaust purification catalysts 20 and 24 is leaner than the stoichiometric air-fuel ratio (lean air-fuel ratio). On the other hand, the exhaust purification catalysts 20 and 24 release the oxygen which is stored in the exhaust purification catalysts 20 and 24 when the inflowing exhaust gas has an air-fuel ratio which is richer than the stoichiometric air-fuel ratio (rich air-fuel ratio).

Figure 2A:
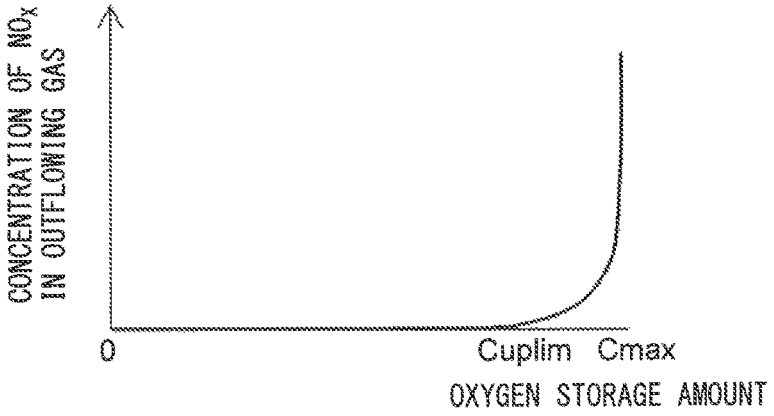
FIG. 2A is a view which shows a relationship between an oxygen storage amount of an exhaust purification catalyst and an $NO_X$ concentration in exhaust gas which flows out from the exhaust purification catalyst.

The exhaust purification catalysts 20 and 24 have a catalytic action and oxygen storage ability and thereby have the action of removing $NO_X$ and unburned gas according to the oxygen storage amount. That is, in the case where the air-fuel ratio of the exhaust gas which flows into the exhaust purification catalysts 20 and 24 is a lean air-fuel ratio, as shown in FIG. 2A, when the oxygen storage amount is small, the exhaust purification catalysts 20 and 24 store the oxygen in the exhaust gas. Further, along with this, the $NO_X$ in the exhaust gas is removed by reduction. On the other hand, if the oxygen storage amount becomes larger, the exhaust gas flowing out from the exhaust purification catalysts 20 and 24 rapidly rises in concentration of oxygen and $NO_X$ at a certain stored amount (in the figure, Cuplim) near the maximum storable oxygen amount Cmax (upper limit storage amount).

Figure 2B:
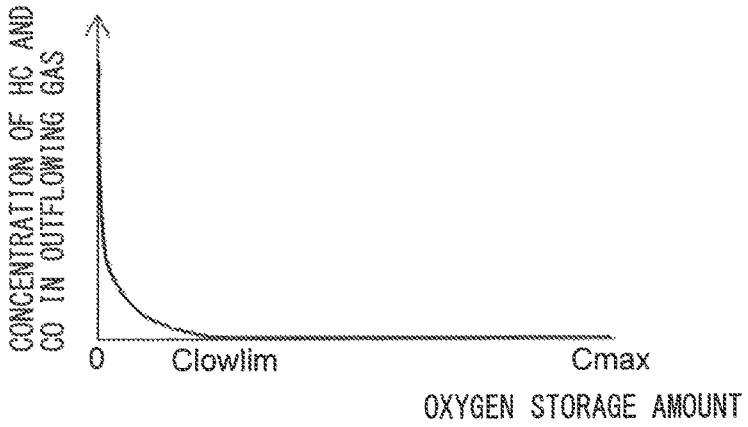
FIG. 2B is a view which shows a relationship between an oxygen storage amount of an exhaust purification catalyst and HC and CO concentrations in exhaust gas which flows out from the exhaust purification catalyst.

On the other hand, in the case where the air-fuel ratio of the exhaust gas flowing into the exhaust purification catalysts 20 and 24 is the rich air-fuel ratio, as shown in FIG. 2B, when the oxygen storage amount is large, the oxygen stored in the exhaust purification catalysts 20 and 24 is released, and the unburned gas in the exhaust gas is removed by oxidation. On the other hand, if the oxygen storage amount becomes small, the exhaust gas flowing out from the exhaust purification catalysts 20 and 24 rapidly rises in concentration of unburned gas at a certain stored amount (in the figure, Clowlim) near zero (lower limit storage amount).

In the above way, according to the exhaust purification catalysts 20 and 24 which are used in the present embodiment, the characteristics of removal of $NO_X$ and unburned gas in the exhaust gas change depending on the air-fuel ratio and oxygen storage amount of the exhaust gas which flows into the exhaust purification catalysts 20 and 24. Note that, if having a catalytic action and oxygen storage ability, the exhaust purification catalysts 20 and 24 may also be catalysts different from three-way catalysts.

<Output Characteristic of Air-Fuel Ratio Sensor>

Figure 3:
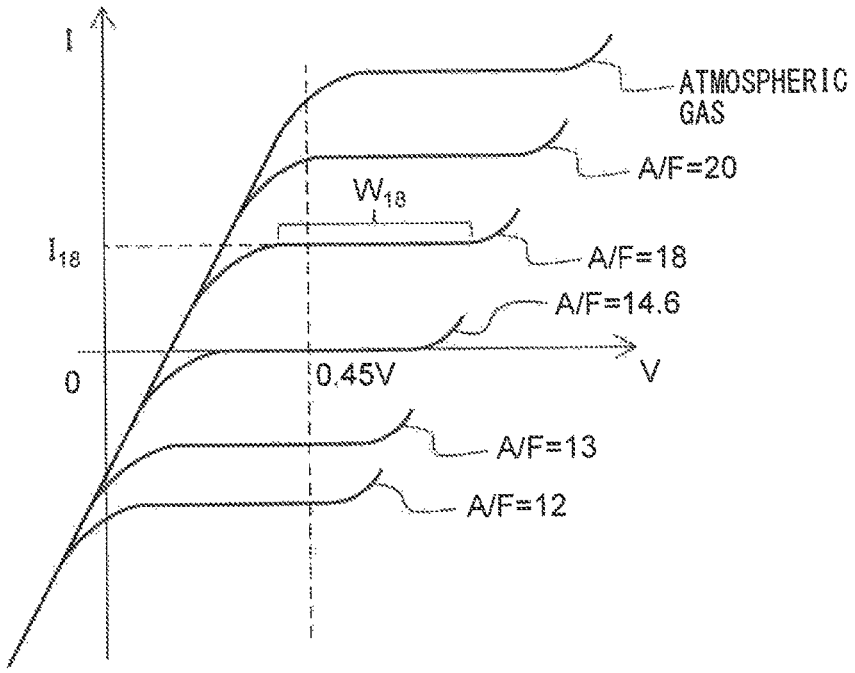
FIG. 3 is a view which shows a relationship between a sensor applied voltage and output current at each exhaust air-fuel ratio.
Figure 4:
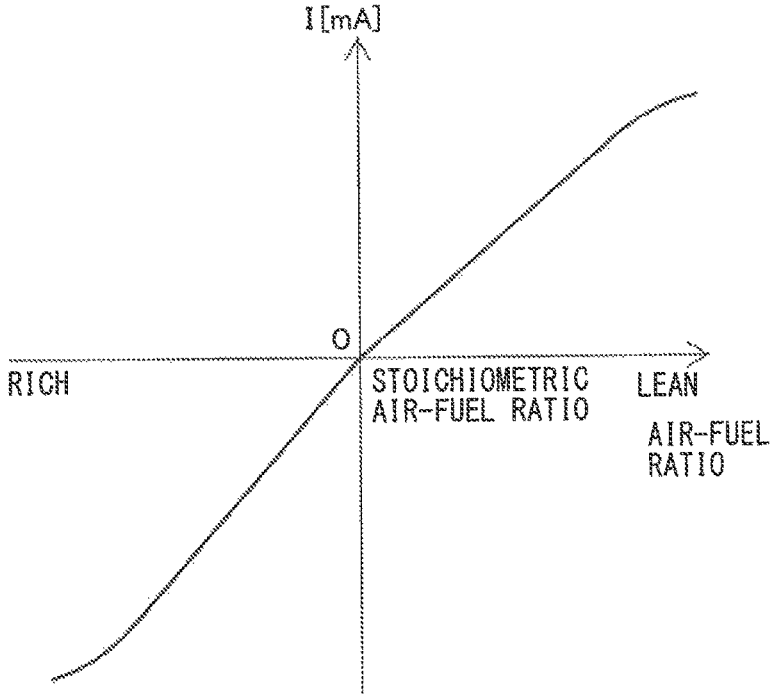
FIG. 4 is a view which shows a relationship between an exhaust air-fuel ratio and output current when making the sensor applied voltage constant.

Next, referring to FIGS. 3 and 4, the output characteristic of air-fuel ratio sensors 40 and 41 in the present embodiment will be explained. FIG. 3 is a view showing the voltage-current (V-I) characteristic of the air-fuel ratio sensors 40 and 41 of the present embodiment. FIG. 4 is a view showing the relationship between air-fuel ratio of the exhaust gas (below, referred to as "exhaust air-fuel ratio") flowing around the air-fuel ratio sensors 40 and 41 and output current I, when making the applied voltage constant. Note that, in this embodiment, the air-fuel ratio sensor having the same configurations is used as both air-fuel ratio sensors 40 and 41.

As will be understood from FIG. 3, in the air-fuel ratio sensors 40 and 41 of the present embodiment, the output current I becomes larger the higher (the leaner) the exhaust air-fuel ratio. Further, the line V-I of each exhaust air-fuel ratio has a region substantially parallel to the V axis, that is, a region where the output current does not change much at all even if the applied voltage of the sensor changes. This voltage region is referred to as the "limit current region". The current at this time is referred to as the "limit current". In FIG. 3, the limit current region and limit current when the exhaust air-fuel ratio is 18 are shown by $W_{18}$ and $I_{18}$, respectively. Therefore, the air-fuel ratio sensors 40 and 41 can be referred to as "limit current type air-fuel ratio sensors".

FIG. 4 is a view which shows the relationship between the exhaust air-fuel ratio and the output current I when making the applied voltage constant at about 0.45V. As will be understood from FIG. 4, in the air-fuel ratio sensors 40 and 41, the output current I varies linearly (proportionally) with respect to the exhaust air-fuel ratio such that the higher (that is, the leaner) the exhaust air-fuel ratio, the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio. Further, when the exhaust air-fuel ratio becomes a certain value or more or when it becomes a certain value or less, the ratio of change of the output current to the change of the exhaust air-fuel ratio becomes smaller.

Note that, in the above example, as the air-fuel ratio sensors 40 and 41, limit current type air-fuel ratio sensors are used. However, as the air-fuel ratio sensors 40 and 41, it is also possible to use air-fuel ratio sensor not a limit current type or any other air-fuel ratio sensor, as long as the output current varies linearly with respect to the exhaust air-fuel ratio. Further, the air-fuel ratio sensors 40 and 41 may have structures different from each other.

<Summary of Basic Air-Fuel Ratio Control>

Next, the air-fuel ratio control in a control system of an internal combustion engine of the present embodiment will be summarized. In air-fuel ratio control of the present embodiment, feedback control is performed based on the output air-fuel ratio of the upstream side air-fuel ratio sensor 40 to control the fuel injection amount from the fuel injector 11 so that the output air-fuel ratio of the upstream side air-fuel ratio sensor 40 becomes the target air-fuel ratio. Note that, the "output air-fuel ratio" means the air-fuel ratio which corresponds to the output value of the air-fuel ratio sensor.

On the other hand, in the air-fuel ratio control of the present embodiment, target air-fuel ratio setting control is performed to set the target air-fuel ratio based on the output air-fuel ratio of the downstream side air-fuel ratio sensor 41. In target air-fuel ratio setting control, when the output air-fuel ratio of the downstream side air-fuel ratio sensor 41 becomes a rich judged air-fuel ratio (for example, 14.55), which is slightly richer than the stoichiometric air-fuel ratio, or less, it is judged that the air-fuel ratio of the exhaust gas which is detected by the downstream side air-fuel ratio sensor 41 has become the rich air-fuel ratio. At this time, the target air-fuel ratio is set to a lean set air-fuel ratio. In this regard, the "lean set air-fuel ratio" is a predetermined air-fuel ratio which is leaner than the stoichiometric air-fuel ratio (air-fuel ratio serving as center of control) by a certain extent, and, for example, is 14.65 to 20, preferably 14.65 to 18, more preferably 14.65 to 16 or so. Further, the lean set air-fuel ratio can be expressed as an air-fuel ratio acquired by adding the lean set adjustment amount to an air-fuel ratio serving as control center (in the present embodiment, stoichiometric air-fuel ratio).

Then, if, in the state where the target air-fuel ratio is set to the lean set air-fuel ratio, the output air-fuel ratio of the downstream side air-fuel ratio sensor 41 becomes an air-fuel ratio with a smaller rich degree than the rich judged air-fuel ratio (air-fuel ratio which is closer to the stoichiometric air-fuel ratio than the rich judged air-fuel ratio), it is judged that the air-fuel ratio of the exhaust gas which is detected by the downstream side air-fuel ratio sensor 41 has become substantially the stoichiometric air-fuel ratio. At this time, the target air-fuel ratio is set to a slight lean set air-fuel ratio. In this regard, the "slight lean set air-fuel ratio" is a lean air-fuel ratio with a smaller lean degree than the lean set air-fuel ratio (smaller difference from stoichiometric air-fuel ratio), and, for example, is 14.62 to 15.7, preferably 14.63 to 15.2, more preferably 14.65 to 14.9 or so.

Further, when the target air fuel ratio is set to the lean air-fuel ratio (lean set air-fuel ratio or slight lean air-fuel ratio), the oxygen excess/deficiency of exhaust gas flowing into the upstream side exhaust purification catalyst 20 is cumulatively added. The "oxygen excess/deficiency" means an amount of the oxygen which becomes in excess or an amount of the oxygen which becomes deficient (amount of excessive unburned gas, etc.) when trying to make the air-fuel ratio of the exhaust gas flowing into the upstream side exhaust purification catalyst 20 the stoichiometric air-fuel ratio. In particular, when the target air-fuel ratio becomes the lean set air-fuel ratio, oxygen in the exhaust gas flowing into the upstream side exhaust purification catalyst 20 becomes excessive. This excess oxygen is stored in the upstream side exhaust purification catalyst 20. Therefore, the cumulative value of the oxygen excess/deficiency (below, referred to as "cumulative oxygen excess/deficiency") can be said to be the estimated value of the oxygen storage amount OSA of the upstream side exhaust purification catalyst 20.

Note that, the oxygen excess/deficiency is calculated based on the output air-fuel ratio AFup of the upstream side air-fuel ratio sensor 40 and the estimated value of the amount of intake air to the inside of the combustion chamber 5 which is calculated based on the air flow meter 39, etc., or the amount of feed of fuel from the fuel injector 11, etc. Specifically, the oxygen excess/deficiency OED is, for example, calculated by the following formula (1):

$$OED = 0.23 \cdot Qi \cdot (AF\text{up} - AFR) \quad (1)$$

In this regard, 0.23 is the oxygen concentration in the air, Qi indicates the fuel injection amount, AFup indicates the output air-fuel ratio of the upstream side air-fuel ratio sensor 40, and AFR indicates an air-fuel ratio serving as control center (in the present embodiment, the stoichiometric air-fuel ratio).

When the cumulative oxygen excess/deficiency acquired by cumulatively adding the oxygen excess/deficiency calculated as above becomes a predetermined switching reference value (corresponding to the switching reference storage amount Cref) or more, the target air-fuel ratio is set to a rich set air-fuel ratio. The "rich set air-fuel ratio" is a predetermined air-fuel ratio which is slightly richer than the stoichiometric air-fuel ratio (air-fuel ratio serving as the control center), and, for example, is 13.50 to 14.58, preferably 14.00 to 14.57, more preferably 14.30 to 14.55 or so. Further, the rich set air-fuel ratio can be expressed as an air-fuel ratio acquired by subtracting the rich set adjustment amount from an air-fuel ratio serving as control center (in the present embodiment, stoichiometric air-fuel ratio). Note that, in the present embodiment, the difference between the rich set air-fuel ratio and the stoichiometric air-fuel ratio (rich degree) is equal to or less than the difference between the lean set air-fuel ratio and the stoichiometric air-fuel ratio (lean degree). Then, when the output air-fuel ratio of the downstream side air-fuel ratio sensor 41 again becomes the rich judged air-fuel ratio or less, the target air-fuel ratio is again set to the lean set air-fuel ratio.

As a result, in the present embodiment, when the output air-fuel ratio of the downstream side air-fuel ratio sensor 41 becomes a rich judged air-fuel ratio or less, first, the target air-fuel ratio is set to the lean set air-fuel ratio. Then, when the output air-fuel ratio of the downstream side air-fuel ratio sensor 41 becomes larger than the rich judged air-fuel ratio, the target air-fuel ratio is set to the slight lean set air-fuel ratio. On the other hand, if the cumulative oxygen excess/deficiency from when the target air-fuel ratio is switched to the rich set air-fuel ratio becomes a predetermined switching reference value or more, the target air-fuel ratio is set to the rich set air-fuel ratio. Then, similar control is repeated.

Note that, even when performing the above-mentioned control, sometimes the actual oxygen storage amount of the upstream side exhaust purification catalyst 20 reaches the maximum storable oxygen amount before the cumulative oxygen excess/deficiency reaches the switching reference value. As the cause of this, for example, the fact that the maximum storable oxygen amount of the upstream side exhaust purification catalyst 20 falls or the fact that the air-fuel ratio of the exhaust gas flowing into the upstream side exhaust purification catalyst 20 temporarily rapidly changes may be mentioned. If the oxygen storage amount reaches the maximum storable oxygen amount in this way, exhaust gas of lean air-fuel ratio flows out from the upstream side exhaust purification catalyst 20. Therefore, in the present embodiment, when the output air-fuel ratio of the downstream side air-fuel ratio sensor 41 becomes a lean air-fuel ratio, the target air-fuel ratio is switched to the rich set air-fuel ratio. In particular, in the present embodiment, when the output air-fuel ratio of the downstream side air-fuel ratio sensor 41 becomes a lean judged air-fuel ratio (for example, 14.65), which is slightly leaner than the stoichiometric air-fuel ratio, or more, it is judged that the output air-fuel ratio of the downstream side air-fuel ratio sensor 41 has become a lean air-fuel ratio.

Further, the rich judged air-fuel ratio and lean judged air-fuel ratio are air-fuel ratios within 1% of the stoichiometric air-fuel ratio, preferably within 0.5%, more preferably within 0.35%. Therefore, the difference between the rich judged air-fuel ratio or lean judged air-fuel ratio and the stoichiometric air-fuel ratio is 0.15 or less when the stoichiometric air-fuel ratio is 14.6, preferably 0.073 or less, more preferably 0.051 or less. Further, the difference between the target air-fuel ratio (for example, slight lean set air-fuel ratio or lean set air-fuel ratio) and the stoichiometric air-fuel ratio is set larger than the above-mentioned difference.

<Explanation of Air-Fuel Ratio Control Using Time Chart>

Figure 5:
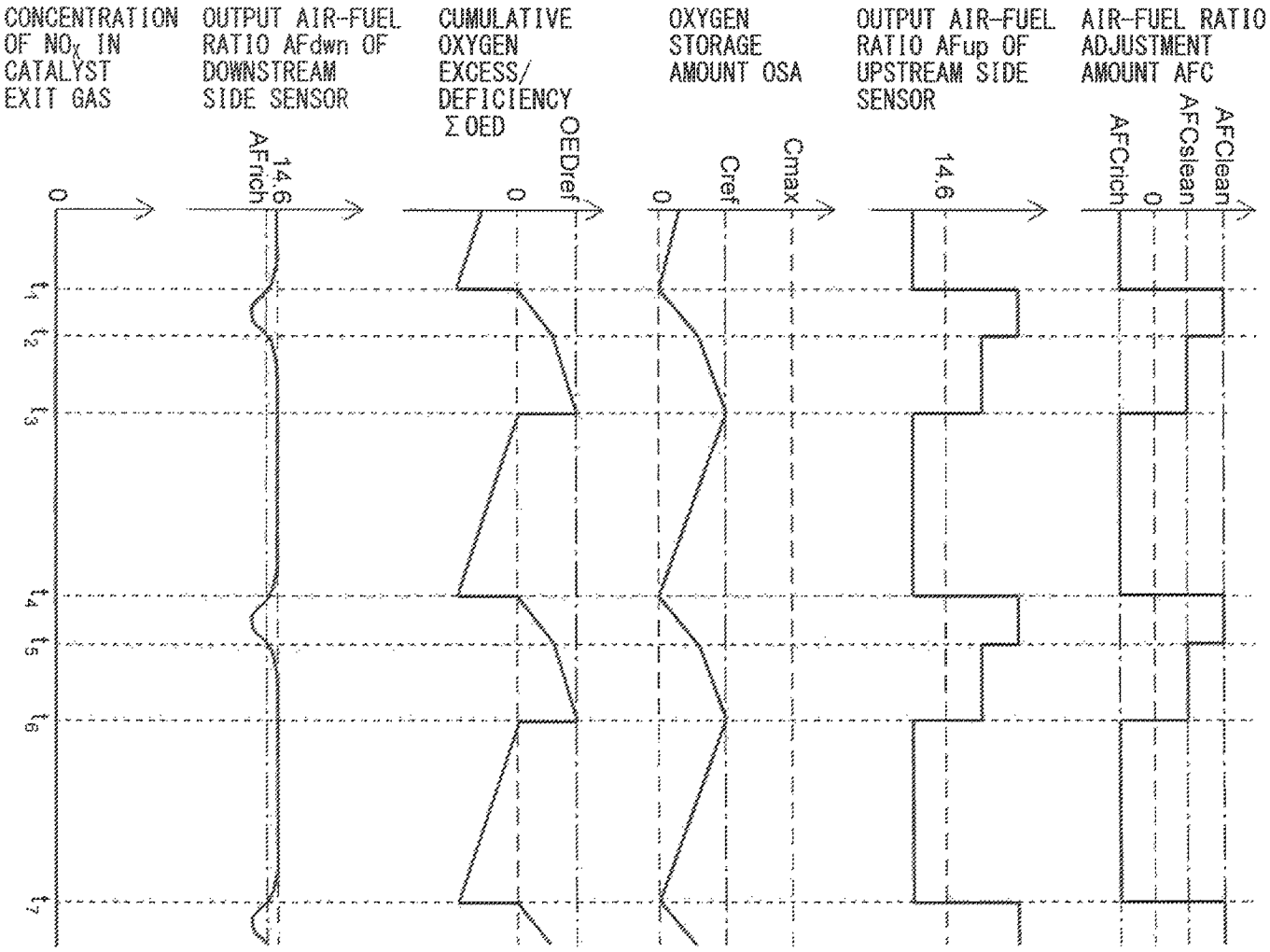
FIG. 5 is a time chart of an air-fuel ratio adjustment amount, etc., when performing air-fuel ratio control according to a control system of an internal combustion engine according to a first embodiment.

Referring to FIG. 5, the above-mentioned operation will be specifically explained. FIG. 5 is a time chart of the air-fuel ratio adjustment amount AFC, the output air-fuel ratio AFup of the upstream side air-fuel ratio sensor 40, the oxygen storage amount OSA of the upstream side exhaust purification catalyst 20, the cumulative oxygen excess/deficiency ΣOED, the output air-fuel ratio AFdwn of the downstream side air-fuel ratio sensor 41, and the $NO_X$ concentration in the exhaust gas flowing out from the upstream side exhaust purification catalyst 20, in the case of performing air-fuel ratio control of the present embodiment.

Note that, the air-fuel ratio adjustment amount AFC is an adjustment amount relating to the target air-fuel ratio of the exhaust gas flowing into the upstream side exhaust purification catalyst 20. When the air-fuel ratio adjustment amount AFC is 0, the target air-fuel ratio is made an air-fuel ratio equal to the air-fuel ratio serving as the control center (below, referred to as the "control center air-fuel ratio") (in the present embodiment, the stoichiometric air-fuel ratio), when the air-fuel ratio adjustment amount AFC is a positive value, the target air-fuel ratio is made an air-fuel ratio leaner than the control center air-fuel ratio (in the present embodiment, the lean air-fuel ratio), and when the air-fuel ratio adjustment amount AFC is a negative value, the target air-fuel ratio is made an air-fuel ratio richer than the control center air-fuel ratio (in the present embodiment, rich air-fuel ratio). Further, the "control center air-fuel ratio" means the air-fuel ratio to which the air-fuel ratio adjustment amount AFC is added in accordance with the engine operating state, that is, the air-fuel ratio serving as the reference when making the target air-fuel ratio fluctuate in accordance with the air-fuel ratio adjustment amount AFC.

In the illustrated example, in the state before the time $t_1$, the air-fuel ratio adjustment amount AFC is set to the rich set adjustment amount AFCrich (corresponding to rich set air-fuel ratio). That is, the target air-fuel ratio is set to the rich air-fuel ratio. Along with this, the output air-fuel ratio of the upstream side air-fuel ratio sensor 40 becomes the rich air-fuel ratio. The unburned gas, which is contained in the exhaust gas flowing into the upstream side exhaust purification catalyst 20, is purified by the upstream side exhaust purification catalyst 20. Along with this, the oxygen storage amount OSA of the upstream side exhaust purification catalyst 20 gradually decreases. Therefore, the cumulative oxygen excess/deficiency ΣOED also gradually decreases. Due to purification at the upstream side exhaust purification catalyst 20, the exhaust gas flowing out from the upstream side exhaust purification catalyst 20 does not contain unburned gas, and therefore the output air-fuel ratio AFdwn of the downstream side air-fuel ratio sensor 41 becomes substantially the stoichiometric air-fuel ratio. Since the air-fuel ratio of the exhaust gas flowing into the upstream side exhaust purification catalyst 20 has been the rich air-fuel ratio, the exhaust amount of $NO_X$ from the upstream side exhaust purification catalyst 20 is substantially zero.

If the oxygen storage amount OSA of the upstream side exhaust purification catalyst 20 gradually decreases, the oxygen storage amount OSA approaches zero. Along with this, part of the unburned gas flowing into the upstream side exhaust purification catalyst 20 starts to flow out without being purified by the upstream side exhaust purification catalyst 20. Due to this, the output air-fuel ratio AFdwn of the downstream side air-fuel ratio sensor 41 gradually falls. As a result, at the time $t_1$, the output air-fuel ratio AFdwn of the downstream side air-fuel ratio sensor 41 reaches the rich judged air-fuel ratio AFrich.

In the present embodiment, if the output air-fuel ratio AFdwn of the downstream side air-fuel ratio sensor 41 becomes the rich judged air-fuel ratio AFrich or less, in order to make the oxygen storage amount OSA increase, the air-fuel ratio adjustment amount AFC is switched to the lean set adjustment amount AFClean (corresponding to lean set air-fuel ratio). Therefore, the target air-fuel ratio is switched from the rich air-fuel ratio to the lean air-fuel ratio. Further, at this time, the cumulative oxygen excess/deficiency ΣOED is reset to 0.

Note that, in the present embodiment, the air-fuel ratio adjustment amount AFC is not switched immediately after the output air-fuel ratio AFdwn of the downstream side air-fuel ratio sensor 41 changes from the stoichiometric air-fuel ratio to the rich air-fuel ratio, but is switched after the rich judged air-fuel ratio AFrich is reached. This is because even if the oxygen storage amount OSA of the upstream side exhaust purification catalyst 20 is sufficient, sometimes the air-fuel ratio of the exhaust gas flowing out from the upstream side exhaust purification catalyst 20 deviates very slightly from the stoichiometric air-fuel ratio. Conversely speaking, the rich judged air-fuel ratio is set to an air-fuel ratio which the air-fuel ratio of the exhaust gas flowing out from the upstream side exhaust purification catalyst 20 never reaches when the oxygen storage amount of the upstream side exhaust purification catalyst 20 is sufficient. Note that the same can be said for the above-mentioned lean judged air-fuel ratio.

If switching the target air-fuel ratio to the lean air-fuel ratio at the time $t_1$, the air-fuel ratio of the exhaust gas flowing into the upstream side exhaust purification catalyst 20 changes from the rich air-fuel ratio to the lean air-fuel ratio. Further, along with this, the output air-fuel ratio AFup of the upstream side air-fuel ratio sensor 40 becomes the lean air-fuel ratio (in actuality, a delay occurs from when switching the target air-fuel ratio to when the air-fuel ratio of the exhaust gas flowing into the upstream side exhaust purification catalyst 20 changes, but in the illustrated example, it is assumed for convenience that they change simultaneously). If the air-fuel ratio of the exhaust gas flowing into the upstream side exhaust purification catalyst 20 changes to the lean air-fuel ratio at the time $t_1$, the oxygen storage amount OSA of the upstream side exhaust purification catalyst 20 increases. Further, along with this, the cumulative oxygen excess/deficiency ΣOED gradually increases.

If, in this way, the oxygen storage amount OSA of the upstream side exhaust purification catalyst 20 increases, the air-fuel ratio of the exhaust gas flowing out from the upstream side exhaust purification catalyst 20 changes toward the stoichiometric air-fuel ratio. Therefore, the output air-fuel ratio AFdwn of the downstream side air-fuel ratio sensor 41 also changes toward the stoichiometric air-fuel ratio. In the example shown in FIG. 5, at the time $t_2$, the output air-fuel ratio AFdwn of the downstream side air-fuel ratio sensor 41 becomes a value larger than the rich judged air-fuel ratio AFrich. That is, the output air-fuel ratio AFdwn of the downstream side air-fuel ratio sensor 41 also becomes substantially the stoichiometric air-fuel ratio. This means the oxygen storage amount OSA of the upstream side exhaust purification catalyst 20 becomes greater by a certain extent.

Therefore, in the present embodiment, when the output air-fuel ratio AFdwn of the downstream side air-fuel ratio sensor 41 changes to a value larger than the rich judged air-fuel ratio AFrich, the air-fuel ratio adjustment amount AFC is switched to the slight lean set adjustment amount AFCslean (corresponding to slight lean set air-fuel ratio). Therefore, at the time $t_2$, the lean degree of the target air-fuel ratio is lowered. Below, the time $t_2$ is called the "lean degree change timing".

At the lean degree change timing of the time $t_2$, if switching the air-fuel ratio adjustment amount AFC to the slight lean set adjustment amount AFCslean, the lean degree of the exhaust gas flowing into the upstream side exhaust purification catalyst 20 also becomes smaller. Along with this, the output air-fuel ratio AFup of the upstream side air-fuel ratio sensor 40 becomes smaller and the increasing speed of the oxygen storage amount OSA of the upstream side exhaust purification catalyst 20 falls.

After the time $t_2$, the oxygen storage amount OSA of the upstream side exhaust purification catalyst 20 gradually increases, though the increase speed thereof is slow. If the oxygen storage amount OSA of the upstream side exhaust purification catalyst 20 gradually increases, the oxygen storage amount OSA of the upstream side exhaust purification catalyst 20 reaches the switching reference storage amount Cref at the time $t_3$. Therefore, the cumulative oxygen excess/deficiency ΣOED reaches the switching reference value OEDref which corresponds to the switching reference storage amount Cref. In the present embodiment, if the cumulative oxygen excess/deficiency ΣOED becomes the switching reference value OEDref or more, the air-fuel ratio correction amount AFC is switched to the rich set correction amount AFCrich (value smaller than 0), in order to suspend the storage of oxygen in the upstream side exhaust purification catalyst 20. Therefore, the target air-fuel ratio is set to the rich air-fuel ratio. Further, at this time, the cumulative oxygen excess/deficiency ΣOED is reset to 0.

In this regard, in the example shown in FIG. 5, the oxygen storage amount OSA falls simultaneously with the target air-fuel ratio being switched at the time $t_3$, but in actuality, a delay occurs from when the target air-fuel ratio is switched to when the stored amount of oxygen OSA falls. In addition, sometimes the air-fuel ratio of the exhaust gas flowing into the upstream side exhaust purification catalyst 20 unintentionally, instantaneously and greatly deviates from the target air-fuel ration, for example, when the engine load becomes higher by the acceleration of the vehicle mounting the internal combustion engine and thus the intake air amount instantaneously greatly deviates.

As opposed to this, the switching reference storage amount Cref is set sufficiently lower than the maximum storable oxygen amount Cmax of when the upstream side exhaust purification catalyst 20 is unused. Therefore, even if such a delay occurs or even if the actual air-fuel ratio unintentionally, instantaneously and greatly deviates from the target air-fuel ratio as staged above, the oxygen storage amount OSA does not reach the maximum storable oxygen amount Cmax. Conversely speaking, the switching reference storage amount Cref is set to an amount sufficiently small so that the oxygen storage amount OSA does not reach the maximum storable oxygen amount Cmax even if the above-mentioned delay or unintentional deviation in the air-fuel ratio occurs. For example, the switching reference storage amount Cref is set to ¾ or less of the maximum storable oxygen amount Cmax when the upstream side exhaust purification catalyst 20 is unused, preferably ½ or less, more preferably ⅕ or less. As a result, the air-fuel ratio adjustment amount AFC is switched to the rich set adjustment amount AFCrich, before the output air-fuel ratio AFdwn of the downstream side air-fuel ratio sensor 41 reaches the lean judged air-fuel ratio AFlean.

At the time $t_3$, if the target air-fuel ratio is switched to the rich air-fuel ratio, the air-fuel ratio of the exhaust gas flowing into the upstream side exhaust purification catalyst 20 changes from the lean air-fuel ratio to the rich air-fuel ratio. Along with this, the output air-fuel ratio AFup of the upstream side air-fuel ratio sensor 40 becomes the rich air-fuel ratio (in actuality, a delay occurs from when the target air-fuel ratio is switched to when the exhaust gas flowing into the upstream side exhaust purification catalyst 20 changes in air-fuel ratio, but in the illustrated example, it is deemed for convenience that the change is simultaneous). Since the exhaust gas flowing into the upstream side exhaust purification catalyst 20 contains unburned gas, the upstream side exhaust purification catalyst 20 gradually decreases in oxygen storage amount OSA, and then the output air-fuel ratio AFdwn of the downstream side air-fuel ratio sensor 41 starts to fall. During this period as well, the air-fuel ratio of the exhaust gas flowing into the upstream side exhaust purification catalyst 20 is the rich air-fuel ratio, and therefore substantially zero $NO_X$ is exhausted from the upstream side exhaust purification catalyst 20.

Next, at the time $t_4$, in the same way as time $t_1$, the output air-fuel ratio AFdwn of the downstream side air-fuel ratio sensor 41 reaches the rich judged air-fuel ratio AFrich. Due to this, the air-fuel ratio adjustment amount AFC is switched to the value AFClean corresponding to the lean set air-fuel ratio. Then, the cycle of the above mentioned times $t_1$ to $t_4$ is repeated.

<Effects in the Air-Fuel Ratio Control>

As will be understood from the above explanation, according to the present embodiment, it is possible to constantly suppress the amount of $NO_X$ exhausted from the upstream side exhaust purification catalyst 20. That is, so long as performing the above mentioned control, basically it is possible to reduce the amount of $NO_X$ exhausted from the upstream side exhaust purification catalyst 20 to substantially zero. Further, since a cumulative time period in calculating the cumulative oxygen excess/deficiency ΣOED is short, and thus calculation error is difficult to occur, compering with the case where the cumulative time period is long. Therefore, it is possible to suppress the exhaust of $NO_X$ due to the calculation errors in the cumulative oxygen excess/deficiency ΣOED.

Further, in general, if the oxygen storage amount of the exhaust purification catalyst is maintained constant, the exhaust purification catalyst falls in oxygen storage ability. That is, to maintain the exhaust purification catalyst high in oxygen storage ability, the stored amount of oxygen of the exhaust purification catalyst has to fluctuate. As opposed to this, according to the present embodiment, as shown in FIG. 5, the oxygen storage amount OSA of the upstream side exhaust purification catalyst 20 constantly fluctuates up and down, and therefore the oxygen storage ability is kept from falling.

In addition, according to the above-mentioned air-fuel ratio control, during the times $t_2$ to $t_3$, the target air-fuel ratio is set to a slight lean set air-fuel ratio with a small lean degree. Further, during the times $t_3$ to $t_4$, the target air-fuel ratio is set to a rich set air-fuel ratio with a small rich degree. Therefore, in this time period, even if the air-fuel ratio of the exhaust gas flowing into the upstream side exhaust purification catalyst 20 temporarily fluctuates, by, for example, the rapid change in the operating state of the internal combustion engine, it is possible to suppress the outflow of $NO_X$ or unburned gas from the upstream side exhaust purification catalyst 20.

Further, according to the above-mentioned air-fuel ratio control, at the time $t_1$ and time $t_4$, etc., right after the target air-fuel ratio is changed from the rich air-fuel ratio to the lean air-fuel ratio (that is, times $t_1$ to $t_2$ and $t_4$ to $t_5$), the target air-fuel ratio is set to a lean air-fuel ratio with a large lean degree. Therefore, at the times $t_1$ and $t_4$, the unburned gas which flowed out from the upstream side exhaust purification catalyst 20 can be quickly reduced. Therefore, the outflow of the unburned gas from the upstream side exhaust purification catalyst 20 can be suppressed.

Furthermore, in the above-mentioned air-fuel ratio control, at the time $t_1$ and time $t_4$, etc., the oxygen storage amount OSA of the upstream side exhaust purification catalyst 20 becomes substantially zero. However, right after the time $t_1$ and time $t_4$, the target air-fuel ratio is set to a lean air-fuel ratio with a large lean degree. Therefore, in this time period (that is, times $t_1$ to $t_2$ and times $t_4$ to $t_5$), even if the air-fuel ratio of the exhaust gas flowing into the upstream side exhaust purification catalyst 20 temporarily fluctuates to the rich side from the target air-fuel ratio, by, for example, a rapid change in the operating state of the internal combustion engine, the air-fuel ratio of the exhaust gas is maintained at the lean air-fuel ratio as is. Therefore, even if fluctuation occurs in the air-fuel ratio of the exhaust gas in this way, rich air-fuel ratio exhaust gas which contains unburned gas is kept from flowing out from the upstream side exhaust purification catalyst 20.

Further, as explained above, when the output air-fuel ratio of the upstream side air-fuel ratio sensor 40 deviates to the lean side, the air-fuel ratio of the exhaust gas flowing into the upstream side exhaust purification catalyst 20 becomes an air-fuel ratio which is deviated to the rich side from the target air-fuel ratio. As opposed to this, according to the above-mentioned air-fuel ratio control, as explained above, right after the target air-fuel ratio is changed from the rich air-fuel ratio to the lean air-fuel ratio at the time $t_1$ and time $t_4$, etc., (that is, times $t_1$ to $t_2$ and times $t_4$ to $t_5$), the target air-fuel ratio is set to a lean air-fuel ratio with a large lean degree. Therefore, even if the output air-fuel ratio of the upstream side air-fuel ratio sensor 40 deviates to the lean side, during the times $t_1$ to $t_2$ and the times $t_4$ to $t_5$, the air-fuel ratio of the exhaust gas flowing into the upstream side exhaust purification catalyst 20 is maintained at the lean air-fuel ratio as is. Therefore, at least between the times $t_1$ and $t_2$ and between the times $t_4$ and $t_5$, the oxygen storage amount OSA of the upstream side exhaust purification catalyst 20 increases. Therefore, even when the output air-fuel ratio of the upstream side air-fuel ratio sensor 40 deviates to the lean side, rich air-fuel ratio exhaust gas continuing to flow out from the upstream side exhaust purification catalyst 20 can be suppressed.

Modification of First Embodiment

Figure 6:
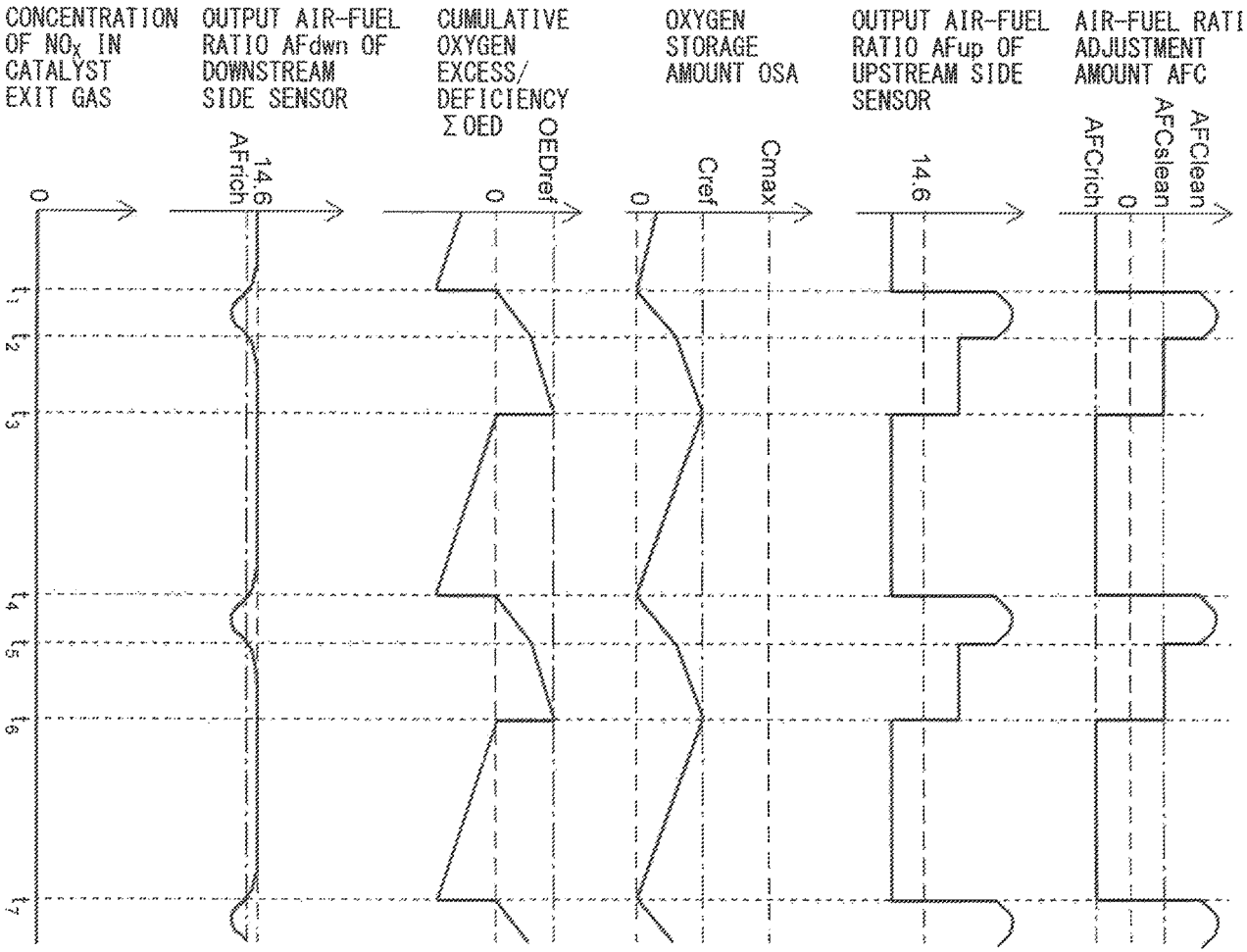
FIG. 6 is a time chart of an air-fuel ratio adjustment amount, etc., when performing air-fuel ratio control according to the control system of an internal combustion engine according to the first embodiment.

Note that, in the above embodiment, during the times $t_1$ to $t_2$ and times $t_4$ to $t_5$, the target air-fuel ratio is set to a predetermined constant lean set air-fuel ratio. However, the lean set air-fuel ratio need not necessarily be a constant value and may also fluctuate. For example, the lean set air-fuel ratio may be set to change in accordance with the rich degree of the current output air-fuel ratio of the downstream side air-fuel ratio sensor 41. In this case, specifically, the larger the rich degree of the current output air-fuel ratio AFdwn of the downstream side air-fuel ratio sensor 41 becomes, the larger the lean degree of the lean set air-fuel ratio becomes. This state is shown in FIG. 6. In the example shown in FIG. 6, during the times $t_1$ to $t_2$, that is, in the time period when the target air-fuel ratio is set to the lean set air-fuel ratio, the lower the output air-fuel ratio AFdwn of the downstream side air-fuel ratio sensor 41 becomes, the larger the air-fuel ratio adjustment amount AFC is set.

Alternatively, the lean set air-fuel ratio may be changed in accordance with the maximum value at the rich degree of the output air-fuel ratio AFdwn of the downstream side air-fuel ratio sensor 41 when the target air-fuel ratio is set to the previous lean set air-fuel ratio (below, referred to as the "maximum rich degree"). That is, if referring to the example shown in FIG. 5 in this case, the lean set air-fuel ratio during the times $t_4$ to $t_5$ is changed in accordance with the maximum rich degree of the output air-fuel ratio AFdwn of the downstream side air-fuel ratio sensor 41 during the times $t_1$ to $t_2$. In this case, specifically, the larger the maximum rich degree of the output air-fuel ratio AFdwn of the downstream side air-fuel ratio sensor 41 when the target air-fuel ratio is previously set to the lean set air-fuel ratio, the larger the lean degree the current lean set air-fuel ratio is set to become. If expressing these together, the lean set air-fuel ratio may also be set in accordance with the rich degree of the output air-fuel ratio of the downstream side air-fuel ratio sensor 41.

Similarly, in the above embodiment, during the times $t_2$ to $t_3$, etc., the target air-fuel ratio is set to a predetermined constant slight lean set air-fuel ratio. However, the slight lean set air-fuel ratio does not necessarily have to be a constant value and may also fluctuate. For example, the slight lean set air-fuel ratio may be changed so as to gradually become smaller in lean degree as the elapsed time from the lean degree change timing becomes longer. However, whatever the case, the slight rich set air-fuel ratio is set to a value smaller than the minimum value of the rich set air-fuel ratio during the times $t_1$ to $t_2$ at all times.

Further, in the above embodiment, the time when the output air-fuel ratio AFdwn of the downstream side air-fuel ratio sensor 41 changes to a value larger than the rich judged air-fuel ratio AFrich is set to the lean degree change timing, which is the timing of switching the target air-fuel ratio from the lean set air-fuel ratio to the slight lean set air-fuel ratio. The lean degree change timing is set to this timing for the following reason. The output air-fuel ratio AFdwn of the downstream side air-fuel ratio sensor 41 changing to a value larger than the rich judged air-fuel ratio AFrich means the rich air-fuel ratio exhaust gas does not flow out from the upstream side exhaust purification catalyst 20. That is, this means that the oxygen storage amount OSA of the upstream side exhaust purification catalyst 20 is increasing. Therefore, if setting the lean degree change timing such a timing, it is possible to make at least the upstream side exhaust purification catalyst 20 store a certain extent of oxygen.

However, the lean degree change timing need not necessarily be this time. Therefore, for example, the lean degree change timing may be a timing after the time when the output air-fuel ratio AFdwn of the downstream side air-fuel ratio sensor 41 changes to a value which is larger than the rich judged air-fuel ratio AFrich. Therefore, the lean degree change timing may also be set to the timing when the elapsed time from the time when the output air-fuel ratio AFdwn of the downstream side air-fuel ratio sensor 41 becomes a value larger than the rich judged air-fuel ratio AFrich becomes a predetermined time, or the timing when the cumulative oxygen excess/deficiency or cumulative intake air amount from the above time becomes a predetermined amount. However, in this case, the lean degree change timing is set to a timing before the estimated value of the oxygen storage amount OSA of the upstream side exhaust purification catalyst 20 becomes the switching reference storage amount Cref or more.

Alternatively, without using the output air-fuel ratio AFdwn of the downstream side air-fuel ratio sensor 41, the lean degree change timing may be set to the timing when the elapsed time from the time when the target air-fuel ratio is switched to the lean air-fuel ratio becomes a predetermined time, or the timing when the cumulative oxygen excess/deficiency or cumulative intake air amount from the above time becomes a predetermined amount. In this case, the predetermined time is set to a time longer than the time which is usually taken until when the output air-fuel ratio AFdwn of the downstream side air-fuel ratio sensor 41 becomes larger than the rich judged air-fuel ratio AFrich. Similarly, the predetermined amount is set to an amount greater than the cumulative oxygen excess/deficiency or cumulative intake air amount which is normally reached until when the output air-fuel ratio AFdwn of the downstream side air-fuel ratio sensor 41 becomes larger than the rich judged air-fuel ratio AFrich. However, in this case as well, the lean degree change timing is set to a timing before the estimated value of the oxygen storage amount OSA of the upstream side exhaust purification catalyst 20 becomes the switching reference storage amount Cref or more.

Whatever the case, the lean degree change timing, which is the timing for switching the target air-fuel ratio from the lean set air-fuel ratio to the slight lean set air-fuel ratio, is set to a timing after switching the target air-fuel ratio to the lean set air-fuel ratio and before the estimated value of the oxygen storage amount OSA of the upstream side exhaust purification catalyst 20 becomes a switching reference storage amount Cref or more.

Further, in the above embodiment, the cumulative oxygen excess/deficiency ΣOED is calculated based on the output air-fuel ratio AFup of the upstream side air-fuel ratio sensor 40 and the estimated value of the intake air amount into the combustion chamber 5, etc. However, the oxygen excess/deficiency OSA may be calculated based on other parameters in addition to the above parameters, or based only on other parameters different from the above parameters. Further, in the above embodiment, if the cumulative oxygen excess/deficiency ΣOED becomes the switching reference value OEDref or more, the target air-fuel ratio is switched from the lean set air-fuel ratio to the rich set air-fuel ratio. However, the timing for switching the target air-fuel ratio from the lean set air-fuel ratio to the rich set air-fuel ratio may be determined based on another parameter, such as an engine operating time or cumulative intake air amount from when the target air-fuel ratio is switched from the rich set air-fuel ratio to the lean set air-fuel ratio. However, even in this case, the target air-fuel ratio needs to be switched from the lean set air-fuel ratio to the rich set air-fuel ratio, while the oxygen storage amount OSA of the upstream side exhaust purification catalyst 20 is estimated to be smaller than the maximum storable oxygen amount.

<Explanation of Specific Control>

Figure 7:
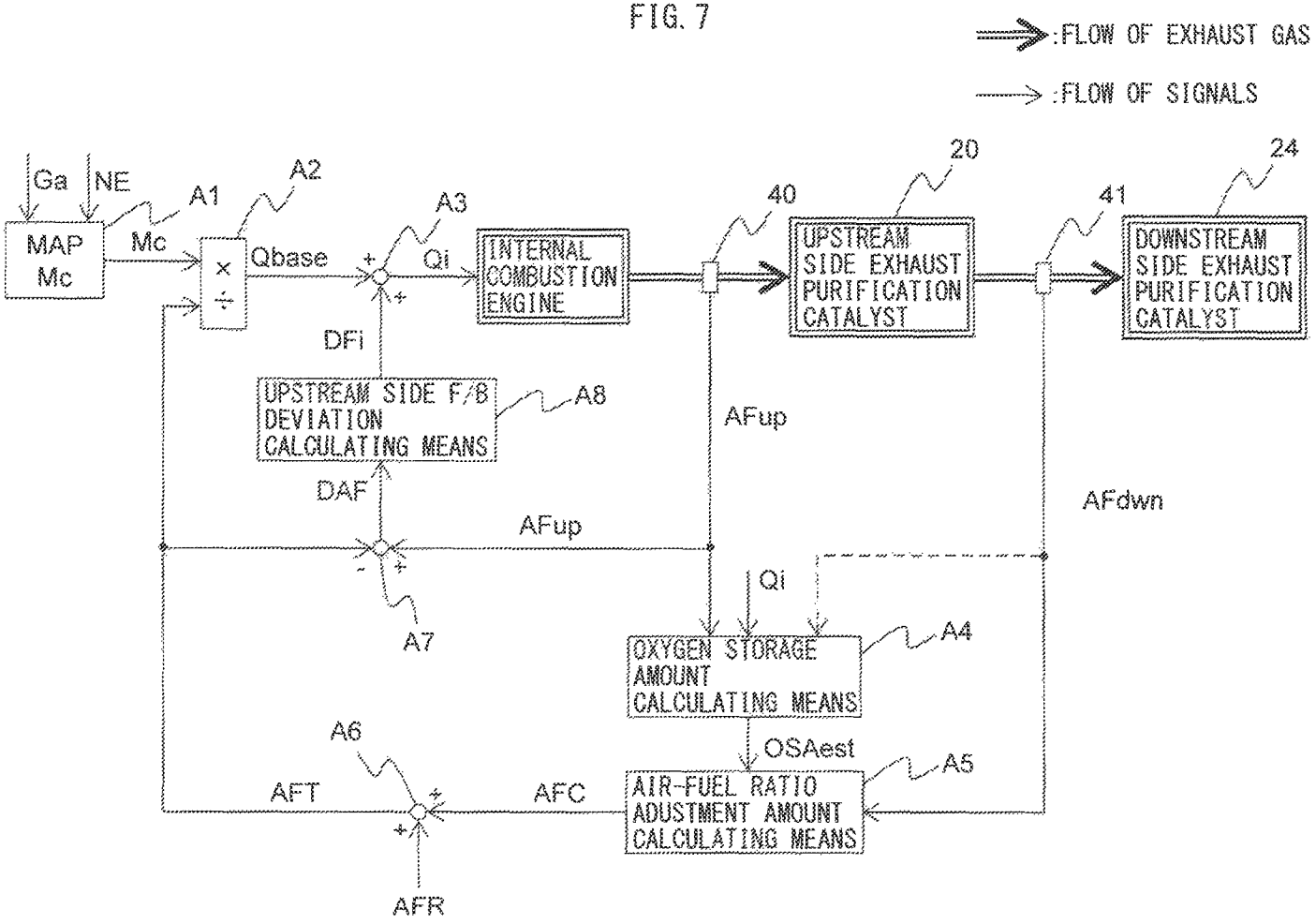
FIG. 7 is a functional block diagram of a control system.
Figure 8:
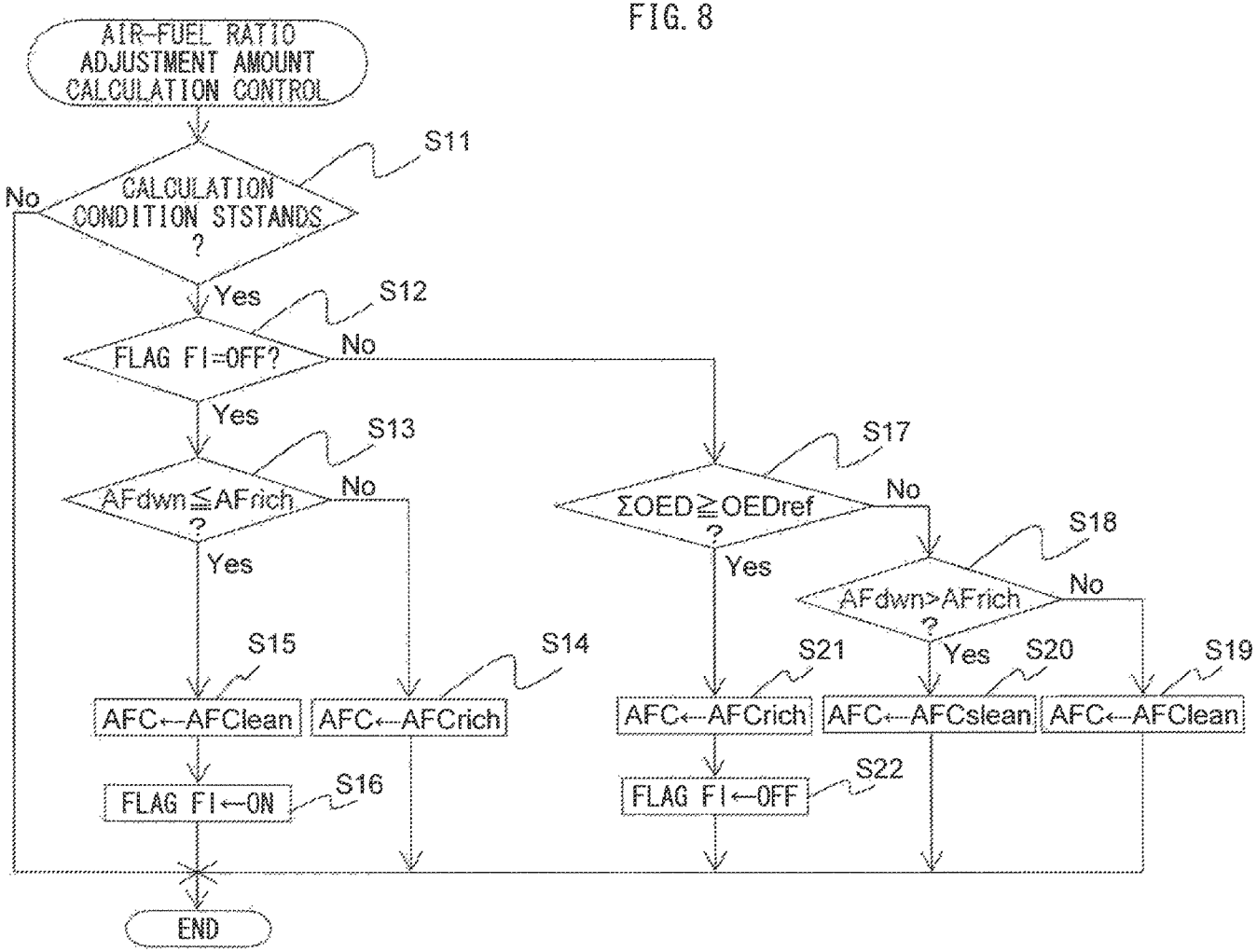
FIG. 8 is a flow chart which shows a control routine of calculation control of the air-fuel ratio adjustment amount.

Next, referring to FIG. 7 and FIG. 8, the control device in the above embodiment will be specifically explained. The control device in the present embodiment is configured so as to include the functional blocks A1 to A8 of the block diagram of FIG. 7. Below, while referring to FIG. 7, the different functional blocks will be explained. The operations of these functional blocks A1 to A8 are basically executed by the ECU 31.

<Calculation of Fuel Injection Amount>

First, calculation of the fuel injection amount will be explained. In calculating the fuel injection amount, the cylinder intake air calculating means A1, basic fuel injection calculating means A2, and fuel injection calculating means A3 are used.

The cylinder intake air calculating means A1 calculates the intake air amount Mc to each cylinder based on the intake air flow rate Ga, engine speed NE, and map or calculation formula which is stored in the ROM 34 of the ECU 31. The intake air flow rate Ga is measured by the air flow meter 39, and the engine speed NE is calculated based on the output of the crank angle sensor 44.

The basic fuel injection calculating means A2 divides the cylinder intake air amount Mc which was calculated by the cylinder intake air calculating means A1 by the target air-fuel ratio AFT to calculate the basic fuel injection amount Qbase (Qbase=Mc/AFT). The target air-fuel ratio AFT is calculated by the later explained target air-fuel ratio setting means A6.

The fuel injection calculating means A3 adds the later explained F/B correction amount DFi to the basic fuel injection amount Qbase which was calculated by the basic fuel injection calculating means A2 to calculate the fuel injection amount Qi (Qi=Qbase+DFi). An injection is instructed to the fuel injector 11 so that fuel of the thus calculated fuel injection amount Qi is injected from the fuel injector 11.

<Calculation of Target Air Fuel Ratio>

Next, calculation of the target air-fuel ratio will be explained. In calculating the target air-fuel ratio, oxygen excess/deficiency calculating means A4, air-fuel ratio adjustment amount calculating means A5, and target air-fuel ratio setting means A6 are used.

The oxygen excess/deficiency calculating means A4 calculates the cumulative oxygen excess/deficiency ΣOED based on the fuel injection amount Qi calculated by the fuel injection calculating means A3 and the output air-fuel ratio AFup of the upstream side air-fuel ratio sensor 40. The oxygen excess/deficiency calculating means A4, for example, multiplies the fuel injection amount Qi by a difference between the control center air-fuel ratio and the output air-fuel ratio of the upstream side air-fuel ratio sensor 40, and cumulatively add the calculated products, to calculate the cumulative oxygen excess/deficiency ΣOED.

The air-fuel ratio adjustment amount calculating means A5 calculates the air-fuel ratio adjustment amount AFC of the target air-fuel ratio, based on the cumulative oxygen excess/deficiency ΣOED calculated by the oxygen excess/deficiency calculating means A4 and the output air-fuel ratio AFdwn of the downstream side air-fuel ratio sensor 41. Specifically, the air-fuel ratio adjustment amount AFC is calculated based on the flow chart shown in FIG. 8.

The target air-fuel ratio setting means A6 adds the calculated air-fuel ratio adjustment amount AFC which was calculated by the target air-fuel ratio correction calculating means A5 to the control center air-fuel ratio AFR (in this embodiment, the stoichiometric air-fuel ratio) to calculate the target air-fuel ratio AFT. The thus calculated target air-fuel ratio AFT is input to the basic fuel injection calculating means A2 and later explained air-fuel ratio deviation calculating means A7.

<Calculation of F/B Correction Amount>

Next, calculation of the F/B correction amount based on the output air-fuel ratio AFup of the upstream side air-fuel ratio sensor 40 will be explained. In calculating the F/B correction amount, air-fuel ratio deviation calculating means A7, and F/B correction calculating means A8 are used.

The air-fuel ratio deviation calculating means A7 subtracts the target air-fuel ratio AFT which was calculated by the target air-fuel ratio setting means A6 from the output air-fuel ratio AFup of the upstream side air-fuel ratio sensor 40 to calculate the air-fuel ratio deviation DAF (DAF=AFup−AFT). This air-fuel ratio deviation DAF is a value which expresses the excess/deficiency of the amount of fuel feed to the target air-fuel ratio AFT.

The F/B correction calculating means A8 processes the air-fuel ratio deviation DAF which was calculated by the air-fuel ratio deviation calculating means A7 by proportional integral derivative processing (PID processing) to calculate the F/B correction amount DFi for compensating for the excess/deficiency of the fuel feed amount based on the following formula (2). The thus calculated F/B correction amount DFi is input to the fuel injection calculating means A3.

$$DFi=Kp\cdot DAF+Ki\cdot \mathrm{SDAF}+Kd\cdot DDAF \tag{2}$$

Note that, in the above formula (2), Kp is a preset proportional gain (proportional constant), Ki is a preset integral gain (integral constant), and Kd is a preset derivative gain (derivative constant). Further, DDAF is the time derivative of the air-fuel ratio deviation DAF and is calculated by dividing the difference between the currently updated air-fuel ratio deviation DAF and the previously updated air-fuel ratio deviation DAF by a time corresponding to the updating interval. Further, SDAF is the time integral of the air-fuel ratio deviation DAF. This time derivative SDAF is calculated by adding the currently updated air-fuel ratio deviation DAF to the previously updated time integral SDAF (SDAF=SDAF+DAF).

Note that, in the above embodiment, the air-fuel ratio of the exhaust gas flowing into the upstream side exhaust purification catalyst 20 is detected by the upstream side air-fuel ratio sensor 40. However, the air-fuel ratio of the exhaust gas flowing into the upstream side exhaust purification catalyst 20 need not to be necessarily detected in a high accuracy, and therefore the air-fuel ratio of this exhaust gas may be estimated, for example, based on the fuel injection amount from the fuel injectors 11 and the output of the air-flow meter 39.

<Flow Chart>

FIG. 8 is a flow chart which shows a control routine of control for calculating the air-fuel ratio adjustment amount. The illustrated control routine is executed by interruption every certain time interval.

As shown in FIG. 8, first, at step S11, it is judged if the condition for calculation of the air-fuel ratio adjustment amount AFC stands. "If the condition for calculation of the air-fuel ratio adjustment amount AFC stands" means during normal control, for example, not being during fuel cut control, etc. When it is judged at step S11 that the condition for calculation of the air-fuel ratio adjustment amount AFC stands, the routine proceeds to step S12.

At step S12, it is judged if the lean set flag F1 is set to OFF. The lean set flag F1 is a flag which is turned ON when the target air-fuel ratio is set to the lean air-fuel ratio, that is, when the air-fuel ratio adjustment amount AFC is set to 0 or more and which is turned OFF otherwise. When it is judged at step S12 that the lean set flag F1 is set to OFF, the routine proceeds to step S13. At step S13, it is judged if the output air-fuel ratio AFdwn of the downstream side air-fuel ratio sensor 41 is the rich judged air-fuel ratio AFrich or less.

At step S13, when it is judged that the output air-fuel ratio AFdwn of the downstream side air-fuel ratio sensor 41 is larger than the rich judged air-fuel ratio AFrich, the routine proceeds to step S14. At step S14, the air-fuel ratio adjustment amount AFC is set to the rich set adjustment amount AFCrich and the control routine is ended.

Then, when the oxygen storage amount OSA of the upstream side exhaust purification catalyst 20 becomes substantially zero and the output air-fuel ratio AFdwn of the downstream side air-fuel ratio sensor 41 becomes the rich judged air-fuel ratio AFrich or less, at the next control routine, the routine proceeds from step S13 to step S15. At step S15, the air-fuel ratio adjustment amount AFC is set to the lean set adjustment amount AFClean. Next, at step S16, the lean set flag F1 is set to ON and the control routine is ended.

If the lean set flag F1 is set to ON, at the next control routine, the routine proceeds from step S12 to step S17. At step S17, it is judged if the cumulative oxygen excess/deficiency ΣOED from when the air-fuel ratio adjustment amount AFC is set to the lean set adjustment amount AFClean is the switching reference value OEDref or more. If at step S17 it is judged that the oxygen storage amount OSA of the upstream side exhaust purification catalyst 20 is small and the cumulative oxygen excess/deficiency ΣOED is smaller than the switching reference value OEDref, the routine proceeds to step S18. At step S18, it is judged if the output air-fuel ratio AFdwn of the downstream side air-fuel ratio sensor 41 is larger than the rich judged air-fuel ratio AFrich. If it is judged that the output air-fuel ratio AFdwn is the rich judged air-fuel ratio AFrich or less, the routine proceeds to step S19. At step S19, the air-fuel ratio adjustment amount AFC continues to be set to the lean set adjustment amount AFClean, and the control routine is ended.

Then, if the output air-fuel ratio AFdwn of the downstream side air-fuel ratio sensor 41 approaches the stoichiometric air-fuel ratio and becomes larger than the rich judged air-fuel ratio AFrich, at the next control routine, the routine proceeds from step S18 to step S20. At step S20, the air-fuel ratio adjustment amount AFC is set to the slight lean set air-fuel ratio AFCslean, and the control routine is ended.

Then, if the oxygen storage amount OSA of the upstream side exhaust purification catalyst 20 increases and the cumulative oxygen excess/deficiency ΣOED becomes the switching reference value OEDref or more, at the next control routine, the routine proceeds from step S17 to step S21. At step S21, the air-fuel ratio adjustment amount AFC is set to the rich set adjustment amount AFCrich. Next, at step S22, the lean setting flag F1 is reset to OFF and the control routine is ended.

Second Embodiment

Next, referring to FIGS. 9 and 10, a second embodiment of the present invention will be explained. The configuration and control of the control system in the second embodiment are basically similar to those of the first embodiment. However, in the above embodiment, when setting the target air-fuel ratio to the rich air-fuel ratio, it is maintained at a certain rich set air-fuel ratio, while in the present embodiment, the target air-fuel ratio is changed from the rich set air-fuel ratio to the slight rich set air-fuel ratio.

In control for setting the target air-fuel ratio in the present embodiment, when the output air-fuel ratio of the downstream side air-fuel ratio sensor 41 becomes the rich judged air-fuel ratio or less, the target air-fuel ratio is set to the lean set air-fuel ratio. Then, in the state where the target air-fuel ratio is set to the rich set air-fuel ratio, when the output air-fuel ratio of the downstream side air-fuel ratio sensor 41 becomes an air-fuel ratio with a smaller rich degree than the rich judged air-fuel ratio, the target air-fuel ratio is set to the slight lean set air-fuel ratio.

Then, if the cumulative oxygen excess/deficiency from when switching the target air-fuel ratio to the lean set air-fuel ratio becomes a predetermined switching reference value or more, the target air-fuel ratio is set to the rich set air-fuel ratio. In this regard, the rich set air-fuel ratio in the present embodiment is a predetermined air-fuel ratio which is a certain extent richer than the stoichiometric air-fuel ratio (air-fuel ratio serving as control center). For example, it is set to 10.00 to 14.55, preferably 12.00 to 14.52, more preferably 13.00 to 14.50 or so. Further, the rich set air-fuel ratio can be expressed as the air-fuel ratio obtained by subtracting the rich set adjustment amount from the air-fuel ratio serving as the control center (in the present embodiment, the stoichiometric air-fuel ratio).

Then, if the elapsed time from when setting the target air-fuel ratio to the rich set air-fuel ratio becomes a predetermined time or more, the target air-fuel ratio is set to the slight rich set air-fuel ratio. In this regard, the slight rich set air-fuel ratio is the rich air-fuel ratio with a smaller rich degree than the rich set air-fuel ratio (smaller difference from stoichiometric air-fuel ratio). For example, it is set to 13.50 to 14.58, preferably 14.00 to 14.57, more preferably 14.30 to 14.55 or so.

As a result, in the present embodiment, when the output air-fuel ratio of the downstream side air-fuel ratio sensor 41 becomes the rich judged air-fuel ratio or less, first, the target air-fuel ratio is set to the lean set air-fuel ratio. Then, when the output air-fuel ratio of the downstream side air-fuel ratio sensor 41 becomes larger than the rich judged air-fuel ratio, the target air-fuel ratio is set to the slight lean set air-fuel ratio. On the other hand, if the cumulative oxygen excess/deficiency from when switching the target air-fuel ratio to the rich set air-fuel ratio becomes a predetermined switching reference value or more, first, the target air-fuel ratio is set to the rich set air-fuel ratio. Then, if the elapsed time from when setting the target air-fuel ratio to the rich set air-fuel ratio becomes a predetermined time or more, the target air-fuel ratio is set to the slight rich set air-fuel ratio. After that, similar control is repeated.

<Explanation of Air-Fuel Ratio Control Using Time Chart>

Figure 9:
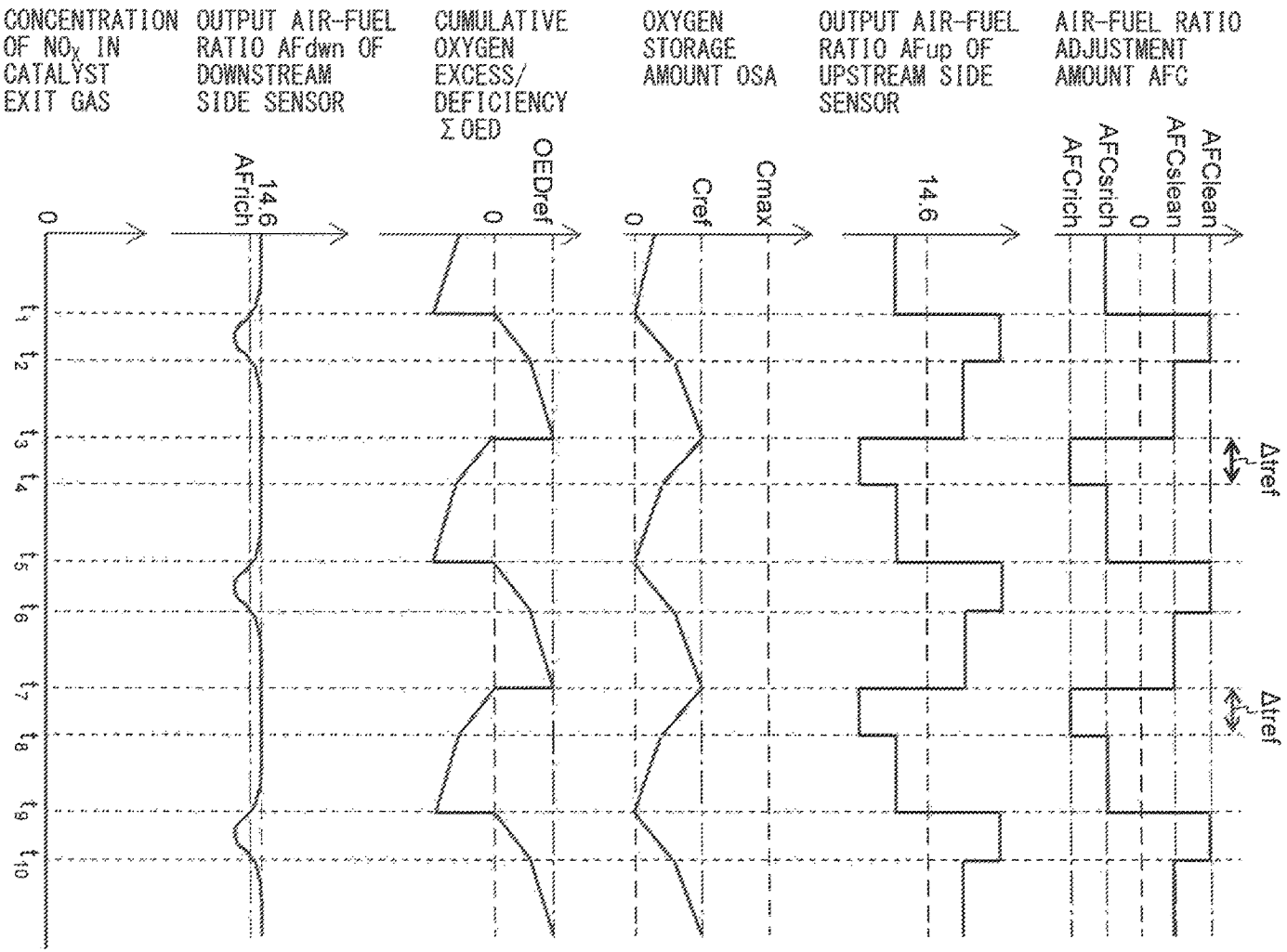
FIG. 9 is a time chart of the air-fuel ratio adjustment amount, etc., when performing air-fuel ratio control according to a control system of an internal combustion engine according to a second embodiment.

Referring to FIG. 9, the above-mentioned operation will be explained specifically. FIG. 9 is a time chart, similar to FIG. 5, of the air-fuel ratio adjustment amount AFC, etc., when performing air-fuel ratio control of the present embodiment.

During the time $t_1$ to time $t_3$, control similar to the time $t_1$ to time $t_3$ of FIG. 5 is performed. Therefore, after the time $t_3$, the air-fuel ratio adjustment amount AFC is set to the rich set adjustment amount AFCrich. That is, the target air-fuel ratio is set to the rich air-fuel ratio. If, at the time $t_3$, the target air-fuel ratio is set to the rich air-fuel ratio, the air-fuel ratio of the exhaust gas flowing into the upstream side exhaust purification catalyst 20 becomes the rich air-fuel ratio. Along with this, the output air-fuel ratio AFup of the upstream side air-fuel ratio sensor 40 becomes the rich air-fuel ratio. As a result, after the time $t_3$, the oxygen storage amount OSA of the upstream side exhaust purification catalyst 20 decreases.

Then, in the present embodiment, if the elapsed time from the time $t_3$ becomes a predetermined reference time Δtref or more, the air-fuel ratio adjustment amount AFC is switched from the rich set adjustment amount AFCrich to the slight rich set adjustment amount AFCsrich (corresponding to slight rich set air-fuel ratio) (time $t_4$). The reference time Δtref is set to a time which is shorter than the time which is normally taken from when setting the target air-fuel ratio to the rich set air-fuel ratio to when the output air-fuel ratio AFdwn of the downstream side air-fuel ratio sensor 41 becomes the rich judged air-fuel ratio AFrich or less.

At the time $t_4$, if switching the air-fuel ratio adjustment amount AFC to the slight rich set adjustment amount AFCsrich, the rich degree of the air-fuel ratio of the exhaust gas flowing into the upstream side exhaust purification catalyst 20 also becomes smaller. Along with this, the output air-fuel ratio AFup of the upstream side air-fuel ratio sensor 40 increases and the speed of decrease of the oxygen storage amount OSA of the upstream side exhaust purification catalyst 20 falls.

After the time $t_4$, the oxygen storage amount OSA of the upstream side exhaust purification catalyst 20 gradually decreases, though the speed of decrease is slow. If the oxygen storage amount OSA of the upstream side exhaust purification catalyst 20 gradually decreases, the oxygen storage amount OSA finally approaches zero and unburned gas starts to flow out from the upstream side exhaust purification catalyst 20. Then, at the time $t_5$, in the same way as the time $t_1$, the output air-fuel ratio AFdwn of the downstream side air-fuel ratio sensor 41 becomes the rich judged air-fuel ratio AFrich or less. Then, operations similar to the operations of the times $t_1$ to $t_5$ are repeated.

Modification of Second Embodiment

Note that, in the above-mentioned second embodiment, when setting the target air-fuel ratio at the rich air-fuel ratio, it is always set to two stages (that is, two stages of rich set air-fuel ratio and slight rich set air-fuel ratio). However, when setting the target air-fuel ratio to the rich air-fuel ratio, it need not necessarily be constantly set to two stages. In this case, for example, under certain conditions, the rich air-fuel ratio is set to two stages, while in other cases, the rich air-fuel ratio is set to only the slight rich set air-fuel ratio (that is, at the times $t_3$ to $t_5$ of FIG. 9, the air-fuel ratio adjustment amount AFC is set to a constant slight rich set adjustment amount AFCsrich).

In this regard, the above-mentioned constant condition is the case where the output air-fuel ratio AFdwn of the downstream side air-fuel ratio sensor 41 has become the lean judged air-fuel ratio or more. That is, as explained above, even if performing the above air-fuel ratio control, lean air-fuel ratio exhaust gas sometimes flows out from upstream side exhaust purification catalyst 20. In such a case, the rich air-fuel ratio is set to two stages.

In this case, when the output air-fuel ratio AFdwn of the downstream side air-fuel ratio sensor 41 becomes the lean judged air-fuel ratio or more, the target air-fuel ratio is switched to the rich set air-fuel ratio. Then, when the output air-fuel ratio AFdwn of the downstream side air-fuel ratio sensor 41 becomes smaller than the lean judged air-fuel ratio, the target air-fuel ratio is switched to the slight rich set air-fuel ratio.

Note that, the rich degree change timing, which is the timing of switching the target air-fuel ratio from the rich set air-fuel ratio to the slight rich set air-fuel ratio, in the same way as the lean degree change timing, does not necessarily have to be this time. Therefore, the lean degree change timing may be the timing after the output air-fuel ratio AFdwn of the downstream side air-fuel ratio sensor 41 changes to a value smaller than the lean judged air-fuel ratio AFlean. Alternatively, the lean degree change timing may be set to the time when the cumulative oxygen excess/deficiency or cumulative intake air amount from when switching the target air-fuel ratio to the rich air-fuel ratio, becomes a predetermined reference amount.

Further, in the above embodiments, during the times $t_3$ to $t_4$, the target air-fuel ratio is set to a predetermined constant rich set air-fuel ratio. However, the rich set air-fuel ratio need not necessarily be a constant value and may also fluctuate. For example, the rich set air-fuel ratio may be set so as to change in accordance with the lean degree in the output air-fuel ratio AFdwn of the downstream side air-fuel ratio sensor 41.

Similarly, in the above embodiments, during the times $t_4$ to $t_5$, the target air-fuel ratio is set to a predetermined constant slight rich set air-fuel ratio. However, the slight rich set air-fuel ratio need not necessarily be a constant value and may also fluctuate. For example, the slight rich set air-fuel ratio may be changed so that the rich degree becomes gradually smaller as the elapsed time from the rich degree change timing becomes longer. However, whatever the case, the slight rich set air-fuel ratio is always set to a value which is larger than the maximum value of the rich set air-fuel ratio during the times $t_3$ to $t_4$.

<Flow Chart in Second Embodiment>

Figure 10:
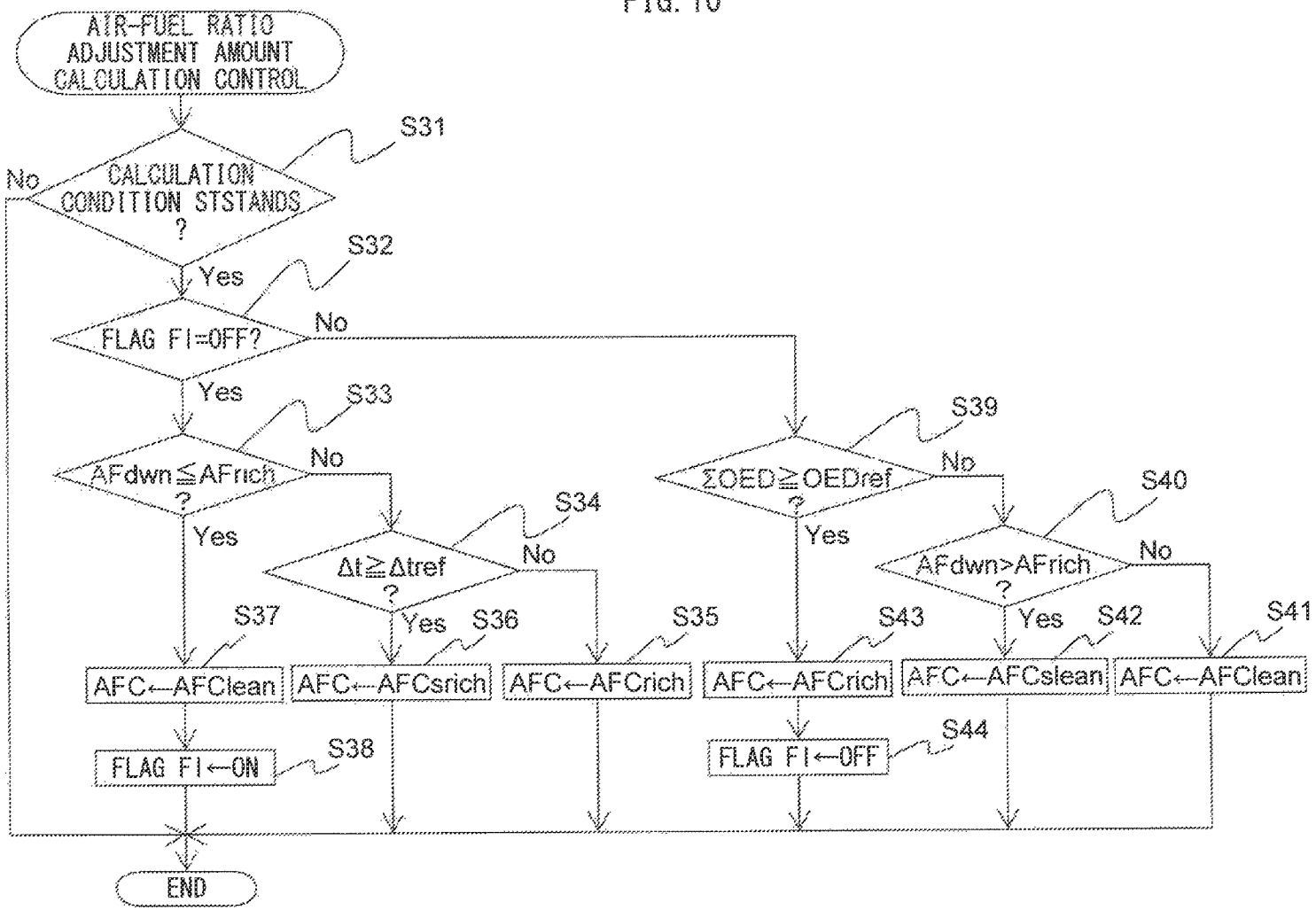
FIG. 10 is a flow chart which shows a control routine of control for calculation of the air-fuel ratio adjustment amount.

FIG. 10 is a flow chart which shows a control routine in control for calculation of the air-fuel ratio adjustment amount according to the second embodiment. The illustrated control routine is executed by interruption every certain time interval. Note that, steps S31 to S33 of FIG. 10 are similar to steps S11 to S13 of FIG. 7, and steps S37 to S44 of FIG. 10 are similar to steps S15 to S22 of FIG. 7, and therefore the explanations thereof will be omitted.

When it is judged at step S33 that the output air-fuel ratio AFdwn of the downstream side air-fuel ratio sensor 41 is larger than the rich judged air-fuel ratio AFrich, the routine proceeds to step S34. At step S34, it is judged if the elapsed time Δt from when the air-fuel ratio adjustment amount AFC is set to the rich set adjustment amount AFCrich, is the reference time Δtref or more. If it is judged that the elapsed time Δt is shorter than the reference time Δtref, the routine proceeds to step S35. At step S35, the air-fuel ratio adjustment amount AFC is maintained as set to the rich set adjustment amount AFCrich, and the control routine is ended.

Then, if time elapses from when the air-fuel ratio adjustment amount AFC is set to the rich set adjustment amount AFCrich and the elapsed time Δt becomes the reference time Δtref or more, at the next control routine, the routine proceeds from step S34 to step S36. At step S36, the air-fuel ratio adjustment amount AFC is set to the slight rich set adjustment amount AFCsrich, and the control routine is ended.

Third Embodiment

Next, referring to FIG. 11 to FIG. 14, a third embodiment of the present invention will be explained. The configuration and control of the control system in the third embodiment are basically similar to the first embodiment except for the points explained below.

In this regard, in the above-mentioned air-fuel ratio control, the target air-fuel ratio is alternately switched between the rich air-fuel ratio and the lean air-fuel ratio. Further, the rich degrees (differences from stoichiometric air-fuel ratio) of the rich set air-fuel ratio and slight rich set air-fuel ratio are kept relatively small. This is because when rapid acceleration of the vehicle which mounts the internal combustion engine, etc., causes the air-fuel ratio of the exhaust gas flowing into the upstream side exhaust purification catalyst 20 to be temporarily disturbed, or when the oxygen storage amount OSA of the upstream side exhaust purification catalyst 20 becomes substantially zero and rich air-fuel ratio exhaust gas flows out from the upstream side exhaust purification catalyst 20, the concentration of unburned gas in the exhaust gas is kept as low as possible.

Similarly, the lean degrees (differences from stoichiometric air-fuel ratio) of the lean set air-fuel ratio and slight lean set air-fuel ratio also are kept relatively small. This is because when rapid deceleration of the vehicle which mounts the internal combustion engine, etc., causes the air-fuel ratio of the exhaust gas flowing into the upstream side exhaust purification catalyst 20 to be temporarily disturbed, the concentration of $NO_X$ in the exhaust gas can be kept as low as possible.

On the other hand, the oxygen storage ability of the exhaust purification catalyst changes in accordance with the rich degree and lean degree of the air-fuel ratio of the exhaust gas flowing into the exhaust purification catalyst. Specifically, the larger the rich degree and lean degree of the air-fuel ratio of the exhaust gas flowing into the exhaust purification catalyst, the larger the amount of oxygen which can be stored in the exhaust purification catalyst can be deemed. In this regard, as explained above, from the viewpoint of the unburned gas concentration or $NO_X$ concentration in the exhaust gas in the exhaust gas which flows out from the upstream side exhaust purification catalyst 20, the rich degrees of the rich set air-fuel ratio and slight rich set air-fuel ratio and the lean degrees of the lean set air-fuel ratio and slight lean set air-fuel ratio are kept relatively small. Therefore, if performing such control, the oxygen storage ability of the upstream side exhaust purification catalyst 20 cannot be maintained sufficiently high.

In this regard, temporary disturbance (outside disturbance) of the exhaust gas flowing into the upstream side exhaust purification catalyst 20 occurs when the engine operating state is not the steady operating state. Conversely speaking, when the engine operating state is a steady operating state, outside disturbance does not easily occur. In addition, the lower the engine load, that is, the lower the load in the operating state of the engine operating state, even if temporary disturbance occurs, the change which occurs in the air-fuel ratio of the exhaust gas flowing into the upstream side exhaust purification catalyst 20 is small.

Therefore, when the engine operating state is a steady operating state or when the engine operating state is a low load operating state, even if the rich degree of the rich set air-fuel ratio or the lean degree of the lean set air-fuel ratio is set larger, the possibility of $NO_X$ or unburned gas flowing out from the upstream side exhaust purification catalyst 20 is low. Further, even if $NO_X$ or unburned gas flows out from the upstream side exhaust purification catalyst 20, the amount can be kept low. Note that "when the engine operating state is a steady operating state", for example, is when the amount of change per unit time of the engine load of the internal combustion engine is a predetermined amount of change or less, or when the amount of change per unit time of the intake air amount of the internal combustion engine is a predetermined amount of change or less.

<Control for Setting Each Set Air-Fuel Ratio>

Therefore, in the present embodiment, when the engine operating state is in the steady operating state and low load operating state, compared to when the engine operating state is not in the steady operating state and is in the medium-high load operating state, the rich degree when the target air-fuel ratio is set to the rich air-fuel ratio and the lean degree when the target air-fuel ratio is set to the lean air-fuel ratio are set larger. Note that, regarding the "low load", "medium load", and "high load" in the Description, when dividing the entire engine load into three equal parts, the lowest load region is called the "low load", the medium extent of load region is called the "medium load", and the highest load region is called the "high load".

Figure 11:
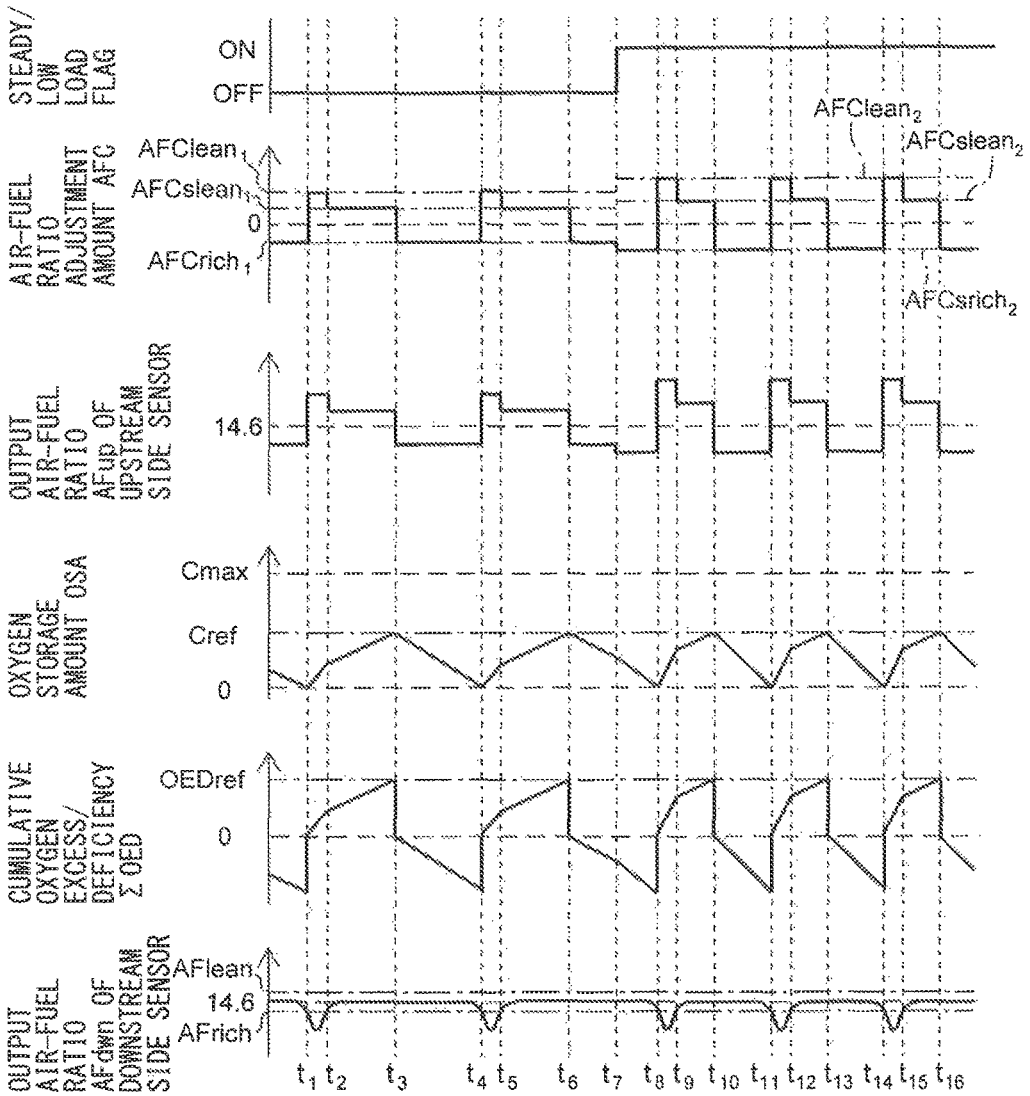
FIG. 11 is a time chart similar to FIG. 5 of the target air-fuel ratio, etc., when performing setting control of each set air-fuel ratio.

FIG. 11 is a time chart similar to FIG. 5 of the target air-fuel ratio, etc., when performing control to set each set air-fuel ratio according to the present embodiment. In the example shown in FIG. 11, control similar to the example shown in FIG. 5 is performed until the time $t_7$. Therefore, when at the times $t_1$ and $t_4$, the output air-fuel ratio AFdwn of the downstream side air-fuel ratio sensor 41 becomes the rich judged air-fuel ratio AFrich or less, the air-fuel ratio adjustment amount AFC is switched to the lean set air-fuel ratio $AFClean_1$ (below, referred to as "normal period lean set air-fuel ratio"). Then, if, at the times $t_2$ and $t_5$, the output air-fuel ratio AFdwn of the downstream side air-fuel ratio sensor 41 becomes larger than the rich judged air-fuel ratio AFrich, the air-fuel ratio adjustment amount AFC is switched to a slight lean set air-fuel ratio $AFCslean_1$ (below, referred to as the "normal period slight lean set air-fuel ratio").

On the other hand, when, at the time $t_3$, the cumulative oxygen excess/deficiency ΣOED becomes the switching reference value OEDref, the air-fuel ratio adjustment amount AFC is switched to the rich set air-fuel ratio $AFCrich_1$ (below, referred to as the "normal period rich set air-fuel ratio"). Note that, up to the time $t_9$, the engine operating state is not in the steady operating state and low load operating state. Therefore, the steady-low load flag, which is turned on when the engine operating state is in the steady operating state and the low load operating state, is set to off.

On the other hand, if, at the time $t_7$, the engine operating state becomes the steady operating state and low load operating state and therefore the steady-low load flag is turned on, the absolute values of the lean set adjustment amount AFClean, slight lean set adjustment amount AFCslean, and rich set adjustment amount AFCrich (below, these together being referred to as the "set adjustment amount") may be increased.

As a result, at the time $t_7$, air-fuel ratio adjustment amount AFC is changed from the normal period rich set adjustment amount $AFCrich_1$ to the increased period rich set adjustment amount $AFCrich_2$ with a larger absolute value than the normal period rich set adjustment amount $AFCrich_1$. That is, the target air-fuel ratio is set to an increased period rich set air-fuel ratio with a larger rich degree than the normal period rich set air-fuel ratio. Therefore, after the time $t_7$, the speed of decrease of the oxygen storage amount OSA of the upstream side exhaust purification catalyst 20 becomes faster.

Then, when, at the time $t_8$, the output air-fuel ratio AFdwn of the downstream side air-fuel ratio sensor 41 becomes the rich judged air-fuel ratio AFrich or less, the air-fuel ratio adjustment amount AFC is switched to an increased period lean set adjustment amount $AFClean_2$ with a larger absolute value than the normal period lean set adjustment amount $AFClean_1$. That is, the target air-fuel ratio is set to an increased period lean set air-fuel ratio with a larger lean degree than the normal period lean set air-fuel ratio. Therefore, the speed of increase of the oxygen storage amount OSA of the upstream side exhaust purification catalyst 20 after the time $t_8$ becomes faster than the speed of increase during the times $t_1$ to $t_2$ and the times $t_4$ to $t_5$.

When, at the time $t_9$, the output air-fuel ratio AFdwn of the downstream side air-fuel ratio sensor 41 becomes larger than the rich judged air-fuel ratio AFrich, the air-fuel ratio adjustment amount AFC is switched to the increased period slight lean set adjustment amount $AFCslean_2$ with a larger absolute value than the normal period slight lean set adjustment amount $AFCslean_1$. That is, the target air-fuel ratio is set to an increased period slight lean set air-fuel ratio with a larger lean degree than the normal period slight lean set air-fuel ratio. Therefore, the speed of increase of the oxygen storage amount OSA of the upstream side exhaust purification catalyst 20 after the time $t_9$ becomes faster than the speed of increase during the times $t_2$ to $t_3$ and times $t_5$ to $t_6$.

Then, at the time $t_{10}$, if the output air-fuel ratio AFdwn of the downstream side air-fuel ratio sensor 41 becomes the lean judged air-fuel ratio AFlean or more, the air-fuel ratio adjustment amount AFC is switched to the increased period rich set adjustment amount $AFCrich_2$ with a larger absolute value than the normal period rich set adjustment amount $AFCrich_1$. That is, the target air-fuel ratio is set to an increased period rich set air-fuel ratio with a larger rich degree than the normal period rich set air-fuel ratio. Therefore, the speed of decrease of the oxygen storage amount OSA of the upstream side exhaust purification catalyst 20 after the time $t_{10}$ becomes faster than the speed of decrease during the times $t_3$ to $t_4$ and the times $t_6$ to $t_7$. Then, so long as the engine operating state is the steady operating state and low load operating state, the operations of the times $t_8$ to $t_{11}$ are repeated.

According to the present embodiment, when the engine operating state is a steady operating state and low load operating state, the rich degree of the rich set air-fuel ratio is set larger and, further, the lean degrees of the lean set air-fuel ratio and slight lean set air-fuel ratio are set larger. Therefore, it is possible to keep the outflow of $NO_X$ or unburned gas from the upstream side exhaust purification catalyst 20 as small as possible, while maintaining the oxygen storage ability of the upstream side exhaust purification catalyst 20 higher.

Modification of Third Embodiment

Note that, in the above embodiments, when the engine operating state is the steady operating state and the low load operating state, the rich degree of the rich set air-fuel ratio and the lean degrees of the lean set air-fuel ratio and slight lean set air-fuel ratio are both set larger. However, it is not necessary to increase both of the rich degree and lean degree. It is also possible to increase only one of these rich degrees and the lean degree.

Further, in the above embodiments, when the engine operating state is the steady operating state and the low load operating state, the rich degree and lean degree of the set air-fuel ratio are increased. However, except when the engine operating state is not the steady operating state and is the medium-high load operating state, it is also possible to make the rich degree and lean degree of the set air-fuel ratio increase other than when the engine operating state is the steady operating state and low load operating state. For example, when the engine operating state is the steady operating state and is the medium load operating state or medium-high load operating state, the rich degree and lean degree of the set air-fuel ratio may be increased.

Figure 12:
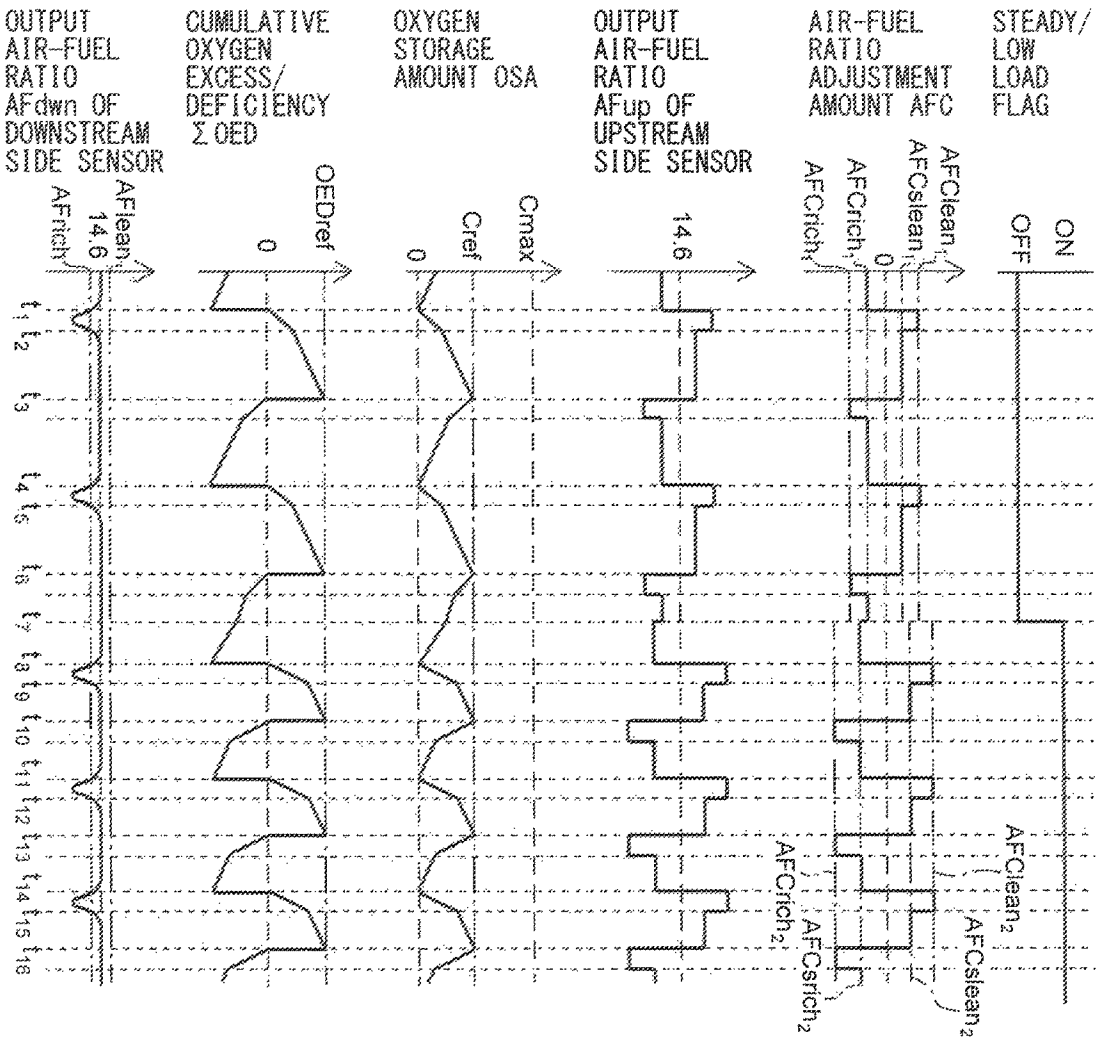
FIG. 12 is a time chart similar to FIG. 5 of the target air-fuel ratio, etc., when performing setting control of each set air-fuel ratio.

In addition, the example shown in FIG. 11 is predicated on the air-fuel ratio control of the first embodiment being performed. However, similar control can be performed even when predicated on performing air-fuel ratio control of the second embodiment. In this case, when the engine operating state is the steady operating state and low load operating state, that is, the steady-low load flag is set on, the absolute value of the slight rich set adjustment amount AFCsrich is increased. That is, when the steady-low load flag is set on, as shown in FIG. 12, the slight rich set adjustment amount AFCsrich is switched from the normal period slight rich set adjustment amount $AFCsrich_1$ to the increased period slight rich set adjustment amount $AFCsrich_2$ with a larger absolute value than the normal period slight rich set adjustment amount $AFCsrich_1$.

Furthermore, in the above embodiments, when the engine operating state is the steady operating state and a low load operating state, compared to when the engine operating state is not the steady operating state and is the medium-high load operating state, the absolute values of all of the lean set adjustment amount AFClean, slight lean set adjustment amount AFCslean, rich set adjustment amount AFCrich, and slight rich set adjustment amount AFCsrich can be increased. However, there is no need for increasing the absolute values of all of these. It is also possible to increase the absolute value of at least one of the set adjustment amounts.

Figure 13:
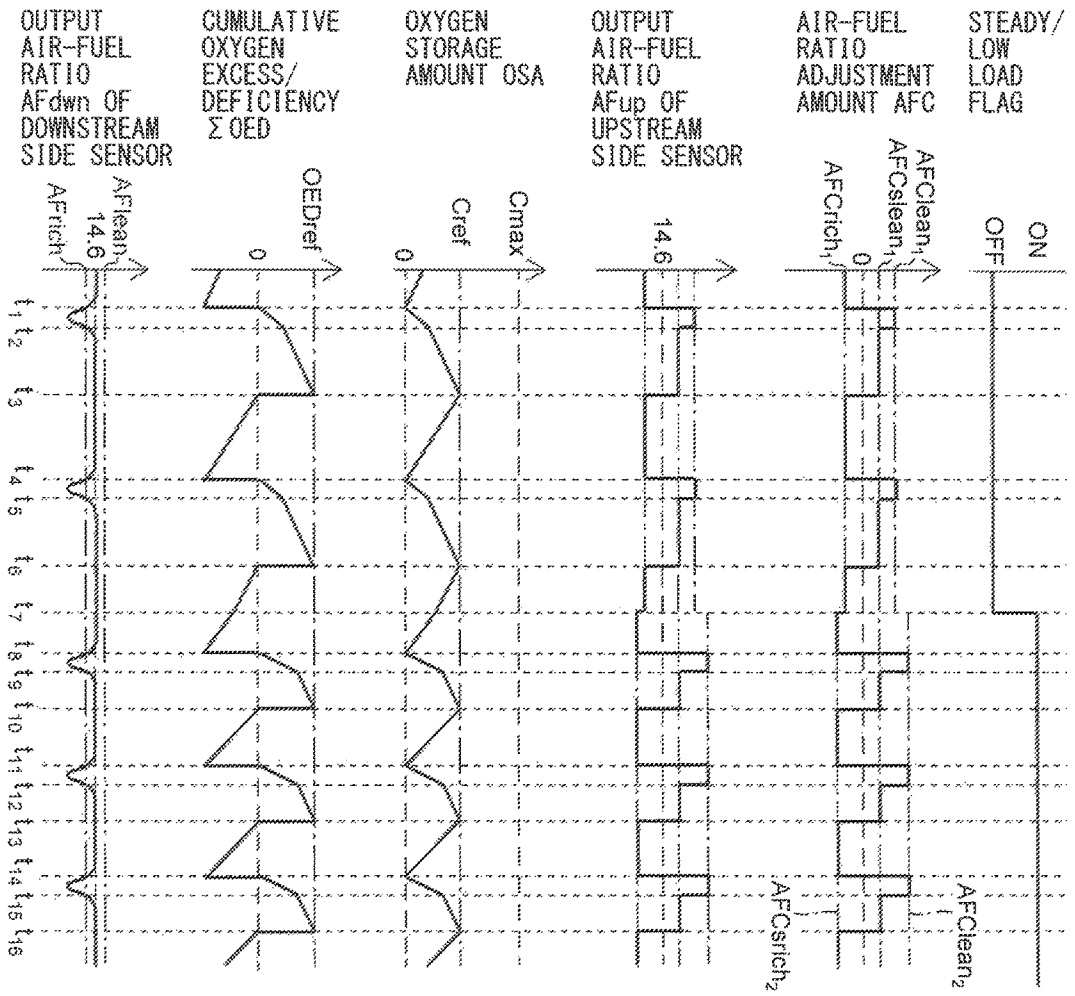
FIG. 13 is a time chart similar to FIG. 5 of the target air-fuel ratio etc. when performing setting control of each set air-fuel ratio.

Therefore, for example, as shown in FIG. 13, when the engine operating state is a steady operating state and low load operating state, compared with when the engine operating state is not a steady operating state and is a medium-high load operating state, it is also possible to increase only the lean set adjustment amount and rich set adjustment amount and maintain the slight lean set adjustment amount and slight rich set adjustment amount as they are. Due to this, for example, at the time $t_{10}$ or time $t_{12}$, even if $NO_X$ or unburned gas flows out from the upstream side exhaust purification catalyst 20, the amount thereof can be kept small.

<Flow Chart>

Figure 14:
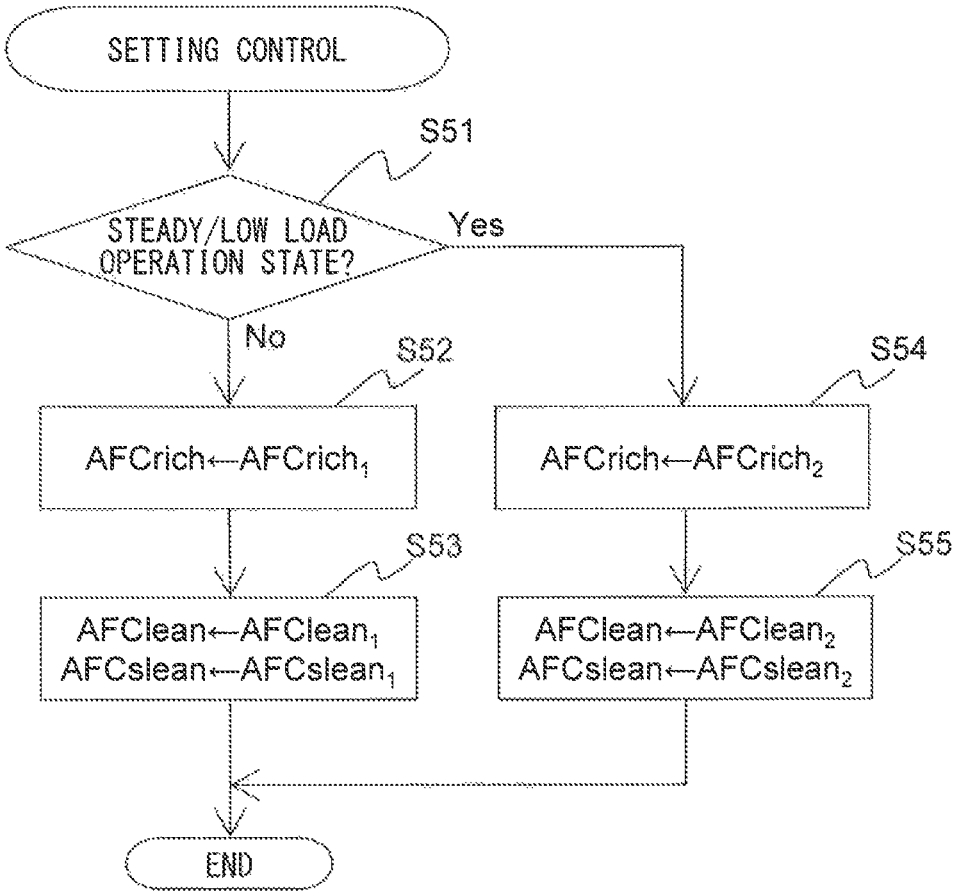
FIG. 14 is a flow chart which shows a control routine of control for setting of a rich set air-fuel ratio and a lean set air-fuel ratio, etc.

FIG. 14 is a flow chart which shows a control routine in control for setting a rich set air-fuel ratio and lean set air-fuel ratio. The illustrated control routine is performed by interruption every certain time interval.

First, at step S51, it is judged if the engine operating state is a steady operating state and engine low load operating state. Specifically, for example, when the amount of change per unit time of the engine load of the internal combustion engine which is detected by the load sensor 43 is a predetermined amount of change or less, or when the amount of change per unit time of the intake air amount of the internal combustion engine which is detected by the air flow meter 39 is a predetermined amount of change or less, it is judged that the engine operating state is the steady operating state. Otherwise, it is judged that the engine operating state is in a transitional operating state (not a steady operating state).

If it is judged at step S51 that the engine operating state is not the steady operating state and is the medium-high load operating state, the routine proceeds to step S52. At step S52, the rich set adjustment amount AFCrich is set to the normal period rich set adjustment amount $AFCrich_1$. Therefore, at steps S15 and S21 of the flow chart shown in FIG.

8, the air-fuel ratio adjustment amount AFC is set to the normal period rich set adjustment amount $AFCrich_1$.

Next, at step S53, the lean set adjustment amount AFClean is set to the normal period lean set adjustment amount $AFClean_1$. Therefore, at steps S15 and S19 of the flow chart shown in FIG. 8, the air-fuel ratio adjustment amount AFC is set to the normal period lean set adjustment amount $AFClean_1$. In addition, at step S53, the slight lean set adjustment amount AFCslean is set to the normal period slight rich set adjustment amount $AFCslean_1$. Therefore, at step S20 of the flow chart shown in FIG. 8, the air-fuel ratio adjustment amount AFC is set to the normal period lean set adjustment amount $AFClean_1$.

On the other hand, if, at step S51, it is judged that the engine operating state is the steady operating state and the engine low load operating state, the routine proceeds to step S54. At step S54, the rich set adjustment amount AFCrich is set to the increased period rich set adjustment amount $AFCrich_2$. Next, at step S55, the lean set adjustment amount AFClean is set to the increased period lean set adjustment amount $AFClean_2$. In addition, the slight lean set adjustment amount AFCslean is set to the increased period slight rich set adjustment amount $AFCslean_2$.

Fourth Embodiment

Next, referring to FIGS. 15 to 24, a fourth embodiment of the present invention will be explained. The configuration and control of the control system in the fourth embodiment are basically similar to the first embodiment except for the points explained below.

<Deviation at Upstream Side Air Fuel Ratio Sensor>

In this regard, when the engine body 1 has a plurality of cylinders, sometimes a deviation occurs between the cylinders in the air-fuel ratio of the exhaust gas which is exhausted from the cylinders. On the other hand, the upstream side air-fuel ratio sensor 40 is arranged at the header of the exhaust manifold 19, but depending on the position of arrangement, the extent by which the exhaust gas which is exhausted from each cylinder is exposed to the upstream side air-fuel ratio sensor 40 differs between cylinders. As a result, the output air-fuel ratio of the upstream side air-fuel ratio sensor 40 is strongly affected by the air-fuel ratio of the exhaust gas which is exhausted from a certain specific cylinder. For this reason, when the air-fuel ratio of the exhaust gas which is exhausted from a certain specific cylinder becomes an air-fuel ratio which differs from the average air-fuel ratio of the exhaust gas which is exhausted from all cylinders, deviation occurs between the average air-fuel ratio and the output air-fuel ratio of the upstream side air-fuel ratio sensor 40. That is, the output air-fuel ratio of the upstream side air-fuel ratio sensor 40 deviates to the rich side or lean side from the average air-fuel ratio of the actual exhaust gas.

Further, hydrogen, among unburned gas, has a fast speed of passage through the diffusion regulation layer of the air-fuel ratio sensor. For this reason, if the concentration of hydrogen in the exhaust gas is high, the output air-fuel ratio of the upstream side air-fuel ratio sensor 40 deviates to the lower side with respect to the actual air-fuel ratio of the exhaust gas (that is, the rich side). If deviation occurs in the output air-fuel ratio of the upstream side air-fuel ratio sensor 40 in this way, the above mentioned control cannot be performed appropriately. Below, this phenomenon will be explained with reference to FIG. 15.

Figure 15:
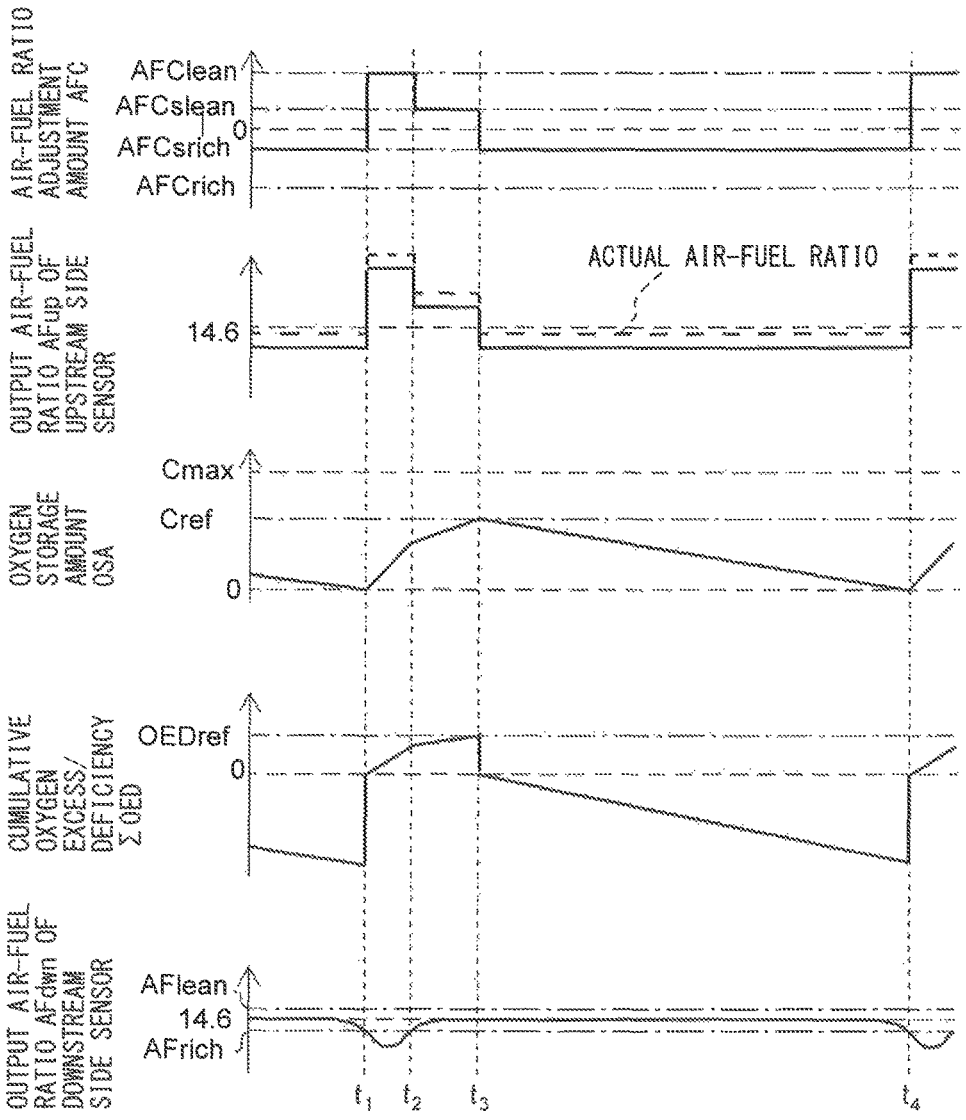
FIG. 15 is a time chart of the air-fuel ratio adjustment amount, etc., when deviation occurs in the output air-fuel ratio of the upstream side air-fuel ratio sensor.

FIG. 15 is a time chart of the air-fuel ratio adjustment amount AFC, etc., similar to FIG. 5. FIG. 15 shows the case where the output air-fuel ratio of the upstream side air-fuel ratio sensor 40 deviates to the rich side. In the figure, the solid line in the output air-fuel ratio AFup of the upstream side air-fuel ratio sensor 40 shows the output air-fuel ratio of the upstream side air-fuel ratio sensor 40. On the other hand, the broken line shows the actual air-fuel ratio of the exhaust gas flowing around the upstream side air-fuel ratio sensor 40.

In the example shown in FIG. 15 as well, in the state before the time $t_1$, the air-fuel ratio adjustment amount AFC is set to the rich set adjustment amount AFCrich. Accordingly, the target air-fuel ratio is set to the rich set air-fuel ratio. Along with this, the output air-fuel ratio AFup of the upstream side air-fuel ratio sensor 40 becomes an air-fuel ratio equal to the rich set air-fuel ratio. However, since, as explained above, the output air-fuel ratio of the upstream side air-fuel ratio sensor 40 deviates to the rich side, the actual air-fuel ratio of the exhaust gas becomes an air-fuel ratio which is at the lean side from the slight rich set air-fuel ratio. That is, the output air-fuel ratio AFup of the upstream side air-fuel ratio sensor 40 becomes lower (richer) than the actual air-fuel ratio (broken line in figure).

Further, in the example shown in FIG. 15, if, at the time $t_1$, the air-fuel ratio adjustment amount AFC is switched to the lean set adjustment amount AFClean, the output air-fuel ratio AFup of the upstream side air-fuel ratio sensor 40 becomes an air-fuel ratio which is equal to the lean set air-fuel ratio. However, since, as explained above, the output air-fuel ratio of the upstream side air-fuel ratio sensor 40 deviates to the rich side, the actual air-fuel ratio of the exhaust gas becomes an air-fuel ratio which is leaner than the lean set air-fuel ratio. That is, the output air-fuel ratio AFup of the upstream side air-fuel ratio sensor 40 becomes lower (richer) than the actual air-fuel ratio (broken line in figure).

In this way, if the output air-fuel ratio of the upstream side air-fuel ratio sensor 40 deviates to the rich side, the actual air-fuel ratio of the exhaust gas flowing into the upstream side exhaust purification catalyst 20 will always become an air-fuel ratio leaner than the target air-fuel ratio. Therefore, for example, if the deviation in the output air-fuel ratio of the upstream side air-fuel ratio sensor 40 becomes larger than the example shown in FIG. 15, during the times $t_3$ to $t_4$, the actual air-fuel ratio of the exhaust gas flowing into the upstream side exhaust purification catalyst 20 will become the stoichiometric air-fuel ratio or lean air-fuel ratio.

If, during the times $t_3$ to $t_4$, the actual air-fuel ratio of the exhaust gas flowing into the upstream side exhaust purification catalyst 20 becomes the stoichiometric air-fuel ratio, after that, the output air-fuel ratio of the downstream side air-fuel ratio sensor 41 no longer becomes the rich judged air-fuel ratio or less, or the lean judged air-fuel ratio or more. Further, the oxygen storage amount OSA of the upstream side exhaust purification catalyst 20 is also maintained constant as it is. Further, if, during the times $t_3$ to $t_4$, the actual air-fuel ratio of the exhaust gas flowing into the upstream side exhaust purification catalyst 20 becomes the lean air-fuel ratio, the oxygen storage amount OSA of the upstream side exhaust purification catalyst 20 increases. As a result, the oxygen storage amount OSA of the upstream side exhaust purification catalyst 20 can no longer change between the maximum storable oxygen amount Cmax and zero and thus the oxygen storage ability of the upstream side exhaust purification catalyst 20 will fall.

Due to the above, it is necessary to detect the deviation of the output air-fuel ratio of the upstream side air-fuel ratio sensor 40 and is necessary to correct the output air-fuel ratio, etc., based on the detected deviation.

<Normal Learning Control>

Therefore, in an embodiment of the present invention, learning control is performed during normal operation (that is, when performing feedback control based on the above mentioned target air-fuel ratio) to compensate for deviation in the output air-fuel ratio of the upstream side air-fuel ratio sensor 40. At first, among the learning control, a normal learning control will be explained.

In this regard, the time period from when switching the target air-fuel ratio to the lean air-fuel ratio to when the cumulative oxygen excess/deficiency OED becomes the switching reference value ΣOED or more, is defined as the oxygen increase time period (first time period). Similarly, the time period from when the target air-fuel ratio is switched to the rich air-fuel ratio to when the output air-fuel ratio of the downstream side air-fuel ratio sensor 41 becomes the rich judgment air-fuel ratio or less, is defined as the oxygen decrease time period (second time period). In the normal learning control of the present embodiment, as the absolute value of the cumulative oxygen excess/deficiency ΣOED in the oxygen increase time period, the lean cumulative value of oxygen amount (first cumulative value of oxygen amount) is calculated. In addition, as the absolute value of the cumulative oxygen excess/deficiency in the oxygen decrease time period, the rich cumulative value of oxygen amount (second cumulative value of oxygen amount) is calculated. Further, the control center air-fuel ratio AFR is corrected so that the difference between the lean cumulative value of oxygen amount and rich cumulative value of oxygen amount becomes smaller. Below, FIG. 16 shows this state.

Figure 16:
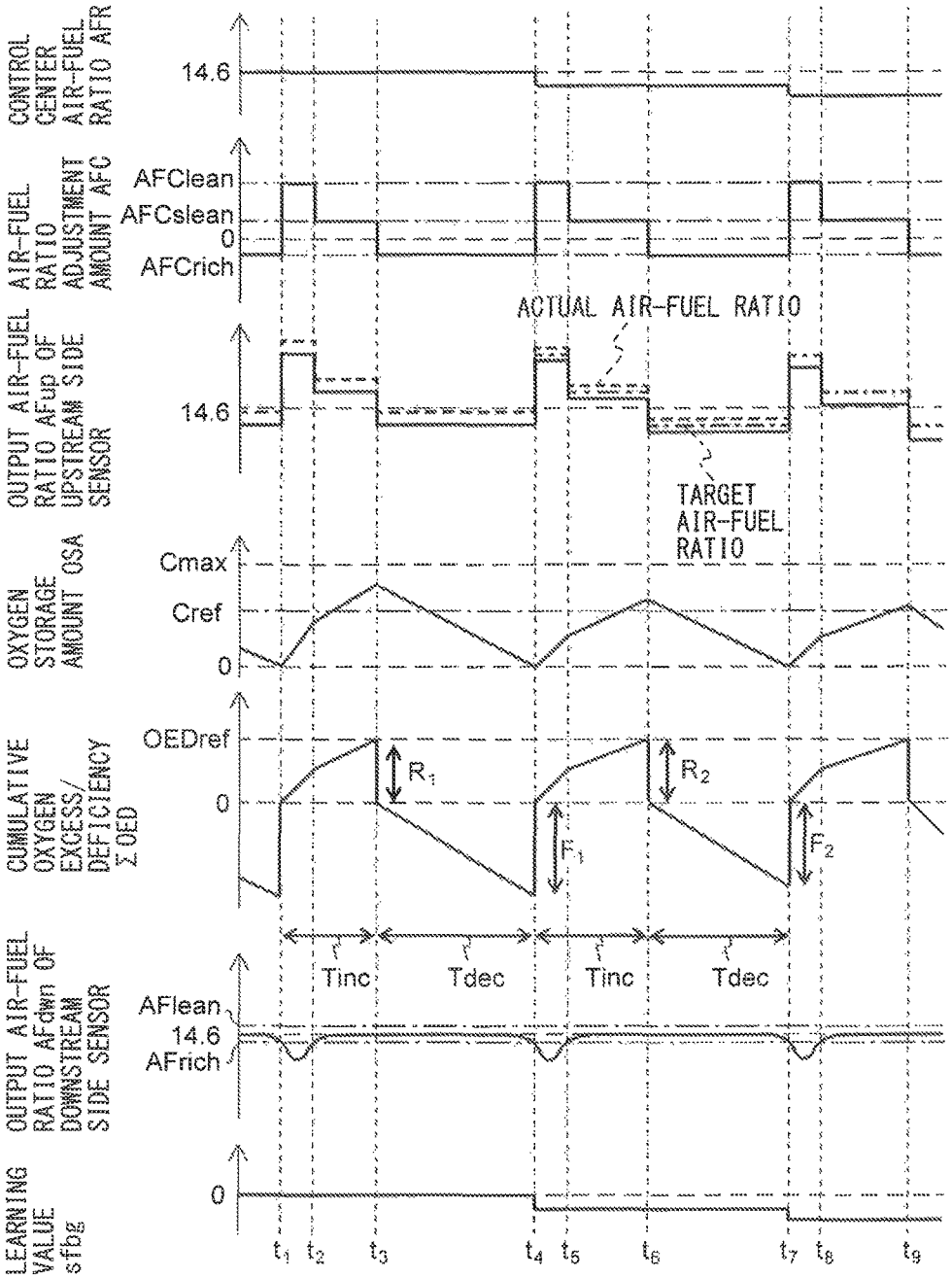
FIG. 16 is a time chart of the air-fuel ratio adjustment amount, etc., when performing normal learning control.

FIG. 16 is a time chart of the control center air-fuel ratio AFr, the air-fuel ratio adjustment amount AFC, the output air-fuel ratio AFup of the upstream side air-fuel ratio sensor 40, the oxygen storage amount OSA of the upstream side exhaust purification catalyst 20, the cumulative oxygen excess/deficiency ΣOED, the output air-fuel ratio AFdwn of the downstream side air-fuel ratio sensor 41, and the learning value sfbg. FIG. 16 shows the case, like FIG. 15, where the output air-fuel ratio AFup of the upstream side air-fuel ratio sensor 40 deviates to the low side (rich side). Note that, the learning value sfbg is a value which changes in accordance with the deviation of the output air-fuel ratio (output current) of the upstream side air-fuel ratio sensor 40 and, in the present embodiment, is used for correction of the control center air-fuel ratio AFR. Further, in the figure, the solid line in the output air-fuel ratio AFup of the upstream side air-fuel ratio sensor 40 shows the output air-fuel ratio of the upstream side air-fuel ratio 40, while the broken line shows the actual air-fuel ratio of the exhaust gas flowing around the upstream side air-fuel ratio 40. In addition, one-dot chain line shows the target air-fuel ratio, that is, an air-fuel ratio corresponding to the air-fuel ratio adjustment amount AFC.

In the illustrated example, in the same way as FIG. 5 and FIG. 15, in the state before the time $t_1$, the control center air-fuel ratio is set to the stoichiometric air-fuel ratio and therefore the air-fuel ratio adjustment amount AFC is set to the rich set adjustment amount AFCrich. At this time, the output air-fuel ratio AFup of the upstream side air-fuel ratio sensor 40, as shown by the solid line, becomes an air-fuel ratio which corresponds to the rich set air-fuel ratio. However, since the output air-fuel ratio AFup of the upstream side air-fuel ratio sensor 40 deviates, the actual air-fuel ratio of the exhaust gas becomes an air-fuel ratio which is leaner than the rich set air-fuel ratio (broken line in FIG. 16). However, in the example shown in FIG. 16, as will be understood from the broken line in FIG. 16, the actual air-fuel ratio of the exhaust gas before the time $t_1$ is a rich air-fuel ratio, while it is richer than the stoichiometric air-fuel ratio. Therefore, the upstream side exhaust purification catalyst 20 is gradually decreased in the oxygen storage amount.

At the time $t_1$, the output air-fuel ratio AFdwn of the downstream side air-fuel ratio sensor 41 reaches the rich judged air-fuel ratio AFrich. Due to this, as explained above, the air-fuel ratio adjustment amount AFC is switched to the lean set adjustment amount AFClean. After the time $t_1$, the output air-fuel ratio of the upstream side air-fuel ratio sensor 40 becomes an air-fuel ratio which corresponds to the lean set air-fuel ratio. However, due to deviation of the output air-fuel ratio of the upstream side air-fuel ratio sensor 40, the actual air-fuel ratio of the exhaust gas becomes an air-fuel ratio which is leaner than the lean set air-fuel ratio, that is, an air-fuel ratio with a larger lean degree (see broken line in FIG. 16). Therefore, the oxygen storage amount OSA of the upstream side exhaust purification catalyst 20 rapidly increases. Further, when the output air-fuel ratio AFdwn of the downstream side air-fuel ratio sensor 41 becomes larger than the rich judged air-fuel ratio AFrich at the time $t_2$, the air-fuel ratio adjustment amount AFC is switched to the slight lean set adjustment amount AFCslean. At this time as well, the actual air-fuel ratio of the exhaust gas becomes a lean air-fuel ratio which is leaner than the slight lean set air-fuel ratio.

Then, when the cumulative oxygen excess/deficiency ΣOED becomes the switching reference value OEDref or more, the air-fuel ratio adjustment amount AFC is switched to the rich set adjustment amount AFCrich. However, due to the deviation of the output air-fuel ratio of the upstream side air-fuel ratio sensor 40, the actual air-fuel ratio of the exhaust gas becomes an air-fuel ratio leaner than the rich set air-fuel ratio, that is, an air-fuel ratio with a small rich degree (see broken line in FIG. 16). Therefore, the speed of decrease of the oxygen storage amount OSA of the upstream side exhaust purification catalyst 20 is slow.

In the present embodiment, as explained above, the cumulative oxygen excess/deficiency ΣOED is calculated from the time $t_1$ to the time $t_2$. In this regard, if referring to the time period from when the target air-fuel ratio is switched to the lean air-fuel ratio (time $t_1$) to when the output air-fuel ratio AFdwn of the downstream side air-fuel sensor 41 becomes the lean judged air-fuel ratio AFlean or more (time $t_3$) as the "oxygen increase time period Tinc", in the present embodiment, the cumulative oxygen excess/deficiency ΣOED is calculated in the oxygen increase time period Tinc. In FIG. 16, the absolute value of the cumulative oxygen excess/deficiency ΣOED in the oxygen increase time period Tinc from the time $t_1$ to time $t_3$ is shown as $R_1$.

The cumulative oxygen excess/deficiency ΣOED($R_1$) of this oxygen increase time period Tinc corresponds to the oxygen storage amount OSA at the time $t_3$. However, as explained above, the oxygen excess/deficiency is estimated by using the output air-fuel ratio AFup of the upstream side air-fuel ratio sensor 40, and deviation occurs in this output air-fuel ratio AFup. For this reason, in the example shown in FIG. 16, the cumulative oxygen excess/deficiency ΣOED in the oxygen increase time period Tinc from the time $t_1$ to time $t_3$ becomes smaller than the value which corresponds to the actual oxygen storage amount OSA at the time $t_3$.

Further, in the present embodiment, the cumulative oxygen excess/deficiency ΣOED is calculated even from the time $t_3$ to time $t_4$. In this regard, if referring to the time period from when the target air-fuel ratio is switched to the rich air-fuel ratio (time $t_3$) to when the output air-fuel ratio AFdwn of the downstream side air-fuel ratio sensor 41 becomes the rich judged air-fuel ratio AFrich or less (time $t_4$) as the "oxygen decrease time period Tdec", in the present embodiment, the cumulative oxygen excess/deficiency ΣOED is calculated in the oxygen decrease time period Tdec. In FIG. 16, the absolute value of the cumulative oxygen excess/deficiency ΣOED at the oxygen decrease time period Tdec from the time $t_3$ to time $t_4$ is shown as $F_1$.

The cumulative oxygen excess/deficiency ΣOED($F_1$) of this oxygen decrease time period Tdec corresponds to the total amount of oxygen which is released from the upstream side exhaust purification catalyst 20 from the time $t_3$ to the time $t_4$. However, as explained above, deviation occurs in the output air-fuel ratio AFup of the upstream side air-fuel ratio sensor 40. Therefore, in the example shown in FIG. 16, the cumulative oxygen excess/deficiency ΣOED in the oxygen decrease time period Tdec from the time $t_3$ to time $t_4$ is larger than the value which corresponds to the total amount of oxygen which is actually released from the upstream side exhaust purification catalyst 20 from the time $t_3$ to the time $t_4$.

In this regard, in the oxygen increase time period Tinc, oxygen is stored at the upstream side exhaust purification catalyst 20, while in the oxygen decrease time period Tdec, the stored oxygen is completely released. Therefore, the absolute value $R_1$ of the cumulative oxygen excess/deficiency at the oxygen increase time period Tinc and the absolute value $F_1$ of the cumulative oxygen excess/deficiency at the oxygen decrease time period Tdec must be basically the same value as each other. However, as explained above, when deviation occurs in the output air-fuel ratio AFup of the upstream side air-fuel ratio sensor 40, the cumulative values change in accordance with the deviation. As explained above, when the output air-fuel ratio of the upstream side air-fuel ratio sensor 40 deviates to the low side (rich side), the absolute value $F_1$ becomes greater than the absolute value $R_1$. Conversely, when the output air-fuel ratio of the upstream side air-fuel ratio sensor 40 deviates to the high side (lean side), the absolute value $F_1$ becomes smaller than the absolute value $R_1$. In addition, the difference ΔΣOED of the absolute value $R_1$ of the cumulative oxygen excess/deficiency at the oxygen increase time period Tinc and the absolute value $F_1$ of the cumulative oxygen excess/deficiency at the oxygen decrease time period Tdec (=$R_1$-$F_1$. below, also referred to as the "excess/deficiency error") expresses the extent of deviation at the output air-fuel ratio of the upstream side air-fuel ratio sensor 40. The larger the difference between these absolute values $R_1$ and $F_1$, the greater the deviation in the output air-fuel ratio of the upstream side air-fuel ratio sensor 40.

Therefore, in the present embodiment, the control center air-fuel ratio AFR is corrected based on the excess/deficiency error ΔΣOED. In particular, in the present embodiment, the control center air-fuel ratio AFR is corrected so that the difference ΔΣOED of the absolute value $R_1$ of the cumulative oxygen excess/deficiency at the oxygen increase time period Tinc and the absolute value $F_1$ of the cumulative oxygen excess/deficiency at the oxygen decrease time period Tdec becomes smaller.

Specifically, in the present embodiment, the learning value sfbg is calculated by the following formula (3), and the control center air-fuel ratio AFR is corrected by the following formula (4).

$$\mathrm{sfbg}(n)=\mathrm{sfbg}(n-1)+k_1\cdot\Delta\Sigma OED \quad (3)$$

$$AFR=AFR\mathrm{base}+\mathrm{sfbg}(n) \quad (4)$$

Note that, in the above formula (3), "n" expresses the number of calculations or time. Therefore, sfbg(n) is the current calculated or current learning value. In addition, "$k_1$" in the above formula (3) is the gain which shows the extent by which the excess/deficiency error ΔΣOED is reflected in the control center air-fuel ratio AFR. The larger the value of the gain "$k_1$", the larger the correction amount of the control center air-fuel ratio AFR. In addition, in the above formula (4), the base control center air-fuel ratio AFRbase is a control center air-fuel ratio which is used as base, and is the stoichiometric air-fuel ration in the present embodiment.

At the time $t_3$ of FIG. 16, as explained above, the learning value sfbg is calculated based on the absolute values $R_1$ and $F_1$. In particular, in the example shown in FIG. 16, the absolute value $F_1$ of the cumulative oxygen excess/deficiency at the oxygen decrease time period Tdec is larger than the absolute value $R_1$ of the cumulative oxygen excess/deficiency at the oxygen increase time period Tinc, and therefore at the time $t_3$, the learning value sfbg is decreased.

In this regard, the control center air-fuel ratio AFR is corrected based on the learning value sfbg by using the above formula (4). In the example shown in FIG. 16, since the learning value sfbg is a negative value, the control center air-fuel ratio AFR becomes a value smaller than the base control center air-fuel ratio AFRbase, that is, the rich side value. Due to this, the air-fuel ratio of the exhaust gas flowing into the upstream side exhaust purification catalyst 20 is corrected to the rich side.

As a result, after the time $t_4$, the deviation of the actual air-fuel ratio of the exhaust gas flowing into the upstream side exhaust purification catalyst 20 with respect to the target air-fuel ratio becomes smaller than before the time $t_4$. Therefore, the difference between the broken line showing the actual air-fuel ratio and the one-dot chain line showing the target air-fuel ratio after the time $t_4$ becomes smaller than the difference before the time $t_4$ (before the time $t_4$, since the target air-fuel ratio conforms to the output air-fuel ratio of the downstream side air-fuel ratio sensor 41, the one-dot chain line overlaps the solid line).

Further, after the time $t_4$ as well, an operation similar to the operation during the time $t_1$ to time $t_4$ is performed. Therefore, at the time $t_6$, if the cumulative oxygen excess/deficiency ΣOED reaches the switching reference value OEDref, the target air-fuel ratio is switched from the lean set air-fuel ratio to the rich set air-fuel ratio. After this, at the time $t_7$, when the output air-fuel ratio AFdwn of the downstream side air-fuel ratio sensor 41 reaches the rich judgment reference value Irrich, the target air-fuel ratio is again switched to the lean set air-fuel ratio.

The time $t_4$ to time $t_6$, as explained above, corresponds to the oxygen increase time period Tinc, and therefore, the absolute value of the cumulative oxygen excess/deficiency ΣOED during this period is expressed by $R_2$ of FIG. 16. Further, the time $t_6$ to time $t_7$, as explained above, corresponds to the oxygen decrease time period Tdec, and therefore the absolute value of the cumulative oxygen excess/deficiency ΣOED during this period is expressed by $F_2$ of FIG. 16. Further, the learning value sfbg is updated based on the difference ΔΣOED (=$R_2$−$F_2$) of these absolute values $R_2$ and $F_2$ by using the above formula (3). In the present embodiment, similar control is repeated after the time $t_7$ and thus the learning value sfbg is repeatedly updated.

By updating the learning value sfbg in this way by means of normal learning control, the output air-fuel ratio AFup of the upstream side air-fuel ratio sensor 40 is gradually separated from the target air-fuel ratio, but the actual air-fuel ratio of the exhaust gas flowing into the upstream side exhaust purification catalyst 20 gradually approaches the target air-fuel ratio. Due to this, it is possible to compensate the deviation at the output air-fuel ratio of the upstream side air-fuel ratio sensor 40.

Note that, as explained above, the learning value sfbg is preferably updated based on the cumulative oxygen excess/deficiency ΣOED at the oxygen increase time period Tinc and the cumulative oxygen excess/deficiency ΣOED at the oxygen decrease time period Tdec which follows this oxygen increase time period Tinc. This is because, as explained above, the total amount of oxygen stored at the upstream side exhaust purification catalyst 20 in the oxygen increase time period Tinc and the total amount of of oxygen released from the upstream side exhaust purification catalyst 20 in the directly following oxygen decrease time period Tdec, become equal.

In addition, in the above embodiment, the learning value sfbg is updated based on the cumulative oxygen excess/deficiency ΣOED in a single oxygen increase time period Tinc and the cumulative oxygen excess/deficiency ΣOED in a single oxygen decrease time period Tdec. However, the learning value sfbg may be updated based on the total value or average value of the cumulative oxygen excess/deficiency ΣOED in a plurality of oxygen increase time periods Tinc and the total value or average value of the cumulative oxygen excess/deficiency ΣOED in a plurality of oxygen decrease time periods Tdec.

Further, in the above embodiment, the control center air-fuel ratio is corrected based on the learning value sfbg. However, a parameter which is corrected based on the learning value sfbg may another parameter relating to the air-fuel ratio. The other parameter, for example, includes one of the amount of fuel fed to the inside of the combustion chamber 5, the output air-fuel ratio of the upstream side air-fuel ratio sensor 40, the air-fuel ratio adjustment amount, etc.

<Large Deviation in Upstream Side Air-Fuel Ratio Sensor>

In the example shown in FIG. 15, deviation occurs in the output air-fuel ratio of the upstream side exhaust purification catalyst 20, but the extent thereof is not that large. Therefore, as will be understood from the broken line of FIG. 15, when the target air-fuel ratio is set to the rich set air-fuel ratio, the actual air-fuel ratio of the exhaust gas becomes a rich air-fuel ratio while leaner than the rich set air-fuel ratio.

As opposed to this, if the deviation which occurs at the upstream side exhaust purification catalyst 20 becomes larger, as explained above, even if the target air-fuel ratio is set to the slight rich set air-fuel ratio, sometimes the actual air-fuel ratio of the exhaust gas becomes the stoichiometric air-fuel ratio. This state is shown in FIG. 17.

Figure 17:
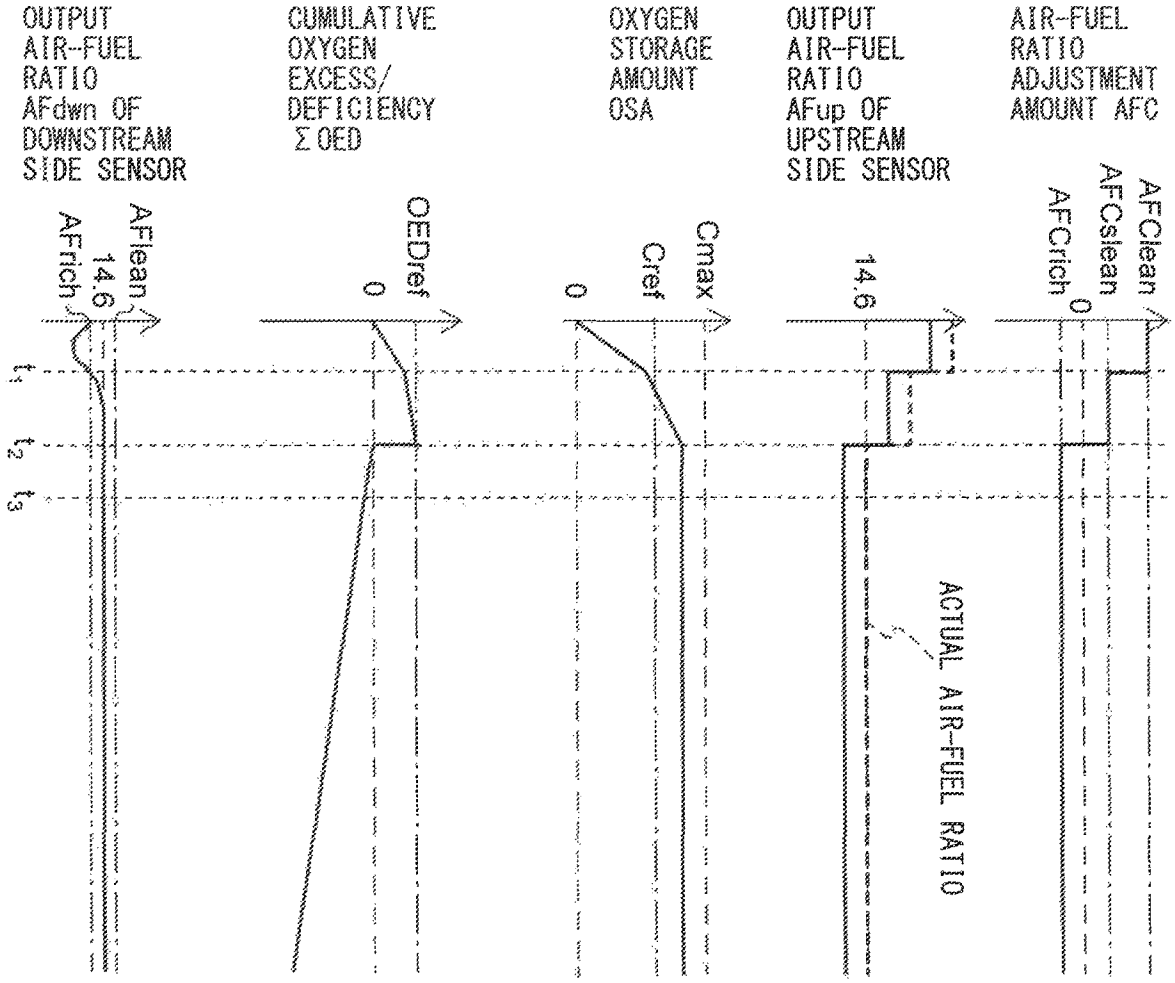
FIG. 17 is a time chart of the air-fuel ratio adjustment amount, etc., when large deviation occurs in the output air-fuel ratio of the upstream side air-fuel ratio sensor.

In the example shown in FIG. 17, if, at the time $t_2$, the output air-fuel ratio AFup of the upstream side air-fuel ratio sensor 40 becomes the lean judged air-fuel ratio AFlean or more, the air-fuel ratio adjustment amount AFC is switched to the rich set adjustment amount AFCrich. Along with this, the output air-fuel ratio AFup of the upstream side air-fuel ratio sensor 40 becomes an air-fuel ratio which corresponds to the rich set air-fuel ratio. However, since the output air-fuel ratio of the upstream side air-fuel ratio sensor 40 greatly deviates to the rich side, the actual air-fuel ratio of the exhaust gas becomes the stoichiometric air-fuel ratio (broken line in figure).

As a result, the oxygen storage amount OSA of the upstream side exhaust purification catalyst 20 is maintained at a constant value without being changed. Therefore, even if a long time elapses from when switching the air-fuel ratio adjustment amount AFC to the slight rich set adjustment amount AFCsrich, unburned gas will never be exhausted from the upstream side exhaust purification catalyst 20. Therefore, the output air-fuel ratio AFdwn of the downstream side air-fuel ratio sensor 41 is maintained at substantially the stoichiometric air-fuel ratio. As explained above, the air-fuel ratio adjustment amount AFC is switched from the rich set adjustment amount AFCrich to the lean set adjustment amount AFClean, when the output air-fuel ratio AFdwn of the downstream side air-fuel ratio sensor 41 reaches the rich judged air-fuel ratio AFrich. However, in the example shown in FIG. 17, the output air-fuel ratio AFdwn of the downstream side air-fuel ratio sensor 41 is maintained as is at the stoichiometric air-fuel ratio, and therefore the air-fuel ratio adjustment amount AFC is maintained at the slight rich set adjustment amount AFCsrich for a long time. In this regard, the above-mentioned normal learning control is predicated on the target air-fuel ratio being alternately switched between the rich air-fuel ratio and the lean air-fuel ratio. Therefore, when the output air-fuel ratio of the upstream side air-fuel ratio sensor 40 greatly deviates, the above-mentioned normal learning control cannot be performed.

Figure 18:
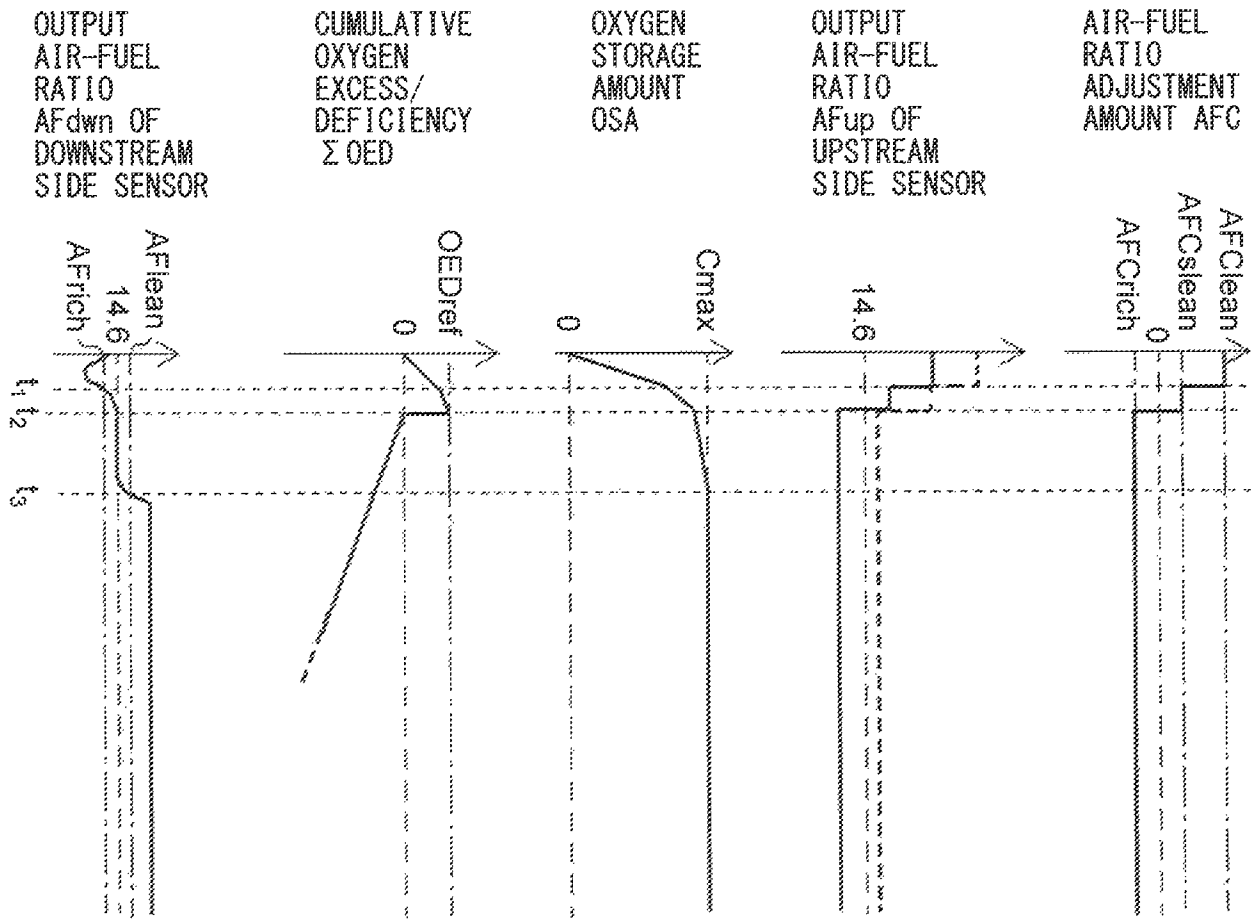
FIG. 18 is a time chart of the air-fuel ratio adjustment amount, etc., when large deviation occurs in the output air-fuel ratio of the upstream side air-fuel ratio sensor.

FIG. 18 is a view similar to FIG. 17 which shows the case where the output air-fuel ratio of the upstream side air-fuel ratio sensor 40 deviates to the rich side extremely greatly. In the example shown in FIG. 18, in the same way as the example shown in FIG. 17, at the time $t_2$, the air-fuel ratio adjustment amount AFC is set to the rich set adjustment amount AFCrich. Along with this, the output air-fuel ratio AFup of the upstream side air-fuel ratio sensor 40 becomes an air-fuel ratio which corresponds to the rich set air-fuel ratio. However, due to deviation of the output air-fuel ratio of the upstream side air-fuel ratio sensor 40, the actual air-fuel ratio of the exhaust gas becomes the lean air-fuel ratio (broken line in figure).

As a result, regardless of the air-fuel ratio adjustment amount AFC being set to the rich set adjustment amount AFCrich, exhaust gas of a lean air-fuel ratio flows into the upstream side exhaust purification catalyst 20. Therefore, the oxygen storage amount OSA of the upstream side exhaust purification catalyst 20 increases after the time $t_2$, and reaches the maximum storable oxygen amount Cmax at the time $t_3$. As a result, after the time $t_3$, the exhaust gas of the lean air-fuel ratio which flows into the upstream side exhaust purification catalyst 20, flows out as it is. Therefore, after the time $t_3$, the output air-fuel ratio AFdwn of the downstream side air-fuel ratio sensor 41 is maintained at the lean judged air-fuel ratio or more. Therefore, the air-fuel ratio adjustment amount AFC is maintained as is without being switched to the lean set adjustment amount AFClean. As a result, when the output air-fuel ratio of the upstream side air-fuel ratio sensor 40 deviates extremely greatly, the air-fuel ratio adjustment amount AFC is also not switched and therefore the above-mentioned normal control cannot be performed. In addition, in this case, exhaust gas containing $NO_X$ continues to flow out from the upstream side exhaust purification catalyst 20.

<Stuck Learning Control>

Therefore, in the present embodiment, even if the deviation of the output air-fuel ratio of the upstream side air-fuel ratio sensor 40 is large, to compensate that deviation, in addition to the above-mentioned normal learning control, stoichiometric air-fuel ratio stuck learning control, lean stuck learning control, and rich stuck learning control are performed.

<Stoichiometric Air-Fuel Ratio Stuck Learning>

First, the stoichiometric air-fuel ratio stuck learning control will be explained. The stoichiometric air-fuel ratio stuck learning control is learning control which is performed when the air-fuel ratio detected by the downstream side air-fuel ratio sensor 41 is stuck at the stoichiometric air-fuel ratio as shown in the example shown in FIG. 17.

Figure 19:
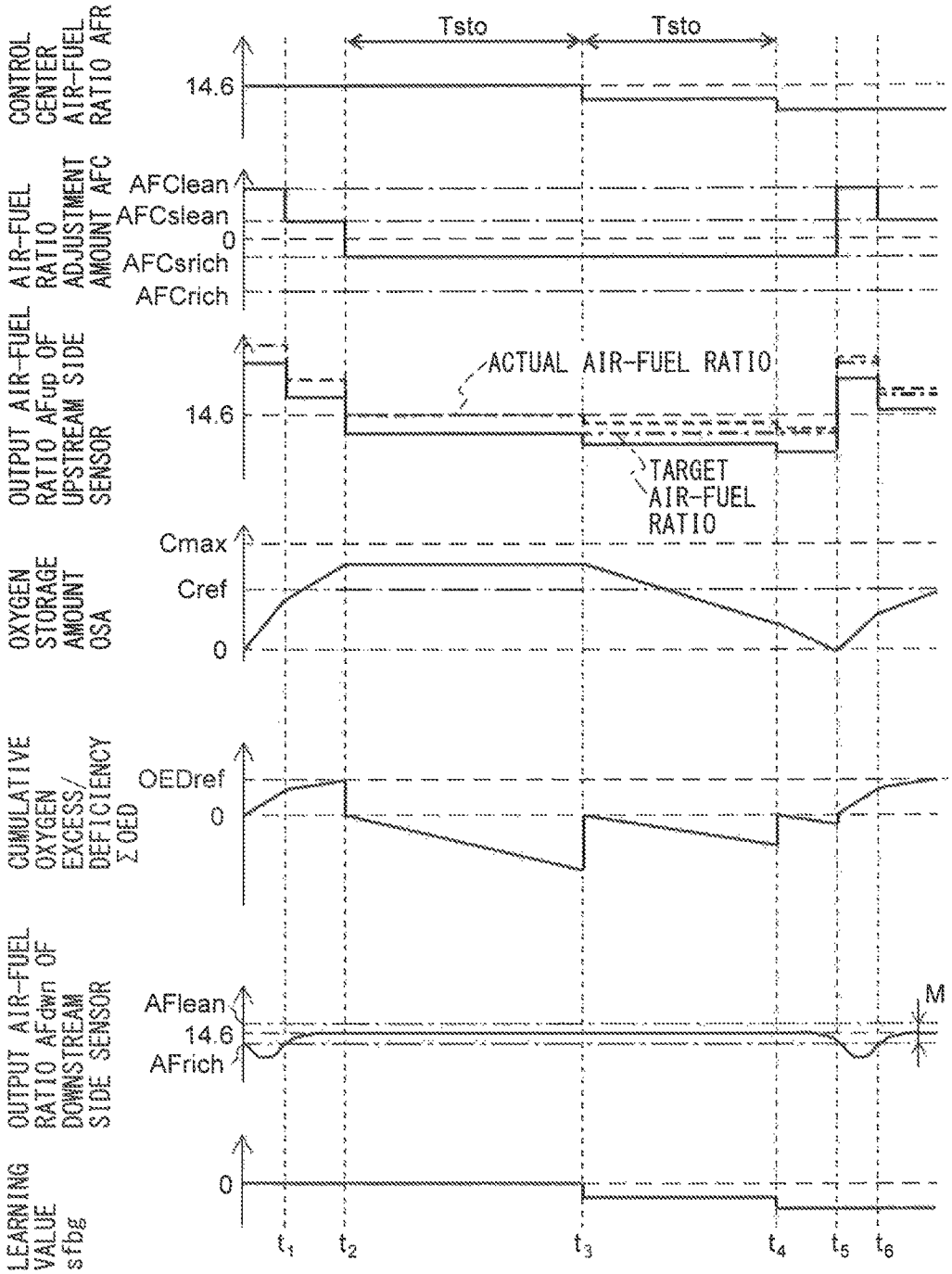
FIG. 19 is a time chart of the air-fuel ratio adjustment amount, etc., when performing stoichiometric air-fuel ratio stuck learning.

In this regard, the region between the rich judged air-fuel ratio AFrich and the lean judged air-fuel ratio AFlean will be referred to as the "middle region M". This middle region M corresponds to a "stoichiometric air-fuel ratio proximity region" which is the air-fuel ratio region between the rich judged air-fuel ratio and the lean judged air-fuel ratio. In stoichiometric air-fuel ratio-stuck learning control, after the air-fuel ratio adjustment amount AFC is switched to the rich set adjustment amount AFCrich, that is, in the state where the target air-fuel ratio is set to the rich air-fuel ratio, it is judged if the output air-fuel ratio AFdwn of the downstream side air-fuel ratio sensor 41 has been maintained in the middle region M over a predetermined stoichiometric air-fuel ratio maintenance judged time or more. Alternatively, after the air-fuel ratio adjustment amount AFC is switched to the lean set adjustment amount AFClean, that is, in the state where the target air-fuel ratio is set to the lean air-fuel ratio, it is judged if the output air-fuel ratio AFdwn of the downstream side air-fuel ratio sensor 41 has been maintained in the middle region M over the predetermined stoichiometric air-fuel ratio maintenance judged time or more. Further, if it has been maintained in the middle region M over the stoichiometric air-fuel ratio maintenance judged time or more, the learning value sfbg is changed so that the air-fuel ratio of the exhaust gas flowing into the upstream side exhaust purification catalyst 20 changes. At this time, when the target air-fuel ratio has been set to the rich air-fuel ratio, the learning value sfbg is decreased so that the air-fuel ratio of the exhaust gas flowing into the upstream side exhaust purification catalyst 20 changes to the rich side. On the other hand, when the target air-fuel ratio has been set to the lean air-fuel ratio, the learning value sfbg is increased so that the air-fuel ratio of the exhaust gas flowing into the upstream side exhaust purification catalyst 20 changes to the lean side. FIG. 19 shows this state.

FIG. 19 is a view similar to FIG. 16 which shows a time chart of the air-fuel ratio adjustment amount AFC, etc. FIG. 19, similarly to FIG. 17, shows the case where the output air-fuel ratio AFup of the upstream side air-fuel ratio sensor 40 greatly deviates to the low side (rich side).

In the illustrated example, similarly to FIG. 17, at the time $t_2$, the air-fuel ratio adjustment amount AFC is set to the slight rich set adjustment amount AFCsrich. However, since the output air-fuel ratio of the upstream side air-fuel ratio sensor 40 greatly deviates to the rich side, similarly to the example shown in FIG. 8, the actual air-fuel ratio of the exhaust gas is substantially the stoichiometric air-fuel ratio. Therefore, after the time $t_3$, the oxygen storage amount OSA of the upstream side exhaust purification catalyst 20 is maintained at a constant value. As a result, the output air-fuel ratio AFdwn of the downstream side air-fuel ratio sensor 41 is maintained near the stoichiometric air-fuel ratio and accordingly is maintained in the middle region M, over a long time period.

Therefore, in the present embodiment, when the target air-fuel ratio is set to a rich air-fuel ratio, if the output air-fuel ratio AFdwn of the downstream side air-fuel ratio sensor 41 is maintained in the middle region M over a predetermined stoichiometric air-fuel ratio maintenance judged time Tsto or more, the control center air-fuel ratio AFR is corrected. In particular, in the present embodiment, the learning value sfbg is updated so that the air-fuel ratio of the exhaust gas flowing into the upstream side exhaust purification catalyst 20 changes to the rich side.

Specifically, in the present embodiment, the learning value sfbg is calculated by the following formula (5), and the control center air-fuel ratio AFR is corrected by the above formula (4).

$$\mathrm{sfbg}(n)=\mathrm{sfbg}(n-1)+k_2 \cdot AFC \tag{5}$$

Note that in the above formula (5), $k_2$ is the gain which shows the extent of correction of the control center air-fuel ratio AFR ($0<k_2\leq 1$). The larger the value of the gain $k_2$, the larger the correction amount of the control center air-fuel ratio AFR becomes. Further, the current air-fuel ratio adjustment amount AFC is plugged in for AFC in formula (5), and in the case of the time $t_3$ of FIG. 19, this is the rich set adjustment amount AFCrich.

In this regard, as explained above, when the target air-fuel ratio is set to the rich air-fuel ratio, if the output air-fuel ratio AFdwn of the downstream side air-fuel ratio sensor 41 is maintained in the middle region M over a long period of time, the actual air-fuel ratio of the exhaust gas becomes a value close to substantially the stoichiometric air-fuel ratio. Therefore, the deviation at the upstream side air-fuel ratio sensor 40 becomes the same extent as the difference between the control center air-fuel ratio (stoichiometric air-fuel ratio) and the target air-fuel ratio (in this case, the rich set air-fuel ratio). In the present embodiment, as shown in the above formula (4), the learning value sfbg is updated based on the air-fuel ratio adjustment amount AFC corresponding to the difference between the control center air-fuel ratio and the target air-fuel ratio. Due to this, it is possible to more suitably compensate for deviation in the output air-fuel ratio of the upstream side air-fuel ratio sensor 40.

In the example shown in FIG. 19, at the time $t_2$, the air-fuel ratio adjustment amount AFC is set to the rich set adjustment amount AFCrich. Therefore, if using formula (5), at the time $t_3$, the learning value sfbg is decreased. As a result, the actual air-fuel ratio of the exhaust gas flowing into the upstream side exhaust purification catalyst 20 changes to the rich side. Due to this, after the time $t_3$, the deviation of the actual air-fuel ratio of the exhaust gas flowing into the upstream side exhaust purification catalyst 20 from the target air-fuel ratio becomes smaller compared with before the time $t_3$. Therefore, after the time $t_3$, the difference between the broken line which shows the actual air-fuel ratio and the one-dot chain line which shows the target air-fuel ratio becomes smaller than the difference before the time $t_3$.

In the example shown in FIG. 19, the gain $k_2$ is set to a relatively small value. For this reason, even if the learning value sfbg is updated at the time $t_3$, deviation of the actual air-fuel ratio of the exhaust gas flowing into the upstream side exhaust purification catalyst 20, from the target air-fuel ratio, remains. Therefore, the actual air-fuel ratio of the exhaust gas becomes an air-fuel ratio which is leaner than the rich set air-fuel ratio, that is, an air-fuel ratio with a small rich degree (see broken line of FIG. 19). For this reason, the decreasing speed of the oxygen storage amount OSA of the upstream side exhaust purification catalyst 20 is slow.

As a result, from the time $t_3$ to the time $t_4$ when the stoichiometric air-fuel ratio maintenance judged time Tsto elapses, the output air-fuel ratio AFdwn of the downstream side air-fuel ratio sensor 41 is maintained close to the stoichiometric air-fuel ratio, and accordingly is maintained in the middle region M. Therefore, in the example shown in FIG. 19, even at the time $t_4$, the learning value sfbg is updated by using formula (5).

In the example shown in FIG. 19, after that, at the time $t_5$, the output air-fuel ratio AFdwn of the downstream side air-fuel ratio sensor 41 becomes the rich judged air-fuel ratio AFrich or less. After the output air-fuel ratio AFdwn becomes the rich judged air-fuel ratio AFrich or less in this way, as explained above, the target air-fuel ratio is alternately set to the lean air-fuel ratio and the rich air-fuel ratio. Along with this, the above-mentioned normal learning control is performed.

By updating the learning value sfbg by the stoichiometric air-fuel ratio stuck learning control in this way, the learning value can be updated even when the deviation of the output air-fuel ratio AFup of the upstream side air-fuel ratio sensor 40 is large. Due to this, it is possible to compensate deviation at the output air-fuel ratio of the upstream side air-fuel ratio sensor 40.

<Modification of Stoichiometric Air-Fuel Ratio Stuck Learning>

Note that in the above embodiment, the stoichiometric air-fuel ratio maintenance judged time Tsto is a predetermined time. In this case, the stoichiometric air-fuel ratio maintenance judged time is set to not less than the usual time taken from when switching the target air-fuel ratio to the rich air-fuel ratio to when the absolute value of the cumulative oxygen excess/deficiency ΣOED reaches the maximum storable oxygen amount of the upstream side exhaust purification catalyst 20 at the time of new product. Specifically, it is preferably set to two to four times that time.

Alternatively, the stoichiometric air-fuel ratio maintenance judged time Tsto may be changed in accordance with other parameters, such as the cumulative oxygen excess/deficiency ΣOED in the period while the output air-fuel ratio AFdwn of the downstream side air-fuel ratio sensor 41 is maintained in the middle region M. Specifically, for example, the greater the cumulative oxygen excess/deficiency ΣOED, the shorter the stoichiometric air-fuel ratio maintenance judged time Tsto is set.

Further, in the above-mentioned stoichiometric air-fuel ratio stuck learning control, the learning value is updated if the air-fuel ratio detected by the downstream side air-fuel ratio sensor 41 is maintained in the air-fuel ratio region close to stoichiometric air-fuel ratio over the stoichiometric air-fuel ratio maintenance judged time Tsto or more. However, stoichiometric air-fuel ratio stuck learning may be performed based on a parameter other than time.

For example, when the air-fuel ratio detected by the downstream side air-fuel ratio sensor 41 is stuck to the stoichiometric air-fuel ratio, the cumulative oxygen excess/deficiency becomes greater after the target air-fuel ratio is switched between the lean air-fuel ratio and the rich air-fuel ratio. Therefore, it is also possible to update the learning value in the above-mentioned way if the absolute value of the cumulative oxygen excess/deficiency after switching the target air-fuel ratio or the absolute value of the cumulative oxygen excess/deficiency in the period when the output air-fuel ratio AFdwn of the downstream side air-fuel ratio sensor 41 is maintained in the middle region M becomes larger than a predetermined value or more.

Furthermore, the example shown in FIG. 10 shows the case where the target air-fuel ratio is switched to the rich air-fuel ratio, and then the output air-fuel ratio AFdwn of the downstream side air-fuel ratio sensor 41 is maintained in the air-fuel ratio region close to stoichiometric air-fuel ratio, over the stoichiometric air-fuel ratio maintenance judged time Tsto or more. However, similar control is possible even where the target air-fuel ratio is switched to the lean air-fuel ratio, and then the output air-fuel ratio AFdwn of the downstream side air-fuel ratio sensor 41 is maintained in the air-fuel ratio region close to the stoichiometric air-fuel ratio, over the stoichiometric air-fuel ratio maintenance judged time Tsto or more.

Therefore, if expressing these together, in the present embodiment, when the target air-fuel ratio is set to an air-fuel ratio deviating from the stoichiometric air-fuel ratio to one side (that is, the rich air-fuel ratio or lean air-fuel ratio), if the air-fuel ratio detected by the downstream side air-fuel ratio sensor 41 is maintained in the air-fuel ratio region close to the stoichiometric air-fuel ratio, over the stoichiometric air-fuel ratio maintenance judged time Tsto or more or during the time period when the cumulative oxygen excess/deficiency becomes a predetermined value or more, the learning means performs "stoichiometric air-fuel ratio-stuck learning" in which the parameter relating to feedback control is corrected so that in the feedback control, the air-fuel ratio of the exhaust gas flowing into the upstream side exhaust purification catalyst 20 changes to the one side.

<Rich/Lean Stuck Learning>

Figure 20:
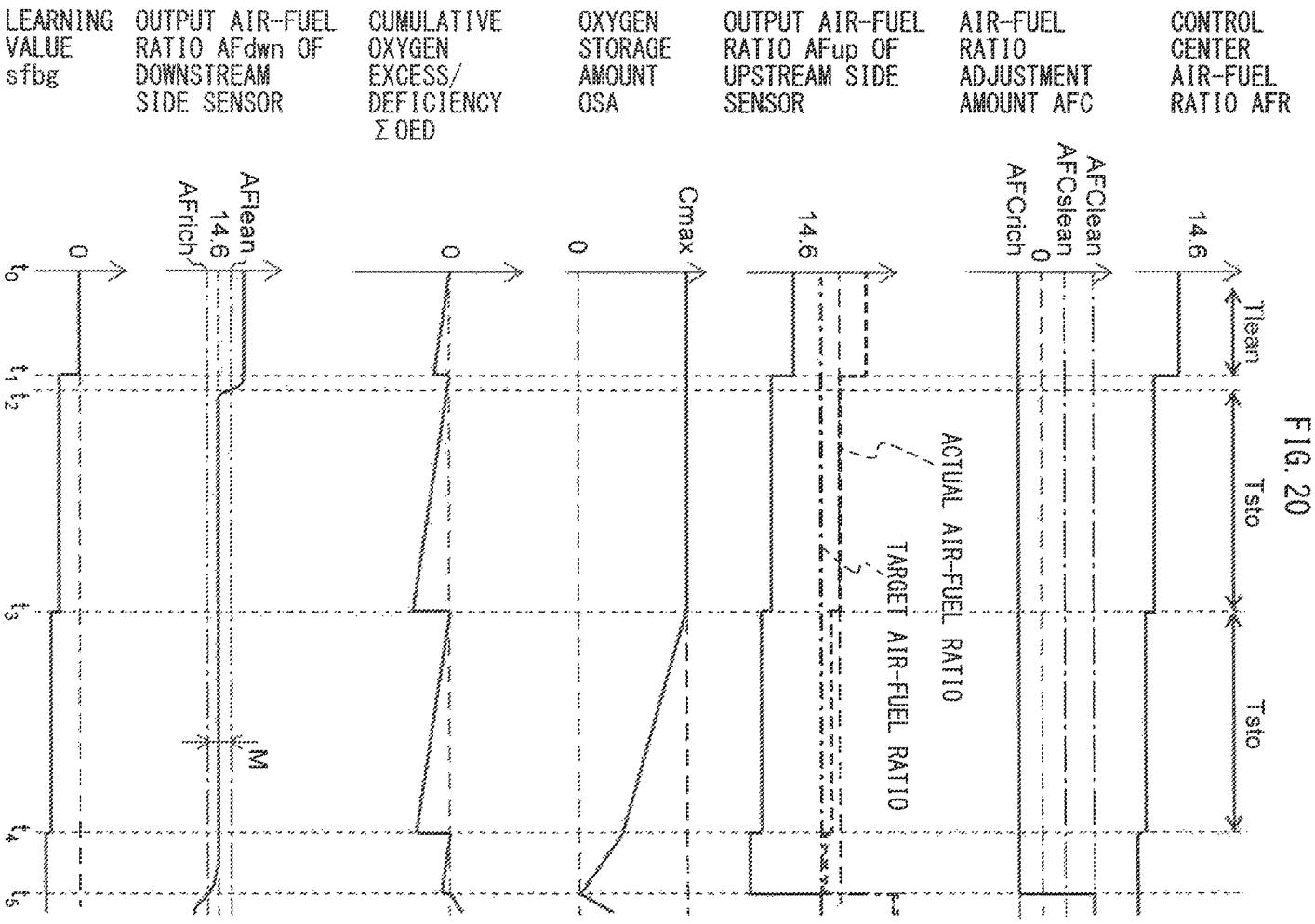
FIG. 20 is a time chart of the air-fuel ratio adjustment amount, etc., when performing lean stuck learning.

Next, lean stuck learning control will be explained. The lean stuck learning control is learning control which is performed where, as shown in the example of FIG. 18, although the target air-fuel ratio is set to the rich air-fuel ratio, the air-fuel ratio detected by the downstream side air-fuel ratio sensor 41 is stuck at the lean air-fuel ratio. In lean stuck learning control, it is judged if the output air-fuel ratio AFdwn of the downstream side air-fuel ratio sensor 41 has been maintained at the lean air-fuel ratio over a predetermined lean air-fuel ratio maintenance judged time or more after the air-fuel ratio adjustment amount AFC is switched to the rich set adjustment amount AFCrich, that is, in the state where the target air-fuel ratio is set to the rich air-fuel ratio. Further, when it is maintained at the lean air-fuel ratio over the lean air-fuel ratio maintenance judged time or more, the learning value sfbg is decreased so that the air-fuel ratio of the exhaust gas flowing into the upstream side exhaust purification catalyst 20 changes to the rich side. FIG. 20 shows this state.

FIG. 20 is a view, similar to FIG. 18, which shows a time chart of the air-fuel ratio adjustment amount AFC, etc. FIG. 20, like FIG. 18, shows the case where the output air-fuel ratio AFup of the upstream side air-fuel ratio sensor 40 deviates extremely greatly to the low side (rich side).

In the illustrated example, at the time $t_0$, the air-fuel ratio adjustment amount AFC is switched from the lean set adjustment amount AFClean to the rich set adjustment amount AFCrich. However, since the output air-fuel ratio of the upstream side air-fuel ratio sensor 40 deviates extremely greatly to the rich side, similarly to the example shown in FIG. 18, the actual air-fuel ratio of the exhaust gas becomes the lean air-fuel ratio. Therefore, after the time $t_0$, the output air-fuel ratio AFdwn of the downstream side air-fuel ratio sensor 41 is maintained at the lean air-fuel ratio.

Therefore, in the present embodiment, when the output air-fuel ratio AFdwn of the downstream side air-fuel ratio sensor 41 has been maintained at the lean air-fuel ratio for the predetermined lean air-fuel ratio maintenance judged time Tlean or more after the air-fuel ratio adjustment amount AFC is set to the rich set adjustment amount AFCrich, the control center air-fuel ratio AFR is corrected. In particular, in the present embodiment, the learning value sfbg is corrected so that the air-fuel ratio of the exhaust gas flowing into the upstream side exhaust purification catalyst 20 changes to the rich side.

Specifically, in the present embodiment, the learning value sfbg is calculated by using the following formula (6) and the control center air-fuel ratio AFR is corrected based on the learning value sfbg by using the above formula (4).

$$\mathrm{sfbg}(n)=\mathrm{sfbg}(n-1)+k_3\cdot(AF\mathrm{Crich}-(AF\mathrm{dwn}-14.6)) \quad (6)$$

Note that in the above formula (6), $k_3$ is the gain which expresses the extent of correction of the control center air-fuel ratio AFR ($0<k_3\leq 1$). The larger the value of the gain $k_3$, the larger the correction amount of the control center air-fuel ratio AFR.

In this regard, in the example shown in FIG. 20, when the air-fuel ratio adjustment amount AFC is set at the rich set adjustment amount AFCrich, the output air-fuel ratio AFdwn of the downstream side air-fuel ratio sensor 41 is maintained at the lean air-fuel ratio. In this case, the deviation at the upstream side air-fuel ratio sensor 40 corresponds to the difference between the target air-fuel ratio and the output air-fuel ratio of the downstream side air-fuel ratio sensor 41. If breaking this down, the deviation at the upstream side air-fuel ratio sensor 40 can be said to be of the same extent as the difference between the target air-fuel ratio and the stoichiometric air-fuel ratio (corresponding to rich set adjustment amount AFCrich) and the difference between the stoichiometric air-fuel ratio and the output air-fuel ratio of the downstream side air-fuel ratio sensor 41 added together. Therefore, in the present embodiment, as shown in the above formula (6), the learning value sfbg is updated based on the value acquired by adding the rich set adjustment amount AFCrich to the difference between the output air-fuel ratio of the downstream side air-fuel ratio sensor 41 and the stoichiometric air-fuel ratio. In particular, in the above-mentioned stoichiometric air-fuel ratio stuck learning, the learning value is corrected by an amount corresponding to the rich set adjustment amount AFCrich, while in lean stuck learning, the learning value is corrected by this amount plus a value corresponding to the output air-fuel ratio AFdwn of the downstream side air-fuel ratio sensor 41. Further, the gain $k_3$ is set to a similar extent to the gain $k_2$. For this reason, the correction amount in the lean stuck learning is larger than the correction amount in stoichiometric air-fuel ratio stuck learning.

In the example shown in FIG. 20, if using formula (6), the learning value sfbg is decreased at the time $t_1$. As a result, the actual air-fuel ratio of the exhaust gas flowing into the upstream side exhaust purification catalyst 20 changes to the rich side. Due to this, after the time $t_1$, the deviation of the actual air-fuel ratio of the exhaust gas flowing into the upstream side exhaust purification catalyst 20 from the target air-fuel ratio becomes smaller, compared with before the time $t_1$. Therefore, after the time $t_1$, the difference between the broken line which shows the actual air-fuel ratio and the one-dot chain line which shows the target air-fuel ratio becomes smaller than the difference before the time $t_1$.

In the example shown in FIG. 20, if the learning value sfbg is updated at the time $t_1$, the deviation of the actual air-fuel ratio of the exhaust gas flowing into the upstream side exhaust purification catalyst 20, with respect to the target air-fuel ratio, becomes smaller. Due to this, in the illustrated example, after the time $t_1$, the actual air-fuel ratio of the exhaust gas becomes substantially the stoichiometric air-fuel ratio. Along with this, the output air-fuel ratio AFdwn of the downstream side air-fuel ratio sensor 41 changes from the lean air-fuel ratio to substantially the stoichiometric air-fuel ratio. In particular, in the example shown in FIG. 20, from the time $t_2$ to the time $t_3$, the output air-fuel ratio AFdwn of the downstream side air-fuel ratio sensor 41 is maintained at substantially the stoichiometric air-fuel ratio, that is, in the middle region M, over the stoichiometric air-fuel ratio maintenance judged time Tsto. For this reason, at the time $t_3$, stoichiometric air-fuel ratio stuck learning is performed by using the above formula (5) to correct the learning value sfbg.

By updating the learning value sfbg in this way by lean stuck learning control, it is possible to update the learning value even when the deviation of the output air-fuel ratio AFup of the upstream side air-fuel ratio sensor 40 is extremely large. Due to this, it is possible to reduce the deviation in the output air-fuel ratio of the upstream side air-fuel ratio sensor 40.

Note that, in the above embodiment, the lean air-fuel ratio maintenance judged time Tlean is a predetermined time. In this case, the lean air-fuel ratio maintenance judged time Tlean is set to not less than the delayed response time of the downstream side air-fuel ratio sensor which is usually taken from when switching the target air-fuel ratio to the rich air-fuel ratio to when, according to this, the output air-fuel ratio of the downstream side air-fuel ratio sensor 41 changes. Specifically, it is preferably set to two times to four times that time. Further, the lean air-fuel ratio maintenance judged time Tlean is shorter than the time usually taken from when switching the target air-fuel ratio to the rich air-fuel ratio to when the absolute value of the cumulative oxygen excess/deficiency ΣOED reaches the maximum storable oxygen amount of the upstream side exhaust purification catalyst 20 at the time of non-use. Therefore, the lean air-fuel ratio maintenance judged time Tlean is set shorter than the above-mentioned stoichiometric air-fuel ratio maintenance judged time Tsto.

Alternatively, the lean air-fuel ratio maintenance judged time Tlean may be changed in accordance with another parameter, such as the cumulative exhaust gas flow amount in the period while the output air-fuel ratio AFdwn of the downstream side air-fuel ratio sensor 41 is the lean judged air-fuel ratio or more. Specifically, for example, the larger the cumulative exhaust gas flow amount ΣGe, the shorter the lean air-fuel ratio maintenance judged time Tlean is set. Due to this, when the cumulative exhaust gas flow from when switching the target air-fuel ratio to the rich air-fuel ratio becomes a predetermined amount, the above-mentioned learning value sfbg can be updated. Further, in this case, the predetermined amount has to be not less than the total amount of flow of the exhaust gas which is required from when switching the target air-fuel ratio to when the output air-fuel ratio of the downstream side air-fuel ratio sensor 41 changes according to the switch. Specifically, it is preferably set to an amount of 2 to 4 times that total flow.

Next, rich stuck learning control will be explained. The rich stuck learning control is control similar to the lean stuck learning control, and is learning control which is performed when although the target air-fuel ratio is set to the lean air-fuel ratio, the air-fuel ratio detected by the downstream side air-fuel ratio sensor 41 is stuck at the rich air-fuel ratio. In rich stuck learning control, in the state where the target air-fuel ratio is set to the lean air-fuel ratio, it is judged if the output air-fuel ratio AFdwn of the downstream side air-fuel ratio sensor 41 is maintained at the rich air-fuel ratio over a predetermined rich air-fuel ratio maintenance judged time (similar to lean air-fuel ratio maintenance judged time) or more. Further, when maintained at the rich air-fuel ratio for the rich air-fuel ratio maintenance judged time or more, the learning value sfbg is increased so that the air-fuel ratio of the exhaust gas flowing into the upstream side exhaust purification catalyst 20 changes to the lean side. That is, in rich stuck learning control, control is performed with rich and lean reversed from the above lean stuck learning control.

<Learning Promotion Control>

If a large deviation occurs in the output air-fuel ratio AFup of the upstream side air-fuel ratio sensor 40, in order to quickly eliminate this deviation, it becomes necessary to promote updating of the learning value sfbg by learning control.

Therefore, in the present embodiment, when it is necessary to promote updating of the learning value sfbg by learning control, compared with when it is not necessary to promote it, the rich degrees of the rich set air-fuel ratio and slight rich set air-fuel ratio are increased. In addition, when it is necessary to promote updating of the learning value sfbg by learning control, compared with when it is not necessary to promote it, the lean degrees of the lean set air-fuel ratio and slight lean set air-fuel ratio are increased. Below, such control will be referred to as "learning promotion control".

In particular, in the present embodiment, when the difference ΔΣOED between the absolute value (lean oxygen amount cumulative value) $R_1$ of the cumulative oxygen excess/deficiency ΣOED at the oxygen increase time period Tinc and the absolute value (rich oxygen amount cumulative value) $F_1$ of the cumulative oxygen excess/deficiency ΣOED at the oxygen decrease time period Tdec is a predetermined promotion judged reference value or more, it is judged that it is necessary to promote updating of the learning value sfbg by learning control. In addition, in the present embodiment, if, after the air-fuel ratio adjustment amount AFC is switched to the rich set adjustment amount AFCrich, that is, the target air-fuel ratio is switched to the rich set air-fuel ratio, the output air-fuel ratio AFdwn of the downstream side air-fuel ratio sensor 41 is maintained in the middle region M over a predetermined stoichiometric air-fuel ratio promotion judged time (which is preferably stoichiometric air-fuel ratio maintenance judged time or less) or more, it is judged that it is necessary to promote updating of the learning value sfbg by learning control. Further, in the present embodiment, if, after the air-fuel ratio adjustment amount AFC is switched to the rich set adjustment amount AFCrich, the output air-fuel ratio AFdwn of the downstream side air-fuel ratio sensor 41 is maintained at the lean air-fuel ratio over a predetermined lean air-fuel ratio promotion judged time (which is preferably lean air-fuel ratio maintenance judged time or less) or more, it is judged that it is necessary to promote updating of the learning value sfbg by learning control. Similarly, if, after the air-fuel ratio adjustment amount AFC is switched to the lean set adjustment amount AFClean, the output air-fuel ratio AFdwn of the downstream side air-fuel ratio sensor 41 is maintained at the rich air-fuel ratio over a predetermined rich air-fuel ratio promotion judged time (which is preferably rich air-fuel ratio maintenance judged time or less) or more, it is judged that it is necessary to promote updating of the learning value sfbg by learning control. Note that, the lean air-fuel ratio promotion judged time and the rich air-fuel ratio promotion judged time are set to times shorter than the stoichiometric air-fuel ratio promotion judged time.

Figure 21:
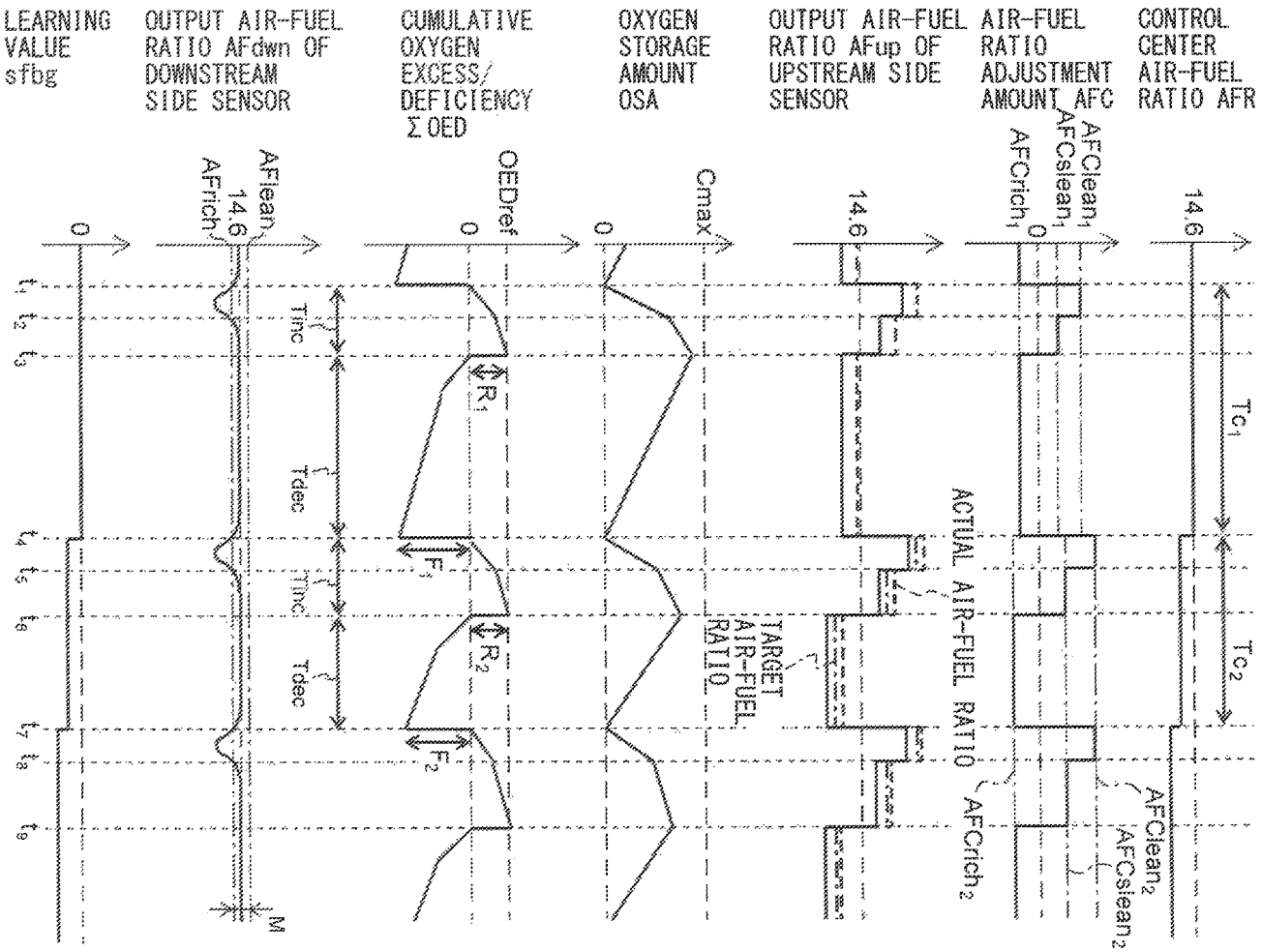
FIG. 21 is a time chart of the air-fuel ratio adjustment amount, etc., when performing learning promotion control.

FIG. 21 is a time chart of the control center air-fuel ratio AFR, etc., similar to FIG. 16, etc. FIG. 21, like FIG. 16, etc., shows the case where the output air-fuel ratio AFup of the upstream side air-fuel ratio sensor 40 deviates to the low side (rich side).

In the illustrated example, in the state before the time $t_1$, the control center air-fuel ratio is set to the stoichiometric air-fuel ratio, and the air-fuel ratio adjustment amount AFC is set to the slight rich set adjustment amount $AFCsrich_1$ (value of an extent similar to slight rich set adjustment amount AFCsrich of example shown in FIG. 16). At this time, the output air-fuel ratio AFup of the upstream side air-fuel ratio sensor 40 becomes an air-fuel ratio which corresponds to the slight rich set air-fuel ratio. However, due to deviation of the output air-fuel ratio of the upstream side air-fuel ratio sensor 40, the actual air-fuel ratio of the exhaust gas becomes an air-fuel ratio leaner than the rich set air-fuel ratio (broken line of FIG. 21).

In the example shown in FIG. 21, during the time $t_1$ to the time $t_4$, control similar to the example shown in FIG. 16 is performed. Therefore, at the time $t_1$ when the output air-fuel ratio AFdwn of the downstream side air-fuel ratio sensor 41 becomes the rich judged air-fuel ratio AFrich or less, the air-fuel ratio adjustment amount AFC is switched to the lean set adjustment amount AFClean. Then, at the time $t_2$ when the output air-fuel ratio AFdwn of the downstream side air-fuel ratio sensor 41 becomes greater than the rich judged air-fuel ratio AFrich, the air-fuel ratio adjustment amount AFC is switched to the slight lean set air-fuel ratio AFCslean. In addition, at the time $t_3$ when the output air-fuel ratio AFdwn of the downstream side air-fuel ratio sensor 41 becomes the lean judged air-fuel ratio AFlean or more, the air-fuel ratio adjustment amount AFC is switched to the rich set adjustment amount AFCrich.

In this regard, at the time $t_5$, the absolute value of the cumulative oxygen excess/deficiency ΣOED at the oxygen increase time period Tinc (time $t_1$ to time $t_3$) is calculated as $R_1$. Similarly, the absolute value of the cumulative oxygen excess/deficiency ΣOED at the oxygen decrease time period Tdec (time $t_3$ to time $t_5$) is calculated as $F_1$. Further, in the example shown in FIG. 21, the difference (excess/deficiency error) ΔΣOED between the absolute value $R_1$ of the cumulative oxygen excess/deficiency at the oxygen increase time period Tinc and the absolute value $F_1$ of the cumulative oxygen excess/deficiency at the oxygen decrease time period Tdec becomes a predetermined promotion judgment reference value or more. Therefore, in the example shown in FIG. 21, at the time $t_4$, it is judged that it is necessary to promote updating of the learning value sfbg by learning control.

Therefore, in the present embodiment, at the time $t_4$, learning promotion control is started. Specifically, at the time $t_4$, the rich set adjustment amount AFCrich is decreased from $AFCrich_1$ to $AFCrich_2$. Accordingly, the rich degree of the rich set air-fuel ratio is increased. In addition, at the time $t_4$, the lean set adjustment amount AFClean is increased from $AFClean_1$ to $AFClean_2$, and the slight lean set adjustment amount AFCslean is increased from $AFCslean_1$ to $AFCslean_2$. Accordingly, the lean degrees of the lean set air-fuel ratio and the slight lean set air-fuel ratio are increased.

Further, in the present embodiment, similarly to the example shown in FIG. 16, at the time $t_4$, the learning value sfbg is updated by using the above formula (3), and then the control center air-fuel ratio AFR is corrected by using the above formula (4). As a result, at the time $t_5$, the learning value sfbg is decreased, and the control center air-fuel ratio AFR is corrected to the rich side.

At the time $t_4$, if the air-fuel ratio adjustment amount AFC is switched to the increased lean set adjustment amount $AFClean_2$, the oxygen storage amount OSA of the upstream side exhaust purification catalyst 20 increases. The speed of increase of the oxygen storage amount OSA at this time is basically faster than the speed of increase during the times $t_1$ to $t_2$. Further, at the time $t_5$, after the air-fuel ratio adjustment amount AFC is switched to the increased slight lean set adjustment amount $AFCslean_2$, the speed of increase of the oxygen storage amount OSA is basically faster than the speed of increase during the times $t_2$ to $t_3$. Therefore, the time period from the time $t_4$ when the air-fuel ratio adjustment amount AFC is switched to the lean set adjustment amount AFClean to the time when the cumulative oxygen excess/deficiency ΣOED becomes the switching reference value OEDref or more, becomes shorter compared with before the time $t_4$.

Then, if, at the time $t_6$, the air-fuel ratio adjustment amount AFC is switched to the decreased rich set adjustment amount $AFCrich_2$, the oxygen storage amount OSA of the upstream side exhaust purification catalyst 20 decreases. The speed of decrease of the oxygen storage amount OSA at this time is basically faster than the speed of decrease during the times $t_3$ to $t_4$. Therefore, the time period from the times $t_6$ when the air-fuel ratio adjustment amount AFC is switched to the rich set adjustment amount AFCrich to the time $t_7$ when the output air-fuel ratio AFdwn of the downstream side air-fuel ratio sensor 41 becomes the rich judged air-fuel ratio AFrich or less, becomes shorter compared with before the time $t_5$.

At the time $t_7$, in the same way as the example shown in FIG. 16, the learning value sfbg is updated. That is, the time $t_4$ to the time $t_6$ corresponds to the oxygen increase time period Tinc. Accordingly, the absolute value of the cumulative oxygen excess/deficiency ΣOED in this time period can be expressed by the $R_2$ of FIG. 21. Further, the time $t_6$ to the time $t_7$ corresponds to the oxygen decrease time period Tdec. Accordingly, the absolute value of the cumulative oxygen excess/deficiency ΣOED in this time period can be expressed by the $F_2$ of FIG. 21. Further, based on the difference ΔΣOED ($=R_2-F_2$) of these absolute values $R_2$ and $F_2$, the learning value sfbg is updated using the above formula (3). In the present embodiment, after the time $t_7$ as well, similar control is repeated. Due to this, updating of the learning value sfbg is repeated.

Then, learning promotion control is repeated by a predetermined number of cycles (for example, the times $t_4$ to $t_7$ of FIG. 21) from when the output air-fuel ratio AFdwn of the downstream side air-fuel ratio sensor 41 reaches the rich judged air-fuel ratio AFrich or less, to when then it again reaches the rich judged air-fuel ratio AFrich or less, and then is ended. Alternatively, the learning promotion control may be ended after the elapse of a predetermined time from the learning promotion control. If the learning promotion control is ended, the rich set adjustment amount AFCrich is increased from $AFCrich_2$ to $AFCrich_1$. Accordingly, the rich degree of the rich set air-fuel ratio is decreased. In addition, the lean set adjustment amount AFClean is decreased from $AFClean_2$ to $AFClean_1$, and the slight rich set adjustment amount AFCslean is decreased from $AFCsrich_2$ to $AFCsrich_1$. Accordingly, the lean degree of the lean set air-fuel ratio is decreased.

In this regard, as explained above, by increasing the rich degree in the average value of the target air-fuel ratio (below, also referred to as "the average target air-fuel ratio") while the target air-fuel ratio is set to the rich air-fuel ratio after the time $t_4$, the time period from the time $t_4$ to the time $t_6$ becomes shorter. In addition, by increasing the lean degree in the average target air-fuel ratio while the target air-fuel ratio is set to the lean air-fuel ratio after the time $t_4$, the time period from the time $t_6$ to the time $t_7$ becomes shorter. Therefore, if considering these together, the time taken for one cycle from the time $t_4$ to the time $t_7$ becomes shorter (time $Tc_2$ of FIG. 21 becomes shorter than time $Tc_1$). On the other hand, as explained above, for updating the learning value sfbg, a cycle including an oxygen increasing time period Tinc and an oxygen decreasing time period Tdec is necessary. Therefore, in the present embodiment, it is possible to shorten the time duration of one cycle (for example, the time $t_4$ to the time $t_7$) necessary for updating the learning value sfbg, and thus is possible to promote updating of the learning value.

Further, as the method of promoting the updating of the learning value, it may be considered to increase the gains $k_b$ $k_2$, and $k_3$ at the above formulas (3), (5), (6). However, these gains $k_b$ $k_2$, and $k_3$ are normally set to values so that the learning value sfbg quickly converges to the optimal value. Therefore, if increasing these gains $k_1$, $k_2$, and $k_3$, the final convergence of the learning value sfbg is delayed. As opposed to this, when changing the rich set adjustment amount AFCrich, etc., these gains $k_1$, $k_2$, and $k_3$ are not changed, and therefore delay of the final convergence of the learning value sfbg is suppressed.

<Modification of Learning Promotion Control>

Note that, the above embodiments are predicated on the air-fuel ratio control of the first embodiment. However, similar control may be performed even in the case predicated on performing the air-fuel ratio control of the second embodiment. In this case, during execution of learning promotion control, the absolute value of the slight rich set adjustment amount AFCsrich is increased. That is, during learning promotion control, the rich degree of the slight rich set air-fuel ratio is increased.

Further, in the above embodiment, while performing learning promotion control, compared with when not performing learning promotion control, all of the rich degrees of the rich set air-fuel ratio and the slight rich set air-fuel ratio and the lean degrees of the lean set air-fuel ratio and slight lean set air-fuel ratio are increased. However, in learning promotion control, it is not necessarily required to increase all of these rich degrees and lean degrees. It is also possible to increase only part of them.

Figure 22:
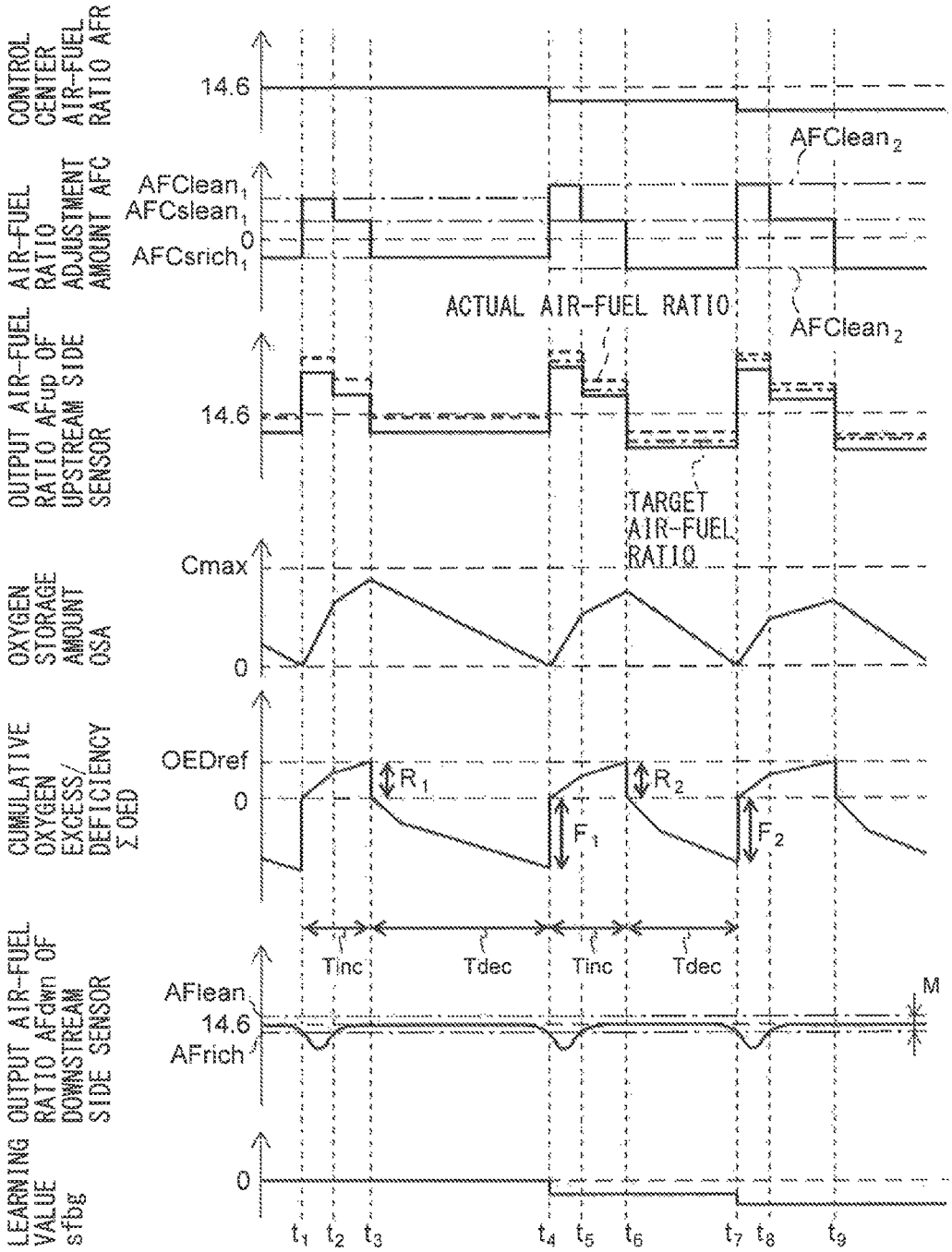
FIG. 22 is a time chart of the air-fuel ratio adjustment amount, etc., when performing learning promotion control.

For example, as shown in FIG. 22, during learning promotion control, it is possible to increase only the rich degree of the rich set air-fuel ratio and the lean degree of the lean set air-fuel ratio increase, and to maintain the lean degree of the slight lean set air-fuel ratio as they are without increasing them.

Further, for example, during learning promotion control, it is also possible to increase only the rich degrees of the rich set air-fuel ratio and the slight rich set air-fuel ratio, and to maintain the lean degrees of the lean set air-fuel ratio and slight lean set air-fuel ratio as they are without increasing them. In this case, by the lean degrees not being increased, the outflow of $NO_X$ from the upstream side exhaust purification catalyst 20 can be suppressed.

Similarly, for example, during learning promotion control, it is also possible to increase only the lean degrees of the lean set air-fuel ratio and slight lean set air-fuel ratio, and to maintain the rich degrees of the rich set air-fuel ratio and the slight rich set air-fuel ratio as they are without increasing them. In this case, by the rich degrees not being increased, the outflow of unburned gas from the upstream side exhaust purification catalyst 20 can be suppressed.

Further, in the above embodiment, in learning promotion control, the amounts or ratios for increasing the rich degrees of the rich set air-fuel ratio and the slight rich set air-fuel ratio and the lean degrees of the lean set air-fuel ratio and slight lean set air-fuel ratio are constant. However, the amounts or ratios for increasing these rich degrees and lean degrees may also differ from each other depending on the parameter.

In addition, in learning promotion control, the amount or ratio of increase of the rich degrees of the rich set air-fuel ratio and the slight rich set air-fuel ratio and the lean degrees of the lean set air-fuel ratio and slight lean set air-fuel ratio may be made smaller along with the elapse of time. That is, in learning promotion control, when increasing the lean degree of the average target air-fuel ratio while the target air-fuel ratio is set to the lean air-fuel ratio, the extent of increase of the lean degree may be set smaller the longer the elapsed time from when switching the target air-fuel ratio from the rich air-fuel ratio to the lean air-fuel ratio. Similarly, in learning promotion control, when increasing the rich degree of the average target air-fuel ratio while the target air-fuel ratio is set to the rich air-fuel ratio, the extent of increase of the rich degree may be set smaller the longer the elapsed time from when switching the target air-fuel ratio from the lean air-fuel ratio to the rich air-fuel ratio.

Summarizing the above, in the present embodiment, it can be said that when the learning promoting condition stands, which stands when it is necessary to promote the correction of the parameters by learning control, compared to when the learning promoting condition does not stand, at least one of the lean degree of the average target air-fuel ratio while the target air-fuel ratio is set to the lean air-fuel ratio and the rich degree of the average target air-fuel ratio while the target air-fuel ratio is set to the rich air-fuel ratio is increased.

Further, in the above embodiment, even when learning promotion control is performed, the gains $k_1$, $k_2$, and $k_3$ at the above formulas (3), (5), and (6) are not changed. However, when learning promotion control is performed, compared with when learning promotion control is not performed, the gains $k_1$, $k_2$, and $k_3$ may also be increased. Even in this case, in the present embodiment, when learning promotion control is performed, the rich set adjustment amount, etc., are changed, and therefore compared with when increasing only the gains $k_1$, $k_2$, and $k_3$, the extent of making the gains $k_1$, $k_2$, and $k_3$ increase is kept low. Therefore, delay in the final convergence of the learning value sfbg is suppressed.

<Flow Chart of Normal Learning Control>

Figure 23:
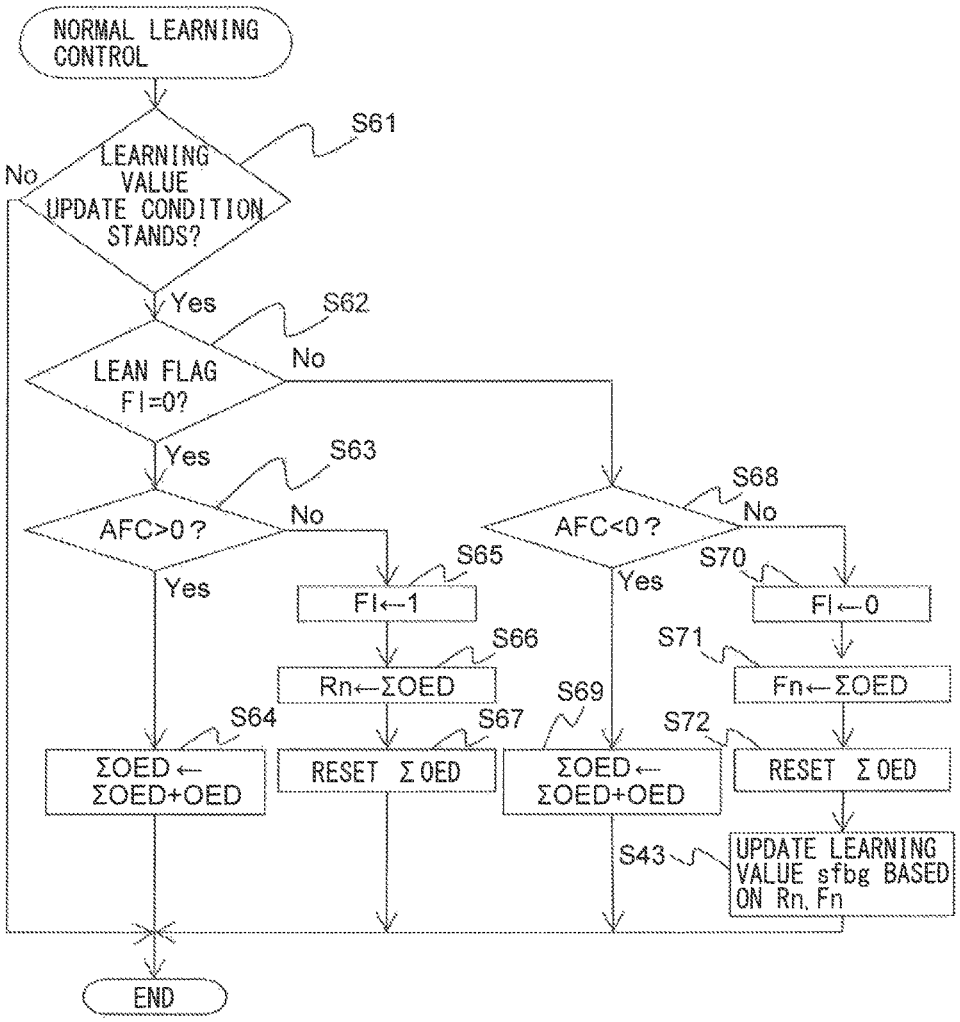
FIG. 23 is a flow chart which shows a control routine of normal learning control.

FIG. 23 is a flow chart which shows the control routine of normal leaning control. The illustrated control routine is performed by interruption every certain time interval.

As shown in FIG. 23, first, at step S61, it is judged if the condition for updating the learning value sfbg stands. As the case when the condition for updating stands, for example, normal control being performed, etc., may be mentioned. When it is judged at step S61 that the condition for updating the learning value sfbg stands, the routine proceeds to step S62. At step S62, it is judged if the lean flag F1 has been set to 0. When it is judged at step S62 that the lean flag F1 has been set to 0, the routine proceeds to step S63.

At step S63, it is judged if the air-fuel ratio adjustment amount AFC is larger than 0, that is, if the target air-fuel ratio is a lean air-fuel ratio. If, at step S63, it is judged that the air-fuel ratio adjustment amount AFC is larger than 0, the routine proceeds to step S64. At step S64, the cumulative oxygen excess/deficiency ΣOED is increased by the current oxygen excess/deficiency OED.

Then, if the target air-fuel ratio is switched to the rich air-fuel ratio, at the next control routine, at step S63, it is judged if the base air-fuel ratio adjustment amount AFCbase is 0 or less and thus the routine proceeds to step S65. At step S65, the lean flag F1 is set to 1, next, at step S66, Rn is made the absolute value of the current cumulative oxygen excess/deficiency ΣOED. Next, at step S67, the cumulative oxygen excess/deficiency ΣOED is reset to 0 and then the control routine is ended.

On the other hand, if the lean flag F1 is set to 1, at the next control routine, the routine proceeds from step S62 to step S68. At step S68, it is judged if the air-fuel ratio adjustment amount AFC is smaller than 0, that is, the target air-fuel ratio is the rich air-fuel ratio. When it is judged at step S68 that the air-fuel ratio adjustment amount AFC is smaller than 0, the routine proceeds to step S69. At step S69, the cumulative oxygen excess/deficiency ΣOED is increased by the current oxygen excess/deficiency OED.

Then, if the target air-fuel ratio is switched to the lean air-fuel ratio, at step S68 of the next control routine, it is judged that the air-fuel ratio adjustment amount AFC is 0 or more, then the routine proceeds to step S70. At step S70, the lean flag Fr is set to 0, then, at step S71, Fn is made the absolute value of the current cumulative oxygen excess/deficiency ΣOED. Next, at step S72, the cumulative oxygen excess/deficiency ΣOED is reset to 0. Next, at step S73, the the learning value sfbg is updated based on Rn which was calculated at step S66 and the Fn which was calculated at step S71, then the control routine is ended.

<Flow Chart of Learning Promotion Control>

Figure 24:
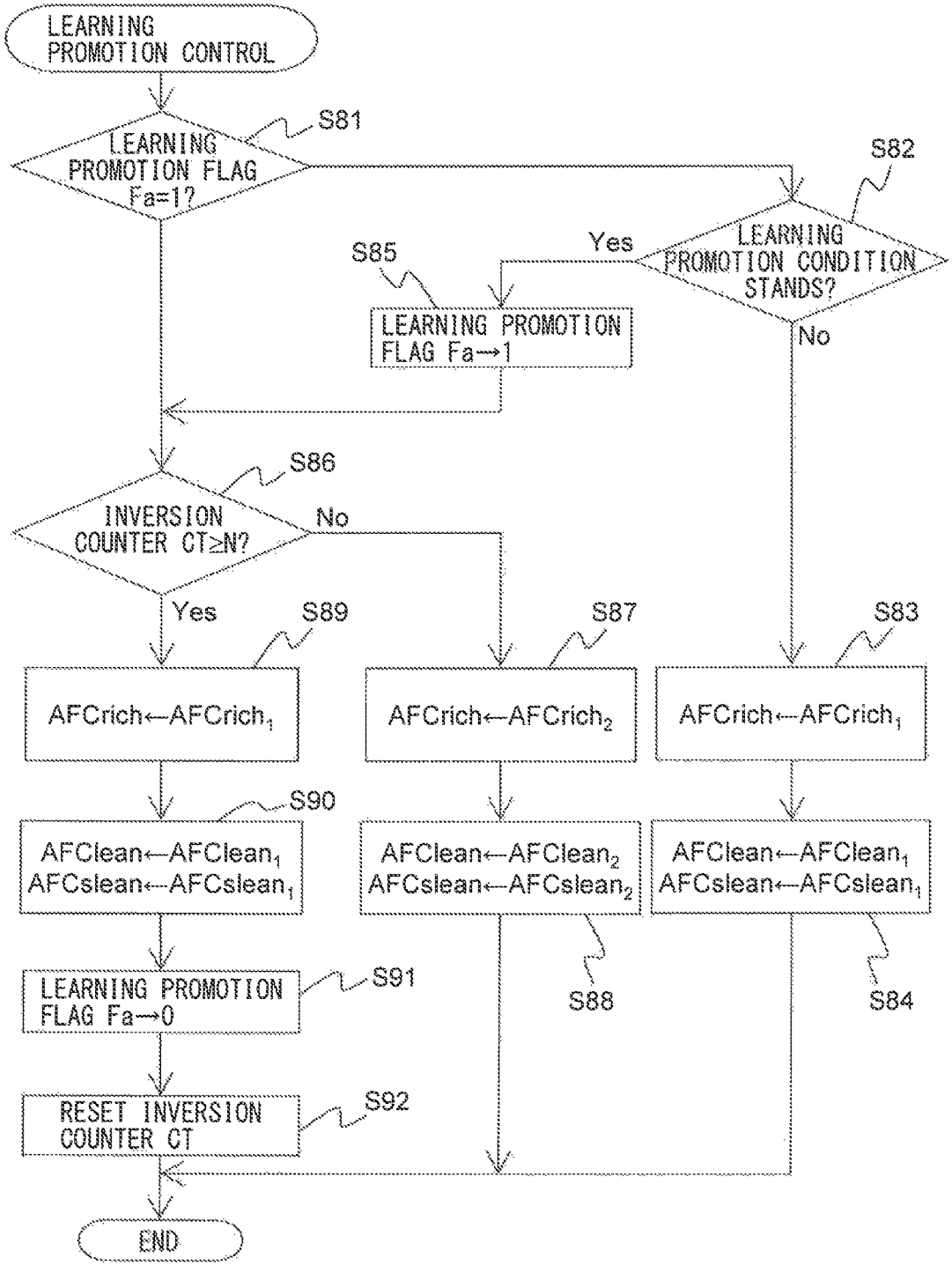
FIG. 24 is a flow chart which shows a control routine of learning promotion control.

FIG. 24 is a flow chart which shows the control routine of learning promotion control. The control routine which is shown in FIG. 24 is performed by interruption every certain time interval. As shown in FIG. 24, first, at step S81, it is judged if the learning promotion flag Fa has been set to "1". The learning promotion flag Fa is a flag which is set to "1" when learning promotion control is to be performed, while is set "0" otherwise. When it is judged at step S81 that the learning promotion flag Fa is set to "0", the routine proceeds to step S82.

At step S82, it is judged if the condition for promotion of learning stands. The condition for promotion of learning stands when it is necessary to promote updating of the learning value by learning control. Specifically, the condition for promotion of learning stands when the above-mentioned excess/deficiency error ΔΣOED is the promotion judgment reference value or more, when the output air-fuel ratio AFdwn of the downstream side air-fuel ratio sensor 41 is maintained in the middle region M over the stoichiometric air-fuel ratio promotion judged time or more, and when the output air-fuel ratio AFdwn of the downstream side air-fuel ratio sensor 41 is maintained at the lean air-fuel ratio or the rich air-fuel ratio over the lean air-fuel ratio promotion judged time or rich air-fuel ratio promotion judged time or more, etc. Alternatively, the condition for promotion of learning may stand when the value of the learning value update amount which is added to sfbg(n−1) in the above formulas (3), (5), and (6) is a predetermined reference value or more.

When it is judged at step S82 that the condition for promotion of learning does not stand, the routine proceeds to step S83. At step S83, the rich set adjustment amount AFCrich is set to $AFCrich_1$. Next, at step S84, the lean set adjustment amount AFClean and slight lean set adjustment amount AFClean are respectively set to $AFClean_1$ and $AFCslean_1$ and the control routine is ended.

On the hand, when it is judged at step S82, that the condition for promotion of learning stands, the routine proceeds to step S85. At step S85, the learning promotion flag Fa is set to "1". Next, at step S86, it is judged if the inversion counter CT is N or more. The inversion counter CT is a counter which is incremented by "1" each time the target air-fuel ratio is inverted between the rich air-fuel ratio and the lean air-fuel ratio.

When it is judged at step S86 that the inversion counter CT is less than N, that is, when it is judged that the number of times of inversion of the target air-fuel ratio is less than N, the routine proceeds to step S87. At step S87, the rich set adjustment amount AFCrich is set to $AFCrich_2$ which is larger in absolute value than $AFCrich_1$. Next, at step S88, the lean set adjustment amount AFClean is set to $AFClean_2$ which is larger in absolute value than $AFClean_1$, and the slight lean set adjustment amount AFCslean is set to $AFCslean_2$ which is larger in absolute value than $AFCslean_1$. After that, the control routine is ended.

If the target air-fuel ratio is inverted a plurality of times, at the next control routine, at step S86, it is judged that the inversion counter CT is N or more, and thus the routine proceeds to step S89. At step S89, the rich set adjustment amount AFCrich is set to $AFCrich_1$. Next, at step S90, the lean set adjustment amount AFClean and the slight lean set adjustment amount AFClean are respectively set to $AFClean_1$ and $AFCslean_1$. Next, at step S91, the learning promotion flag Fa is reset to "0" and, at step S92, the inversion counter CT is reset to "0", and then the control routine is ended.

REFERENCE SIGNS LIST

1 engine body
5 combustion chamber
7 intake port
9 exhaust port
19 exhaust manifold
20 upstream side exhaust purification catalyst
24 upstream side exhaust purification catalyst
31 ECU
40 upstream side air-fuel ratio sensor
41 downstream side air-fuel ratio sensor

The invention claimed is:

1. An internal combustion engine, comprising:

an exhaust purification catalyst which is arranged in an exhaust passage of the internal combustion engine and which can store oxygen;

a downstream side air-fuel ratio sensor which is arranged at a downstream side, in the direction of exhaust flow, of said exhaust purification catalyst and which detects the air-fuel ratio of the exhaust gas flowing out from said exhaust purification catalyst; and an electronic control unit configured to perform feedback control so that the air-fuel ratio of the exhaust gas flowing into said exhaust purification catalyst becomes a target air-fuel ratio, wherein said electronic control unit is configured to:

switch said target air-fuel ratio to a lean set air-fuel ratio which is leaner than a stoichiometric air-fuel ratio when the air-fuel ratio detected by said downstream side air-fuel ratio sensor becomes less than or equal to a rich judged air-fuel ratio, which is richer than the stoichiometric air-fuel ratio;

change said target air-fuel ratio to a lean air-fuel ratio with a smaller lean degree than said lean set air-fuel ratio at a predetermined lean degree changing timing after switching said target air-fuel ratio to said lean set air-fuel ratio and before an estimated value of said oxygen storage amount of the exhaust purification catalyst becomes greater than or equal to a predetermined switching reference storage amount, which is smaller than a maximum storable oxygen amount; and switch said target air-fuel ratio to a rich air-fuel ratio which is richer than the stoichiometric air-fuel ratio, when the estimated value of said oxygen storage amount of the exhaust purification catalyst becomes greater than or equal to said switching reference storage amount.

2. The internal combustion engine according to claim 1, wherein said lean degree change timing is a timing after the time when the air-fuel ratio detected by said downstream side air-fuel ratio sensor changes from said rich judged air-fuel ratio or less to an air-fuel ratio which is larger than said rich judged air-fuel ratio.

3. The internal combustion engine according to claim 1, wherein said lean degree change timing is a timing after the time when the elapsed time from when the air-fuel ratio detected by said downstream side air-fuel ratio sensor becomes said rich judged air-fuel ratio or less, becomes a predetermined time or more.

4. The internal combustion engine according to claim 1, wherein said target air-fuel ratio is maintained at a constant value from said lean degree change timing until the estimated value of said oxygen storage amount of the exhaust purification catalyst becomes said switching reference storage amount or more.

5. The internal combustion engine according to claim 1, wherein said lean set air-fuel ratio is changed in accordance with the air-fuel ratio detected by said downstream side air-fuel ratio sensor.

6. The internal combustion engine according to claim 1, wherein said electronic control unit is configured to:

switch said target air-fuel ratio to a rich set air-fuel ratio which is richer than the stoichiometric air-fuel ratio when the estimated value of said oxygen storage amount of the exhaust purification catalyst becomes greater than or equal to said switching reference storage amount; and change said target air-fuel ratio to a rich air-fuel ratio with a smaller difference from the stoichiometric air-fuel ratio than said rich set air-fuel ratio at a predetermined rich degree change timing after switching said target air-fuel ratio to said rich set air-fuel ratio and before the air-fuel ratio detected by said downstream side air-fuel ratio sensor becomes less than or equal to said rich judged air-fuel ratio.

7. The internal combustion engine according to claim 1, wherein an average lean degree of said target air-fuel ratio after said lean degree change timing is not changed between a case where the engine operating state is the steady operating state and low load operating state and a case where the engine operating state is not the steady operating state and is the medium-high load operating state.

8. The internal combustion engine according to claim 1, wherein said target air-fuel ratio is maintained at a constant rich set air-fuel ratio from when said target air-fuel ratio is switched to a rich air-fuel ratio to when the air-fuel ratio detected by said downstream side air-fuel ratio sensor becomes less than or equal to said rich judged air-fuel ratio.

9. The internal combustion engine according to claim 8, wherein said electronic control unit is configured to increase at least one of an average lean degree of said target air-fuel ratio while said target air-fuel ratio is set to the lean air-fuel ratio and an average rich degree of said target air-fuel ratio while said target air-fuel ratio is set to the rich air-fuel ratio, when the engine operating state is in the steady operating state and low load operating state, compared with when the engine operating state is not the steady operating state and is the medium-high load operating state.

10. The internal combustion engine according to claim 9, wherein said electronic control unit is configured to increase at least one of a lean degree of said lean set air-fuel ratio and a rich degree of said rich set air-fuel ratio, when the engine operating state is the steady operating state and low load operating state, compared with when the engine operating state is not the steady operating state and is the medium-high load operating state.

11. The internal combustion engine according to claim 1, wherein said electronic control unit is configured to:

perform learning control which corrects a parameter relating to said feedback control based on the output air-fuel ratio of said downstream side air-fuel ratio sensor; and increase at least one of an average lean degree of said target air-fuel ratio while said target air-fuel ratio is set to the lean air-fuel ratio and an average rich degree of said target air-fuel ratio while said target air-fuel ratio is set to the rich air-fuel ratio, when a learning promotion condition, which stands when it is necessary to promote correction of said parameter by said learning control, stands, compared with when said learning promotion condition does not stand.

12. The internal combustion engine according to claim 11, wherein even when said learning promotion condition stands, the lean degree of the air-fuel ratio is maintained as is without being increased from said lean degree change timing until the estimated value of said oxygen storage amount of the exhaust purification catalyst becomes said switching reference storage amount or more.

* * * * *